US007270945B2

(12) United States Patent
Goto

(10) Patent No.: US 7,270,945 B2
(45) **Date of Patent: *Sep. 18, 2007**

(54) IMAGE FORMING METHOD USING PHOTOTHERMOGRAPHIC MATERIAL

(75) Inventor: Narito Goto, Tokyo (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/620,153

(22) Filed: Jan. 5, 2007

(65) Prior Publication Data

US 2007/0105059 A1 May 10, 2007

Related U.S. Application Data

(62) Division of application No. 11/444,855, filed on Jun. 1, 2006, now Pat. No. 7,192,696, which is a division of application No. 11/113,914, filed on Apr. 25, 2005, now Pat. No. 7,129,030.

(30) Foreign Application Priority Data

May 7, 2004 (JP) ..... 2004-138709
Sep. 14, 2004 (JP) ..... 2004-266491

(51) Int. Cl.
*G03C 1/765* (2006.01)
*G03C 1/498* (2006.01)
*G03C 5/29* (2006.01)

(52) U.S. Cl. ..... 430/353; 430/403; 430/950

(58) Field of Classification Search ..... 430/353, 430/403, 496, 619, 950
See application file for complete search history.

(56) References Cited

U.S. PATENT DOCUMENTS 6,548,232 B2 * 4/2003 Goto ..... 430/350
7,129,030 B2 * 10/2006 Goto ..... 430/353
2003/0091347 A1 * 5/2003 Goto et al. ..... 396/564

FOREIGN PATENT DOCUMENTS

JP 2001-005136 * 1/2001
JP 2001-154311 * 6/2001
JP 2002-049125 * 2/2002
JP 2004-333813 * 11/2004

* cited by examiner

*Primary Examiner*—Richard L. Schilling
(74) *Attorney, Agent, or Firm*—Lucas & Mercanti, LLP

(57) ABSTRACT

A method of forming an image using a photothermographic material containing a support having thereon an image forming layer which contains an organic silver salt, silver halide grains, a binder and a reducing agent, the method including the steps of: imagewise exposing the photothermographic material to light to form a latent image; and simultaneously or sequentially heating the exposed photothermographic material to develop the latent image, wherein at least two matting agents are contained on one surface of the support, and an average particle size LA of Matting agent A and an average particle size LB of Matting agent B satisfy the following relationship: $1.5 \leqq LB/LA \leqq 6.0$, provided that Matting agent A is the matting agent having a largest weight ratio; and Matting agent B is the matting agent having a second largest weight ratio.

14 Claims, 2 Drawing Sheets

IMAGE FORMING METHOD USING PHOTOTHERMOGRAPHIC MATERIAL

This is a Divisional of U.S. patent application Ser. No. 11/444,855 filed Jun. 1, 2006 now U.S. Pat. No. 7,192,696, which was a Divisional of U.S. patent application Ser. No. 11/113,914 filed Apr. 25, 2005 now U.S. Pat. No. 7,192,030, which claimed the priority from Japanese Patent Application Nos. JP2004-138709 filed May 7, 2004 and JP2004-266491, filed Sep. 14, 2004, the priority of both prior U.S. applications and both Japanese priority applications are hereby claimed and all four applications are incorporated herein by reference.

TECHNICAL FIELD

The present invention relates to an image forming method using a specific photothermographic material containing a support having thereon an organic silver salt, silver halide grains, a binder and a reducing agent.

BACKGROUND

Heretofore, in the medical and printing plate-making fields, effluent generated by the wet process of image forming materials has resulted in problems for workability. In recent years, it has increasingly been demanded to reduce the processing effluent in view of environmental protection and space saving. Accordingly, silver salt photothermographic dry imaging materials capable of forming images by application of only heat have been practiced and increasingly employed in the aforesaid fields.

Silver salt photothermographic dry imaging materials themselves (hereinafter referred to as heat developable materials, photothermographic materials or simply as light-sensitive materials) were proposed a relatively long time ago (refer, for example, to Patent Documents 1 and 2).

This heat developable martial is processed employing a so-called thermal processor which applies constant heat onto heat developable materials to form images. As noted above, along with its rapid popularity in recent years, a large quantity of the above thermal processors have been offered on the market. On the other hand, depending on temperature and humidity, problems occur in which slippage properties between the light-sensitive material and conveying rollers of a thermal processor or processing members vary, resulting in unreliable conveyance as well as uneven density. Further, problems have occurred in which density of photothermographic materials varies over an elapse of time. It has been discovered that these phenomena are markedly generated in photothermographic materials which form images via heat development. Further, in recent years, a decrease in size of laser imagers as well as more rapid processing has been sought.

On that account, it has become essential that characteristics of photothermographic materials are enhanced. In order to achieve sufficient density even under rapid processing, it is effective to enhance covering power by increasing the number of color forming points, employing silver halide grains of a smaller average particle size as described in Japanese Patent Publication Open to Public Inspection (hereinafter referred to as JP-A) Nos. 11-295844 and 11-352627, to employ highly active reducing agents having a secondary or tertiary alkyl group as described in JP-A No. 2001-209145, or to employ development accelerators such as hydrazine compounds, vinyl compounds, as well as phenol derivatives or naphthol derivatives (refer to Patent Documents 3 and 4). However, in cases in which heat development and exposure are simultaneously performed, problems occur in which vibration in the exposed portion tends to be transferred to heat development portion due to the fact that the exposed portion is adjacent to the heat deployment portion. Trials have been made to stabilize conveyance by improving this point (refer to Patent Documents 5 and 6). On the other hand, as improvements from aspect of light-sensitive materials, techniques are disclosed in which in order to improve conveying characteristics during heat development and to minimize pin holes, surface roughness is controlled (refer to Patent Document 7).

(Patent Document 1) JP-A No. 2002-278017 (claims)
(Patent Document 2) JP-A No. 2003-066558 (claims)
(Patent Document 3) JP-A No. 2002-162692 (claims)
(Patent Document 4) JP-A No. 2004-085763 (claims)
(Patent Document 5) JP-A No. 2003-287862 (claims)
(Patent Document 6) JP-A No. 2004-004279 (claims)
(Patent Document 7) JP-A No. 2001-005136 (claims)

SUMMARY

However, in cases in which exposure and heat development are simultaneously performed, these improvement means are not sufficient to overcome the above drawbacks. Specifically, during rapid processing, uneven density and unreliable conveyance tends to occur. Further, during storage at relatively high temperatures, problems on an increase in fogging occurred.

In view of the above problems, the present invention was achieved. An object of the present invention is to provide an image forming method, employing a photothermographic material, which results in high image density, excellent retention quality of light irradiated images, minimizes uneven density and exhibits excellent conveyance properties during heat development, and minimizes fogging during storage at high temperature. Further, another object of the present invention is to provide an image forming method which results in excellent image retention quality during storage at high temperature, exhibits excellent film conveyance properties and excellent environmental adaptability.

In the present invention, diligent investigation was conducted to overcome drawbacks such as a decrease in image density, the degradation of retention quality under light irradiation, uneven density during heat development, poor conveyance, and an increase in fogging during storage at high temperature, which occurred when thermal photographic processing and quick development were simultaneously performed. As a result, it was discovered that the above object was achievable by employing a photothermographic material in which at least two types of matting agents were incorporated on the same surface side with respect to the support, and ratio LB/LA of the average particle diameter (in μm) of the aforesaid matting agents was 1.5-6.0, and by controlling the center line mean roughness (Ra(E)) of the uppermost surface on the image forming layer side to 125-200 nm and the center line average roughness (Ra(B)) of the uppermost surface on the back coat layer side to 105-200 nm. Subsequently, the present invention was achieved.

DESCRIPTION OF THE PREFERRED EMBODIMENTS

Figure 1:
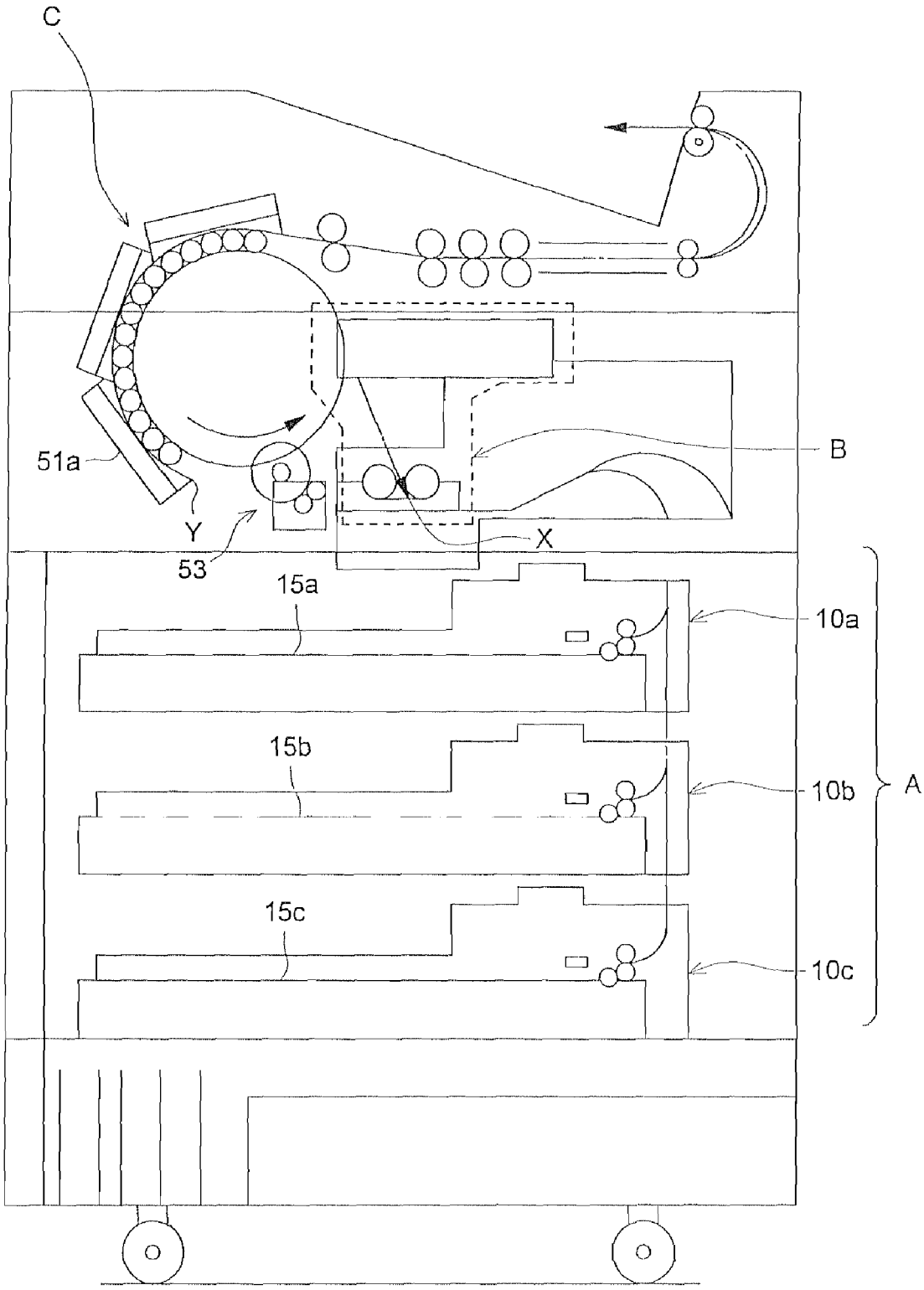
FIG. 1 is a schematic view showing the structure of the thermal processor loaded with a laser recording apparatus.

The aforesaid object of the present invention is achieved employing the embodiments described below.

(1) A method of forming an image using a photothermographic material containing a support having thereon an image forming layer which contains an organic silver salt, silver halide grains, a binder and a reducing agent, the method comprising the steps of:

imagewise exposing the photothermographic material to light to form a latent image; and simultaneously or sequentially heating the exposed photothermographic material to develop the latent image, wherein at least two matting agents are contained on one surface of the support, and an average particle size LA of Matting agent A and an average particle size LB of Matting agent B satisfy the following relationship:

$$1.5 \leqq LB/LA \leqq 6.0,$$

provided that Matting agent A is the matting agent having a largest weight ratio; and Matting agent B is the matting agent having a second largest weight ratio.

(2) The method of forming an image of the above-described item 1, wherein a weight ratio of Matting agent A to Matting agent B is between 55:45 and 99:1.

(3) The method of forming an image of the above-described items 1 or 2, wherein the average particle size LA is from 1.0 to 3.5 μm; and the average particle size LB is from 4.5 to 20.0 μm.

(4) A method of forming an image using a photothermographic material containing a support having:

an image forming layer which contains an organic silver salt, silver halide grains, a binder and a reducing agent on one side of the support; and a backing layer on the other side of the support opposite the image forming layer, the method comprising the steps of:

imagewise exposing the photothermographic material to light to form a latent image; and simultaneously or sequentially heating the exposed photothermographic material to develop the latent image, wherein a center-line mean roughness Ra (E) of an outermost surface of a side having the image forming layer is from 125 to 200 nm; or a center-line mean roughness Ra(B) of an outermost surface of a side having the backing layer is from 105 to 200 nm.

When the photothermographic material further has a protective layer on the image forming layer or on the backing layer, the outermost surface is a surface of the protective layer.

(5) The method of forming an image of the above-described item 4, wherein a ten-point mean roughness Rz(E) of the outermost surface of the side having the image forming layer is from 3.0 to 5.0 μm; or a ten-point mean roughness Rz(B) of the outermost surface of the side having the backing layer is from 5.0 to 8.0 μm, (6) The method of forming an image of any one of the above-described items 1 to 5, wherein each of the silver halide gains contains silver iodide in an amount of 5 to 100 mol %.

(7) The method of forming an image of any one of the above-described items 1 to 6, wherein a surface sensitivity of the silver halide grains decreases after heat development of the photothermographic material.

(8) The method of forming an image of any one of the above-described items 1 to 7, wherein a ratio of a ten-point mean roughness Rz(E) of all outermost surface of a side having the image forming layer to a ten-point mean roughness Rz(B) of an outermost surface of a side having the hacking layer, Rz(E)/Rz(B), is from 0.10 to 0.70.

(9) The method of forming an image of any one of the above-described items 1 to 8, wherein a ratio of a ten-point mean roughness $R_z(E)$ of an outermost surface of a side having the image forming layer to a center-line mean roughness $R_a(E)$ of the outermost surface of the side having the image forming layer, $R_z(E)/R_a(E)$, is from 10 to 70.

(10) The method of forming an image of any one of the above-described items 1 to 9, wherein a ratio of a ten-point mean roughness $R_z(B)$ of an outermost surface of a side having the backing layer to a center-line mean roughness $R_a(B)$ of the outermost surface of the side having the backing layer, $R_z(B)/R_a(B)$, is from 20 to 70.

(11) The method of forming an image of any one of the above-described items 1 to 10, wherein a transporting speed of the exposed photothermographic material during heating is from 20 to 200 mm/sec.

(12) The method of forming an image of any one of the above-described items 1 to 11, wherein imagewise exposure of the photothermographic material is carried out with a laser having a luminescence peak in the range of 350 to 450 nm.

According to the present invention, it is possible to provide an image forming method, employing photothermographic materials, which results in high image density, excellent image retention quality of light irradiated images, minimizes uneven density during heat development, results in excellent conveyance, and minimizes fogging during storage at high temperature. Further, it desired, it is also possible to provide an image forming method which results in excellent image retention quality during storage at high temperature or results in excellent film conveyance as well as environmental adaptability.

The preferred embodiments to practice the present invention will now be described; however, the present invention is not limited thereto.

The image forming method of the present invention is one which employs a photothermographic material incorporating a support having thereon an image forming layer containing organic silver salts, silver halides, binders, and reducing agents, and one of the features of this method is that a photothermographic material is employed in which at least two types of matting agents are incorporated on the same surface side with respect to the support of the above photothermographic material and LB/LA is 1.5-6.0, wherein A and B each represent matting agents A and B in the order of the larger ratio of the added amount, and the average particle diameter (in μm) of each matting agent is represented by LA and LB, respectively, and exposure and thermal photographic processing are simultaneously performed.

In one of the embodiments of the present invention, LB/LA is preferably 2.0-5.5, but is more preferably 2.5-5.0.

In one of the embodiments of the present invention, the added weight ratio of matting agent A and matting agent B is preferably 60:40-95:5, but is more preferably 65:35-90:10.

In one of the embodiments of the present invention, LA is preferably 1.3-3.3 μm, but is more preferably 1.6-3.0 μm, while LB is preferably 5.0-16.0 μm, but is more preferably 6.0-12.0 μm.

In one of the embodiments of the present invention, (Ra(E)) is preferably 130-180 nm, but is more preferably 135-160 nm, while (Ra(B)) is preferably 110-180 nm, but is more preferably 115-160 nm.

In one of the embodiments of the present invention, (Rz(E)) is preferably 3.2-4.7 μm, but is more preferably 3.4-4.5 μm, while (Rz(B)) is preferably 5.2-7.5 μm, but is more preferably 5.4-7.0 μm.

Further, by constituting an invention as described in the preferred embodiments of the present invention, it is possible to further improve conveyance properties during quick thermal photographic processing and to minimize uneven density.

The constituting elements of the present invention will now be described.

(Organic Silver Salts)

Organic silver salts usable in the present invention are those which are relatively stable in light and form silver images in the presence of exposed photocatalysts (latent images of light-sensitive silver halide) when heated to at least 80° C.

Such light-insensitive organic silver salts are described in paragraphs (0048)-(0049) of JP-A No. 10-62899; line 24 on page 18-line 37 on page 19 of European Patent Publication Open to Public Inspection No. 962812A1; JP-A Nos. 11-349591, 2000-7683, 2000-72711, 2002-23301, 2002-23303, and 2002-49119; Japanese Patent Publication No. 196446; European Patent Publication Open to Public Inspection Nos. 1246001A1 and 1258775A1; JP-A Nos. 2003-140290, 2003-195445, 2003-295378, 2003-295379, 2002-295380, and 2003-295381.

In the present invention, employed together with the above organic silver salts may be silver salts of aliphatic carboxylic acid, particularly silver salts of long chain aliphatic carboxylic acid (having 10-30, but preferably 15-28 carbon atoms). The molecular weight of aliphatic carboxylic acids for forming silver salts is preferably 200-500, but is more preferably 250-400. Preferred examples of aliphatic silver salts include silver behenate, silver arachidate, silver stearate, silver oleate, silver laurate, silver caproate, silver myristiate, silver palmitate, as well as mixtures thereof.

In the present invention, of these aliphatic acid silver salts, it is preferable to use aliphatic silver salts which incorporate silver behenate in an amount of preferably at least 50 mol percent, more preferably 80-99.9 mol percent, but still more preferably 90-99.9 mol percent.

Also employed as organic silver other than those described above may be core-shell organic silver salts (JP-A No. 2002-23303), silver salts of polyhydric carboxylic acids (European Patent No. 1,246,001 as well as JP-A No. 2004-061948), and polymer silver salts (JP-A Nos. 2000-292881, 2003-295378-2003-295381).

The form of organic silver salts usable in the present invention is not particularly limited and may include any of a needle form, a rod form, tabular form, or a scaly form. In the present invention, scaly organic silver salts are preferred. In addition, preferably employed are a short acicular form at a length ratio of the minor axis to the major axis of at least 5, a rectangular parallelepiped, a cube, and a potato-shaped irregular particle. Compared to long acicular particles at a length ratio of major axis to the minor axis of at least 5, these organic silver particles exhibit features in which fogging is decreased during heat development. Scaly organic acid silver salts, as described in the present invention, are defined as follows. Organic acid silver salts are observed employing an electron microscope, and the shape of the organic silver salt particles is approximated to a cube. Then, the sides of the cube are determined and are represented by a, b, and c in the order of the shortest to the longest, and x is obtained employing the formula below.

$$x=b/a$$

In such a manner, x, of about 200 particles, is determined and averaged. When the resulting average is represented by x (average), those which satisfy the relationship of x (average)≧1.5 are defined as being scaly. The above relationship is preferably 30≧x (average)≧1.5, but is more preferably 20≧x (average)≧2.0. Incidentally, a acicular form meets the relationship of 1≦x≦1.5.

With regard to the scaly particles, it is possible to regard "a" as thickness of tabular particles in which the plane having sides of "b" and "c" is the major plane. The average of "a" is preferably 0.01-0.23 μm, but is more preferably 0.1-0.20 μm. The average of c/b is preferably 1-6, is more preferably 1.05-4, is still more preferably 1.1-3, but is most preferably 1.1-2.

The particle size distribution of organic silver salts is preferably a monodispersion. In a monodispersion, as described herein, the percentage of the value obtained by dividing the standard deviation of each of the minor axis and the major axis by each of the length of the minor axis and the major axis is preferably at most 100 percent, is more preferably at most 80 percent, but is most preferably at most 50 percent. It is possible to determine the shape of organic silver salts utilizing electron microscopic images of an organic silver salt dispersion. Another method to determine monodispersion includes one in which the standard deviation of the volume weighted-average diameter of organic silver salts is determined. The percentage (being a variation coefficient) of the value, obtained by dividing by the volume weighted-average diameter, is preferably at most 100 percent, is more preferably at most 80 percent, but is most preferably at most 50 percent. The measurement method follows. For example, a laser beam is irradiated to organic silver salts dispersed into a liquid. Subsequently, it is possible to determine the above values based on the particle size (being a volume weighted-average diameter which is obtained by determining the autocorrelation function with respect to the time variation of the fluctuation of scattered light).

It is possible to produce and disperse organic acid silver employed in the present invention, by employing methods known in the art. It is possible to refer, for example, to the aforesaid JP-A No. 10-62899, European Patent Publication Open to Public Inspection Nos. 803763A1 and 9628122A1, as well as JP-A Nos. 2001-167022, 2000-7683, 2000-72711, 2001-1638899, 2001-163890, 2001-163827, 2001-33907, 2001-188313, 2001-83652, 2002-6442, 2002-31870, and 2003-280135.

Incidentally, during dispersion of organic silver salts, when light-sensitive salts are simultaneously present, fog increases and photographic speed markedly decreases. Due to that, it is preferable that during the dispersion, the substantial amount of light-sensitive silver salts is not incorporated. In the present invention, the amount of light-sensitive silver salts in an aqueous dispersion, into which those salts are dispersed, is preferably at most 1 mol per mol of the organic acid silver salts in the above liquid, but is more preferably at most 0.1 mol. It is further more preferable that the light-sensitive silver salts are not added.

In the present invention, it is possible to produce light-sensitive materials by blending an aqueous organic silver salt dispersion with an aqueous light-sensitive silver salt dispersion. The mixing ratio of the organic silver salts to the light-sensitive silver salts may be chosen depending on purposes. The ratio of the light-sensitive silver salts to the organic silver salts is preferably in the range of 1-30 mol percent, is more preferably 2-20 mol percent, but is most preferably 3-15 mol percent. When mixed, blending at least two types of aqueous organic silver salt dispersions with at least two types of aqueous light-sensitive silver salt dispersion is a method which is preferably employed to control photographic characteristics.

It is possible to use the organic silver salts of the present invention in the desired amount. However, an amount in terms of silver is preferably 0.1-5 g/m$^2$, is more preferably 0.3-3 g/m$^2$, but is still more preferably 0.5-3 g/m$^2$.

<Silver Halide Grains>

Photosensitive silver halide grains (hereinafter simply referred to as silver halide grains) will be described which are employed in the silver salt photothermographic dry imaging material of the present invention (hereinafter simply referred to as the photosensitive material of the present invention).

The photosensitive silver halide grains, as described in the present invention, refer to silver halide crystalline grains which can originally absorb light as an inherent quality of silver halide crystals, can absorb visible light or infrared radiation through artificial physicochemical methods and are treatment-produced so that physicochemical changes occur in the interior of the silver halide crystal and/or on the crystal surface, when the crystals absorb any radiation from ultraviolet to infrared.

Silver halide grains employed in the present invention can be prepared in the form of silver halide grain emulsions, employing publicly known methods. Namely, any of an acidic method, a neutral method, or an ammonia method may be employed. Further, employed as methods to allow water-soluble silver salts to react with water-soluble halides may be any of a single-jet precipitation method, a double-jet precipitation method, or combinations thereof. However, of these methods, the so-called controlled double-jet precipitation method is preferably employed in which silver halide grains are prepared while controlling formation conditions.

Grain formation is commonly divided into two stages, that is, the formation of silver halide seed grains (being nuclei) and the growth of the grains. Either method may be employed in which two stages are continually carried out, or in which the formation of nuclei (seed grains) and the growth of grains are carried out separately. A controlled double-jet precipitation method, in which grains are formed while controlling the pAg and pH which are grain forming conditions, is preferred, since thereby it is possible to control grain shape as well as grain size. For example, when the method, in which nucleus formation and grain growth are separately carried out, is employed, initially, nuclei (being seed grains) are formed by uniformly and quickly mixing water-soluble silver salts with water-soluble halides in an aqueous gelatin solution. Subsequently, under the controlled pAg and pH, silver halide grains are prepared through a grain growing process which grows the grains while supplying water-soluble silver salts as well as water-soluble halides.

After grain formation, unnecessary salts can be eliminated using a desalting method so as to obtain targeted silver halide grains. Examples of desalting methods are, a noodle method, a flocculation method, an ultrafiltering method and an electrodialysis.

In the present invention, silver halide grains are preferably in a state of monodispersion. Monodispersion, as described herein, means that the variation coefficient, obtained by the formula described below, is less than or equal to 30 percent. The aforesaid variation coefficient is preferably less than or equal to 20 percent, and is more preferably less than or equal to 15 percent.

Variation coefficient (in percent) of grain diameter=standard deviation of grain diameter/average of grain diameter×100

Cited as shapes of silver halide grains may be cubic, octahedral and tetradecahedral grains, planar grains, spherical grains, rod-shaped grains, and roughly elliptical-shaped grains. Of these, cubic, octahedral, tetradecahedral, and planar silver halide grains are particularly preferred.

When the aforesaid planar silver halide grains are employed, their average aspect ratio is preferably 1.5 to 100, and is more preferably 2 to 50. These are described in U.S. Pat. Nos. 5,264,337, 5,314,798, and 5,320,958, and incidentally it is possible to easily prepare the aforesaid target planar grains. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of (100), it is preferable that the ratio of the (100) surface on the external surface of silver halide grains is high. The ratio is preferably at least 50 percent, is more preferably at least 70 percent, and is most preferably at least 80 percent. Incidentally, it is possible to obtain a ratio of the surface having a Miller index of (100), based on T. Tani, J. Imaging Sci., 29, 165 (1985), utilizing adsorption dependence of sensitizing dye in a (111) plane as well as a (100) surface.

The silver halide grains, employed in the present invention, are preferably prepared employing low molecular weight gelatin, having an average molecular weight of less than or equal to 50,000 during the formation of the grains, which are preferably employed during formation of nuclei.

The low molecular weight gelatin refers to gelatin having an average molecular weight of less than or equal to 50,000. The molecular weight is preferably from 2,000 to 40,000, and is more preferably from 5,000 to 25,000. It is possible to measure the molecular weight of gelatin employing gel filtration chromatography.

The low molecular weight gelatin can be obtained from usually used gelatin with a molecular weight of about 100,000 employing various methods. Examples of such methods are, degradation of a high molecular weight gelatin solution with gelatin degradation enzyme, hydrolysis with acid or alkali under heating condition, thermal degradation under an atmospheric pressure or under pressure, ultrasonic degradation or using the combined method thereof.

The concentration of dispersion media during the formation of nuclei is preferably less than or equal to 5 percent by weight. It is more effective to carry out the formation at a low concentration of 0.05 to 3.00 percent by weight.

During formation of the silver halide grains employed in the present invention, it is possible to use a compound represented by the general formula described below.

$$YO(CH_2CH_2O)_m(CH(CH_3)CH_2O)_p(CH_2CH_2O)_nY \quad \text{General Formula}$$

wherein Y represents a hydrogen atom, —$SO_3M$, or —CO—B—COOM; M represents a hydrogen atom, an alkali metal atom, an ammonium group, or an ammonium group substituted with an alkyl group having less than or equal to 5 carbon atoms; B represents a chained or cyclic group which forms an organic dibasic acid; m and n each represents 0 through 50; and p represents 1 through 100.

When silver halide photosensitive photographic materials are produced, polyethylene oxides, represented by the above general formula, have been preferably employed as anti-foaming agents to counter marked foaming which occurs while stirring and transporting emulsion raw materials in a process in which an aqueous gelatin solution is prepared, in the process in which water-soluble halides as well as water-soluble silver salts are added to the gelatin solution, and in a process in which the resultant emulsion is applied onto a support. Techniques to employ polyethylene oxides as an anti-foaming agent are disclosed in, for example, JP-A No. 44-9497. The polyethylene oxides represented by the above general formula function as an anti-foaming agent during nuclei formation.

The content ratio of polyethylene oxides, represented by the above general formula, is preferably less than or equal to 1 percent by weight with respect to silver, and is more preferably from 0.01 to 0.10 percent by weight.

It is desired that polyethylene oxides, represented by the above general formula, are present during nuclei formation. It is preferable that they are previously added to the dispersion media prior to nuclei formation. However, they may also be added during nuclei formation, or they may be employed by adding them to an aqueous silver salt solution or an aqueous halide solution which is employed during nuclei formation. However, they are preferably employed by adding them to an aqueous halide solution, or to both aqueous solutions in an amount of 0.01 to 2.00 percent by weight. Further, it is preferable that they are present during at least 50 percent of the time of the nuclei formation process, and it is more preferable that they are present during at least 70 percent of the time of the same. The polyethylene oxides, represented by the above general formula, may be added in the form of powder or they may be dissolved in a solvent such as methanol and then added.

Incidentally, temperature during nuclei formation is commonly from 5 to 60° C., and is preferably from 15 to 50° C. It is preferable that the temperature is controlled within the range, even when a constant temperature, a temperature increasing pattern (for example, a case in which temperature at the initiation of nuclei formation is 25° C., subsequently, temperature is gradually increased during nuclei formation and the temperature at the completion of nuclei formation is 40° C.), or a reverse sequence may be employed.

The concentration of an aqueous silver salt solution and an aqueous halide solution, employed for nuclei formation, is preferably less than or equal to 3.5 M, and is more preferably in the lower range of 0.01 to 2.50 M. The silver ion addition rate during nuclei formation is preferably from $1.5\times10^{-3}$ to $3.0\times10^{-1}$ mol/minute, and is more preferably from $3.0\times10^{-3}$ to $8.0\times10^{-2}$ mol/minute.

The pH during nuclei formation can be set in the range of 1.7 to 10.0. However, since the pH on the alkali side broadens the particle size distribution of the formed nuclei, the preferred pH is from 2 to 6. Further, the pBr during nuclei formation is usually from about 0.05 to about 3.00, is preferably from 1.0 to 2.5, and is more preferably from 1.5 to 2.0.

In the present invention, an average grain size of silver halide grains is usually from 10 to 50 nm, preferably from 10 to 40 nm, and more preferably from 10 to 35 nm. When the average grain size is less than 10 nm, the image density may be decreased or light fastness of the image may be deteriorated. When the average grain size is more than 50 nm, the image density may be also decreased.

Incidentally, grain diameter, as described herein, refers to the edge length of silver halide grains which are so-called regular crystals such as a cube or an octahedron. Further, when silver halide gains are planar, the grain diameter refers to the diameter of the circle which has the same area as the projection area of the main surface.

When the silver halide grains are not regular crystals, such as spherical shape, rod shape, the grain sizes are calculated based on the sphere having the same volume. An average grain size can be obtained from 300 grains measured by electron microscope.

Further, in the present invention, by employing silver halide grains, at an average grain size of 55-100 nm, together with silver halide grains of an average grain size of 10-50 nm, it is possible to enhance image density and minimize a decrease in image density during storage. The ratio (being the weight ratio) of silver halide grains of an average grain size of 10-50 nm to silver halide grains of an average grain size of 55-100 nm is preferably 95:5-50:50, but is more preferably 90:10-60:40.

(Silver Halide Containing Silver Iodide in an Amount of 5-100 Mol Percent)

In silver halide grains of the present invention, with regard to silver halide compositions, the content of silver iodide is preferably 5-10 mol percent. When a silver iodide content ratio is in the above range, the composition distribution in a grain may be uniform or continuously varied. Further, preferably employed may be silver halide grains having a core/shell structure in which the silver iodide content ratio is greater in the interior and/or on the surface. Preferred as structures is a 2- to 5-layered structure. Core/shell grains of a 2- to 4-layered structure are more preferred. The silver iodide content ratio in the emulsions employed in the present invention is preferably 10-100 mol percent, is more preferably 40-100 mol percent, but is most preferably 90-100 mol percent. It is preferable that the silver halides of the present invention exhibit, between 350 and 440 nm, direct transition absorption due to the silver iodide crystalline structure. Detection of whether these silver halides exhibit direct transition absorption is readily performed by observing excitonic absorption near 400-430 nm due to direct transition. Introduction of silver iodide to silver halide grains is preferably performed employing a method in which an aqueous alkali iodide solution is added during grain formation, a method in which at lest one of minute silver iodide grains, minute silver iodobromide grains, minute iodochloride grains, or minute iodochlorobromide grains is added, and a method in which iodide ion releasing agents, described in JP-A Nos. 5-323487 and 6-11780, are employed.

<Silver Halide Grains of Internal Latent Formation after Thermal Development>

The photosensitive silver halide grains according to the present invention are characterized in that they have a property to change from a surface latent image formation type to an internal latent image formation type after subjected to thermal development. This change is caused by decreasing the speed of the surface latent image formation by the effect of thermal development.

When the silver halide grains are exposed to light prior to thermal development, latent images capable of functioning as a catalyst of development reaction are formed on the surface of the aforesaid silver halide grains. "Thermal development" is a reduction reaction by a reducing agent for silver ions. On the other hand, when exposed to light after the thermal development process, latent images are more formed in the interior of the silver halide grains than the surface thereof. As a result, the silver halide grains result in retardation of latent image formation on the surface.

It was not known in the field of a photothermographic material to employ the above-mentioned silver halide grains which largely change their latent image formation function before and after thermal development.

Generally, when photosensitive silver halide grains are exposed to light, silver halide grains themselves or spectral sensitizing dyes, which are adsorbed on the surface of photosensitive silver halide grains, are subjected to photoexcitation to generate free electrons. Generated electrons are competitively trapped by electron traps (sensitivity centers) on the surface or interior of silver halide grains. Accordingly, when chemical sensitization centers (chemical sensitization specks) and dopants, which are useful as an electron trap, are much more located on the surface of the silver halide grains than the interior thereof and the number is appropriate, latent images are dominantly formed on the surface, whereby the resulting silver halide grains become developable. Contrary to this, when chemical sensitization centers (chemical sensitization specks) and dopants, which are useful as an electron trap, are much more located in the interior of the silver halide grains than the surface thereof and the number is appropriate, latent images are dominantly formed in the interior, whereby it becomes difficult to develop the resulting silver halide grains. In other words, in the former, the surface speed is higher than interior speed, while in the latter, the surface speed is lower than the interior speed. The former type of latent image is called "a surface latent image", and the latter is called "an internal latent image". Examples of the references are:

(1) T. H. James ed., "The Theory of the Photographic Process" $4^{th}$ edition, Macmillan Publishing Co., Ltd. 1977; and (2) Japan Photographic Society, "Shashin Kogako no Kiso" (Basics of Photographic Engineering), Corona Publishing Co. Ltd., 1998.

The photosensitive silver halide grains of the present invention are preferably provided with dopants which act as electron trapping in the interior of silver halide grains at least in a stage of exposure to light after thermal development. This is required so as to achieve high photographic speed grains as well as high image keeping properties.

It is especially preferred that the dopants act as a hole trap during an exposure step prior to thermal development, and the dopants change after a thermal development step resulting in functioning as an electron trap.

Electron trapping dopants, as described herein, refer to silver, elements except for halogen or compounds constituting silver halide, and the aforesaid dopants themselves which exhibit properties capable of trapping free electron, or the aforesaid dopants are incorporated in the interior of silver halide grains to generate electron trapping portions such as lattice defects. For example, listed are metal ions other than silver ions or salts or complexes thereof, chalcogen (such as elements of oxygen family) sulfur, selenium, or tellurium, inorganic or organic compounds comprising nitrogen atoms, and rare earth element ions or complexes thereof.

Listed as metal ions, or salts or complexes thereof may be lead ions, bismuth ions, and gold ions, or lead bromide, lead carbonate, lead sulfate, bismuth nitrate, bismuth chloride, bismuth trichloride, bismuth carbonate, sodium bismuthate, chloroauric acid, lead acetate, lead stearate, and bismuth acetate.

Employed as compounds comprising chalcogen such as sulfur, selenium, and tellurium may be various chalcogen releasing compounds which are generally known as chalcogen sensitizers in the photographic industry. Further, preferred as organic compounds comprising chalcogen or nitrogen are heterocyclic compounds which include, for example, imidazole, pyrazole, pyridine, pyrimidine, pyrazine, pyridazine, triazole, triazine, indole, indazole, purine, thiazole, oxadiazole, quinoline, phthalazine, naphthylizine, quinoxaline, quinazoline, cinnoline, pteridine, acridine, phenanthroline, phenazine, tetrazole, thiazole, oxazole, benzimidazole, benzoxazole, benzothiazole, indolenine, and tetraazaindene. Of these, preferred are imidazole, pyrazine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzothiazole, and tetraazaindene.

Incidentally, the aforesaid heterocyclic compounds may have substituent(s). Preferable substituents include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, a phosphoric acid amide group, a halogen atom, a cyano group, a sulfo group, a carboxyl group, a nitro group, a heterocyclic group. Of these, more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amido group, a halogen atom, a cyano group, a nitro group, and a heterocyclic group. More preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group, and a heterocyclic group.

Incidentally, ions of transition metals which belong to Groups 6 through 11 in the Periodic Table may be chemically modified to form a complex employing ligands of the oxidation state of the ions and incorporated in silver halide grains employed in the present invention so as to function as an electron trapping dopant, as described above, or as a hole trapping dopant. Preferred as aforesaid transition metals are W, Fe, Co, Ni, Cu, Ru, Rh, Pd, Re, Os, Ir, and Pt.

In the present invention, aforesaid various types of dopants may be employed individually or in combination of at least two of the same or different types. It is required that at least one of the dopants act as an electron trapping dopant during an exposure time after being thermal developed. They may be incorporated in the interior of the silver halide grains in any forms of chemical states.

It is not recommended to use a complex or a salt of Ir or Cu as a single dopant without combining with other dopant.

The content ratio of dopants is preferably in the range of $1\times10^{-9}$ to $1\times10$ mol per mol of silver, and is more preferably $1\times10^{-6}$ to $1\times10^{-2}$ mol.

However, the optimal amount varies depending the types of dopants, the diameter and shape of silver halide grains, and ambient conditions. Accordingly, it is preferable that addition conditions are optimized taking into account these conditions.

In the present invention, preferred as transition metal complexes or complex ions are those represented by the general formula described below.

$$[ML_6]^m \qquad \text{General Formula}$$

wherein M represents a transition metal selected from the elements of Groups 6 through 11 in the Periodic Table; L represents a ligand; and m represents 0, -, 2-, 3-, or 4-. Listed as specific examples of ligands represented by L are a halogen ion (a fluoride ion, a chloride ion, a bromide ion, or an iodide ion), a cyanide, a cyanate, a thiocyanate, a selenocyanate, a tellurocyanate, an azide, and an aqua ligand, and nitrosyl and thionitrosyl. Of these, aqua, nitrosyl, and thionitrosyl are preferred. When the aqua ligand is present, one or two ligands are preferably occupied by the aqua ligand. L may be the same or different.

It is preferable that compounds, which provide ions of these metals or complex ions, are added during formation of silver halide grains so as to be incorporated in the silver halide grains. The compounds may be added at any stage of, prior to or after, silver halide grain preparation, namely nuclei formation, grain growth, physical ripening or chemical ripening. However, they are preferably added at the stage of nuclei formation, grain growth, physical ripening, are more preferably added at the stage of nuclei formation and growth, and are most preferably added at the stage of nuclei formation. They may be added over several times upon dividing them into several portions. Further, they may be uniformly incorporated in the interior of silver halide grains. Still further, as described in JP-A Nos. 63-29603, 2-306236, 3-167545, 4-76534, 6-110146, and 5-273683, they may be incorporated so as to result in a desired distribution in the interior of the grains.

These metal compounds may be dissolved in water or suitable organic solvents (for example, alcohols, ethers, glycols, ketones, esters, and amides) and then added. Further, addition methods include, for example, a method in which either an aqueous solution of metal compound powder or an aqueous solution prepared by dissolving metal compounds together with NaCl and KCl is added to a water-soluble halide solution, a method in which silver halide grains are formed by a silver salt solution, and a halide solution together with a the compound solution as a third aqueous solution employing a triple-jet precipitation method, a method in which, during grain formation, an aqueous metal compound solution in a necessary amount is charged into a reaction vessel, or a method in which, during preparation of silver halide, other silver halide grains which have been doped with metal ions or complex ions are added and dissolved. Specifically, a method is preferred in which either an aqueous solution of metal compound powder or an aqueous solution prepared by dissolving metal compounds together with NaCl and KCl is added to a water-soluble halide solution. When added onto the grain surface, an aqueous metal compound solution in a necessary amount may be added to a reaction vessel immediately after grain formation, during or after physical ripening, or during chemical ripening.

Incidentally, it is possible to introduce non-metallic dopants into the interior of silver halide employing the same method as the metallic dopants.

In the imaging materials in accordance with the present invention, it is possible to evaluate whether the aforesaid dopants exhibit electron trapping properties or not, while employing a method which has commonly employed in the photographic industry. Namely a silver halide emulsion comprised of silver halide grains, which have been doped with the aforesaid dopant or decomposition product thereof so as to be introduced into the interior of grains, is subjected to photoconduction measurement, employing a microwave photoconduction measurement method. Subsequently, it is possible to evaluate the aforesaid electron trapping properties by comparing the resulting decrease in photoconduction to that of the silver halide emulsion comprising no dopant as a standard. It is also possible to evaluate the same by performing experiments in which the internal speed of the aforesaid silver halide grains is compared to the surface speed.

Further, a method follows which is applied to a finished photothermographic dry imaging material to evaluate the electron trapping dopant effect in accordance with the present invention. For example, prior to exposure, the aforesaid imaging material is heated under the same conditions as the commonly employed thermal development conditions. Subsequently, the resulting material is exposed to white light or infrared radiation through an optical wedge for a definite time (for example, 30 seconds), and thermally developed under the same thermal development conations as above, whereby a characteristic curve (or a densitometry curve) is obtained. Then, it is possible to evaluate the aforesaid electron trapping dopant effect by comparing the speed obtained based on the characteristic curve to that of the imaging material which is comprised of the silver halide emulsion which does not comprise the aforesaid electron trapping dopant. Namely, it is necessary to confirm that the speed of the former sample comprised of the silver halide grain emulsion comprising the dopant in accordance with the present invention is lower than the latter sample which does not comprise the aforesaid dopant.

Speed of the aforesaid material is obtained based on the characteristic curve which is obtained by exposing the aforesaid material to white light or infrared radiation through an optical wedge for a definite time (for example 30 seconds) followed by developing the resulting material under common thermal development conditions. Further, speed of the aforesaid material is obtained based on the characteristic curve which is obtained by heating the aforesaid material under common thermal development conditions prior to exposure and giving the same definite exposure as above to the resulting material for the same definite time as above followed by thermally developing the resulting material under common thermal development conditions. The ratio of the latter speed to the former speed is preferably at most 1/10, and is more preferably at most 1/20. When the silver halide emulsion is chemically sensitized, the preferred photographic speed ratio is as low as not more than 1/50.

The silver halide grains of the present invention may be incorporated in a photosensitive layer employing an optional method. In such a case, it is preferable that the aforesaid silver halide grains are arranged so as to be adjacent to reducible silver sources (being aliphatic carboxylic silver salts) in order to get an imaging material having a high covering power (CP).

The silver halide of the present invention is previously prepared and the resulting silver halide is added to a solution which is employed to prepare aliphatic carboxylic acid silver salt particles. By so doing, since a silver halide preparation process and an aliphatic carboxylic acid silver salt particle preparation process are performed independently, production is preferably controlled. Further, as described in British Patent No. 1,447,454, when aliphatic carboxylic acid silver salt particles are formed, it is possible to almost simultaneously form aliphatic carboxylic acid silver salt particles by charging silver ions to a mixture consisting of halide components such as halide ions and aliphatic carboxylic acid silver salt particle forming components. Still further, it is possible to prepare silver halide grains utilizing conversion of aliphatic carboxylic acid silver salts by allowing halogen-containing components to act on aliphatic carboxylic acid silver salts. Namely, it is possible to convert some of aliphatic carboxylic acid silver salts to photosensitive silver halide by allowing silver halide forming components to act on the previously prepared aliphatic carboxylic acid silver salt solution or dispersion, or sheet materials comprising aliphatic carboxylic acid silver salts.

Silver halide grain forming components include inorganic halogen compounds, onium halides, halogenated hydrocarbons, N-halogen compounds, and other halogen containing compounds.

Specific examples are disclosed in; U.S. Pat. Nos. 4,009,039, 3,4757,075, 4,003,749; GB Pat. No. 1,498,956; and JP-A Nos. 53-27027, 53-25420.

Further, silver halide grains may be employed in combination which are produced by converting some part of separately prepared aliphatic carboxylic acid silver salts.

The aforesaid silver halide grains, which include separately prepared silver halide grains and silver halide grains prepared by partial conversion of aliphatic carboxylic acid silver salts, are employed commonly in an amount of 0.001 to 0.7 mol per mol of aliphatic carboxylic acid silver salts and preferably in an amount of 0.03 to 0.5 mol.

The separately prepared photosensitive silver halide particles are subjected to desalting employing desalting methods known in the photographic art, such as a noodle method, a flocculation method, an ultrafiltration method, and an electrophoresis method, while they may be employed without desalting.

<Chemical Sensitization>

The photosensitive silver halide of the present invention may undergo chemical sensitization. For instance, it is possible to create chemical sensitization centers (being chemical sensitization nuclei) utilizing compounds which release chalcogen such as sulfur, as well as noble metal compounds which release noble metals ions, such as gold ions, while employing methods described in, for example, JP-A Nos. 2001-249428 and 2001-249426.

The chemical sensitization nuclei is capable of trapping an electron or a hole produced by a photo-excitation of a sensitizing dye.

It is preferable that the aforesaid silver halide is chemically sensitized employing organic sensitizers containing chalcogen atoms, as described below.

It is preferable that the aforesaid organic sensitizers, comprising chalcogen atoms, have a group capable of being adsorbed onto silver halide grains as well as unstable chalcogen atom positions.

Employed as the aforesaid organic sensitizers may be those having various structures, as disclosed in JP-A Nos. 60-150046, 4-109240, and 11-218874. Of these, the aforesaid organic sensitizer is preferably at least one of compounds having a structure in which the chalcogen atom bonds to a carbon atom, or to a phosphorus atom, via a double bond. More specifically, a thiourea derivative having a heterocylic group and a triphenylphosphine derivative are preferred.

Chemical sensitization methods of the present invention can be applied based on a variety of methods known in the field of wet type silver halide materials. Examples are disclosed in: (1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing, 1979.

Specifically, when a silver halide emulsion is chemically sensitized, then mixed with a light-insensitive organic silver salt, the conventionally known chemical sensitizing methods can be applied.

The employed amount of chalcogen compounds as an organic sensitizer varies depending on the types of employed chalcogen compounds, silver halide grains, and reaction environments during performing chemical sensitization, but is preferably from $10^{-8}$ to $10^{-2}$ mol per mol of silver halide, and is more preferably from $10^{-7}$ to $10^{-3}$ mol. The chemical sensitization environments are not particularly limited. However, it is preferable that in the presence of compounds which diminish chalcogenized silver or silver nuclei, or decrease their size, especially in the presence of oxidizing agents capable of oxidizing silver nuclei, chalcogen sensitization is performed employing organic sensitizers, containing chalcogen atoms. The sensitization conditions are that the pAg is preferably from 6 to 11, but is more preferably from 7 to 10, while the pH is preferably from 4 to 10, but is more preferably from 5 to 8. Further, the sensitization is preferably carried out at a temperature of less than or equal to 30° C.

Further, it is preferable that chemical sensitization, employing the aforesaid organic sensitizers, is carried out in the presence of either spectral sensitizing dyes or compounds containing heteroatoms, which exhibit the adsorption onto silver halide grains. By carrying out chemical sensitization in the presence of compounds which exhibit adsorption onto silver halide grains, it is possible to minimize the dispersion of chemical sensitization center nuclei, whereby it is possible to achieve higher speed as well as lower fogging. Though spectral sensitizing dyes will be described below, the compounds comprising heteroatoms, which result in adsorption onto silver halide grains, as descried herein, refer to, as preferable examples, nitrogen containing heterocyclic compounds described in JP-A No. 3-24537. Listed as heterocycles in nitrogen-containing heterocyclic compounds may be a pyrazole ring, a pyrimidine ring, a 1,2,4-triazine ring, a 1,2,3-triazole ring, a 1,3,4-thiazole ring, a 1,2,3-thiazole ring, a 1,2,4-thiadiazole ring, a 1,2,5-thiadiazole ring, 1,2,3,4-tetrazole ring, a pyridazine ring, and a 1,2,3-triazine ring, and a ring which is formed by combining 2 or 3 of the rings such as a triazolotriazole ring, a diazaindene ring, a triazaindene ring, and a pentaazaindenes ring. It is also possible to employ heterocyclic rings such as a phthalazine ring, a benzimidazole ring, an indazole ring and a benzothiazole ring, which are formed by condensing a single heterocyclic ring and an aromatic ring.

Of these, preferred is an azaindene ring. Further, preferred are azaindene compounds having a hydroxyl group, as a substituent, which include compounds such as hydroxytriazaindene, tetrahydroxyazaindene, and hydroxypentaazaindene.

The aforesaid heterocyclic ring may have substituents other than a hydroxyl group. As substituents, the aforesaid heterocyclic ring may have, for example, an alkyl group, a substituted alkyl group, an alkylthio group, an amino group, a hydroxyamino group, an alkylamino group, a dialkylamino group, an arylamino group, a carboxyl group; an alkoxycarbonyl group, a halogen atom, and a cyano group.

The added amount of these heterocyclic compounds varies widely depending on the size and composition of silver halide grains, and other conditions. However, the amount is in the range of about $10^{-6}$ to 1 mol per mol with respect to silver halide, and is preferably in the range of $10^{-4}$ to $10^{-1}$ mol.

The photosensitive silver halide of the present invention may undergo noble metal sensitization utilizing compounds which release noble metal ions such as gold ions. For example, employed as gold sensitizers may be chloroaurates and organic gold compounds disclosed in JP-A No. 11-194447.

Further, other than the aforesaid sensitization methods, it is possible to employ a reduction sensitization method. Employed as specific compounds for the reduction sensitization may be ascorbic acid, thiourea dioxide, stannous chloride, hydrazine derivatives, boron compounds, silane compounds, and polyamine compounds. Further, it is possible to perform reduction sensitization by ripening an emulsion while maintaining a pH higher than or equal to 7 or a pAg less than or equal to 8.3.

Silver halide which undergoes the chemical sensitization, according to the present invention, includes one which has been formed in the presence of organic silver salts, another which has been formed in the absence of organic silver salts, or still another which has been formed by mixing those above.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization.

In order to decrease the effect of chemical sensitization after thermal development treatment, it is required to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

<Spectral Sensitization>

It is preferable that photosensitive silver halide in the present invention is adsorbed by spectral sensitizing dyes so as to result in spectral sensitization. Employed as spectral sensitizing dyes may be cyanine dyes, merocyanine dyes, complex cyanine dyes, complex merocyanine dyes, homopolar cyanine dyes, styryl dyes, hemicyanine dyes, oxonol dyes, and hemioxonol dyes. For example, employed may be sensitizing dyes described in JP-A Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes, employed in the present invention, are described in, for example, Research Disclosure, Item 17645, Section IV-A (page 23, December 1978) and Item 18431, Section X (page 437, August 1978) and publications further cited therein. It is specifically preferable that those sensitizing dyes are used which exhibit spectral sensitivity suitable for spectral characteristics of light sources of various types of laser imagers, as well as of scanners. For example, preferably employed are compounds described in JP-A Nos. 9-34078, 9-54409, and 9-80679.

Useful cyanine dyes include, for example, cyanine dyes having basic nuclei such as a thiazoline nucleus, an oxazoline nucleus, a pyrroline nucleus, a pyridine nucleus, an oxazole nucleus, a thiazole nucleus, a selenazole nucleus, and an imidazole nucleus. Useful merocyanine dyes, which are preferred, comprise, in addition to the basic nuclei, acidic nuclei such as a thiohydantoin nucleus, a rhodanine nucleus, an oxazolizinedione nucleus, a thiazolinedione nucleus, a barbituric acid nucleus, a thiazolinone nucleus, a maronitryl nucleus, and a pyrazolone nucleus.

In the present invention, it is possible to employ sensitizing dyes which exhibit spectral sensitivity, specifically in the infrared region. Listed as preferably employed infrared spectral sensitizing dye are infrared spectral sensitizing dyes disclosed in U.S. Pat. Nos. 4,536,473, 4,515,888, and 4,959,294.

It is preferred that the imaging material of the present invention incorporates at least one sensitizing dye represented by the following General Formulas (SD-1) or (SD-2).

General Formula (SD-1)

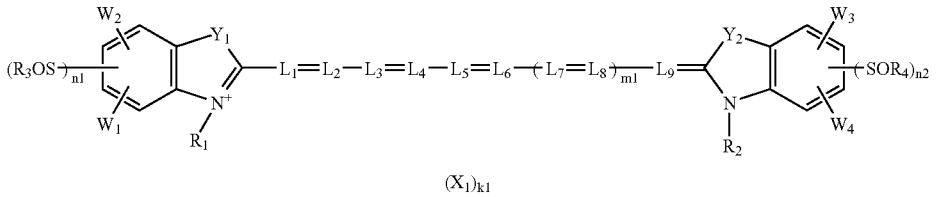

-continued

General Formula (SD-2)

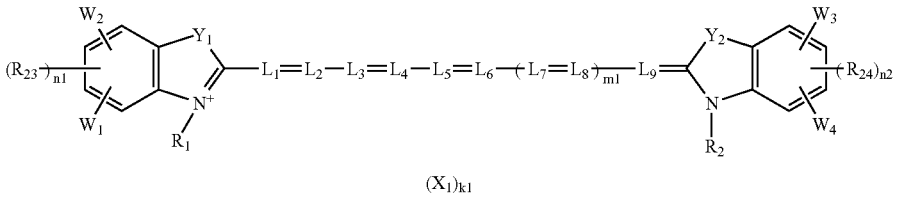

wherein $Y_1$ and $Y_2$ each represent an oxygen atom, a sulfur atom, a selenium atom, or —CH═CH—; $L_1$-$L_9$ each represent a methine group; $R_1$ and $R_2$ each represent an aliphatic group; $R_3$, $R_4$, $R_{23}$, and $R_{24}$ each represent a lower alkyl group, a cycloalkyl group, an alkenyl group, an aralkyl group, an aryl group, or a heterocyclic group; $W_1$, $W_2$, $W_3$, and $W_4$ each represent a hydrogen atom, a substituent, or a group of non-metallic atoms necessary for forming a condensed ring while combined between $W_1$ and $W_2$ and $W_3$ and $W_4$ or represent a group of non-metallic atoms necessary for forming a 5- or 6-membered condensed ring while combined between $R_3$ and $W_1$, $R_3$ and $W_2$, $R_{23}$ and $W_1$, $R_{23}$ and $W_2$, $R_4$ and $W_3$, $R_4$ and $W_4$, $R_{24}$ and $W_3$, or $R_{24}$ and $W_4$; $X_1$ represents an ion necessary for neutralizing the charge in the molecule; $k_1$ represents the number of ions necessary for neutralizing the charge in the molecule; m1 represents 0 or 1; and n1 and n2 each represent 0, 1, or 2, however, n1 and n2 should not represent 0 at the same time.

It is possible to easily synthesize the aforesaid infrared sensitizing dyes, employing the method described in F. M. Harmer, "The Chemistry of Heterocyclic Compounds, Volume 18, The Cyanine Dyes and Related Compounds (A. Weissberger ed., published by Interscience, New York, 1964).

These infrared sensitizing dyes may be added at any time after preparing the silver halide. For example, the dyes may be added to solvents, or the dyes, in a so-called solid dispersion state in which the dyes are dispersed into minute particles, may be added to a photosensitive emulsion comprising silver halide grains or silver halide grains/aliphatic carboxylic acid silver salts. Further, in the same manner as the aforesaid heteroatoms containing compounds which exhibit adsorption onto silver halide grains, the dyes are adsorbed onto silver halide grains prior to chemical sensitization, and subsequently, undergo chemical sensitization, whereby it is possible to minimize the dispersion of chemical sensitization center nuclei so at to enhance speed, as well as to decrease fogging.

In the present invention, the aforesaid spectral sensitizing dyes may be employed individually or in combination. Combinations of sensitizing dyes are frequently employed when specifically aiming for supersensitization, for expanding or adjusting a spectral sensitization range.

An emulsion comprising photosensitive silver halide as well as aliphatic carboxylic acid silver salts, which are employed in the silver salt photothermographic dry imaging material of the present invention, may comprise sensitizing dyes together with compounds which are dyes having no spectral sensitization or have substantially no absorption of visible light and exhibit supersensitization, whereby the aforesaid silver halide grains may be supersensitized.

Useful combinations of sensitizing dyes and dyes exhibiting supersensitization, as well as materials exhibiting supersensitization, are described in Research Disclosure Item 17643 (published December 1978), page 23, Section J of IV; Japanese Patent Publication Nos. 9-25500 and 43-4933; and JP-A Nos. 59-19032, 59-192242, and 5-431432. Preferred as supersensitizers are hetero-aromatic mercapto compounds or mercapto derivatives.

Ar—SM wherein M represents a hydrogen atom or an alkali metal atom, and Ar represents an aromatic ring or a condensed aromatic ring, having at least one of a nitrogen, sulfur, oxygen, selenium, or tellurium atom. Hetero-aromatic rings are preferably benzimidazole, naphthoimidazole, benzimidazole, naphthothiazole, benzoxazole, naphthooxazole, benzoselenazole, benztellurazole, imidazole, oxazole, pyrazole, triazole, triazine, pyrimidine, pyridazine, pyrazine, pyridine, purine, quinoline, or quinazoline. On the other hand, other hetero-aromatic rings are also included.

Incidentally, mercapto derivatives, when incorporated in the dispersion of aliphatic carboxylic acid silver salts and/or a silver halide grain emulsion, are also included which substantially prepare the mercapto compounds. Specifically, listed as preferred examples are the mercapto derivatives described below.

Ar—S—S—Ar wherein Ar is the same as the mercapto compounds defined above.

The aforesaid hetero-aromatic rings may have a substituent selected from the group consisting of, for example, a halogen atom (for example, Cl, Br, and I), a hydroxyl group, an amino group, a carboxyl group, an alkyl group (for example, an alkyl group having at least one carbon atom and preferably having from 1 to 4 carbon atoms), and an alkoxy group (for example, an alkoxy group having at least one carbon atom and preferably having from 1 to 4 carbon atoms).

Other than the aforesaid supersensitizers, employed as supersensitizers may be compounds represented by General Formula (5), shown below, which is disclosed in JP-A No. 2001-330918 and large ring compounds containing a hetero atom.

The amount of a supersensitizer of the present invention used in a photosensitive layer containing an organic silver salt and silver halide grains and in the present invention is in the range of 0.001 to 1.0 mol per mol of Ag. More preferably, it is 0.01 to 0.5 mol per mol of Ag.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization.

In order to decrease the effect of chemical sensitization after thermal development treatment, it is required to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

(Reducing Agents)

In the present invention, as reducing agents (silver ion reducing agents), at least one of the compounds represented by General Formula (1) below is used singly or in combinations with other reducing agents having a different structure.

General Formula (1)

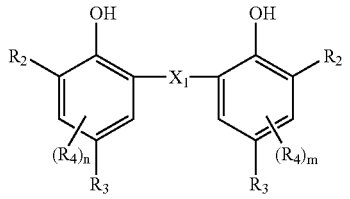

In the above formula, $X_1$ represents a chalcogen atom or $CHR_1$ wherein $R_1$ represents a hydrogen atom, a halogen atom, an alkyl group, an alkenyl group, or a heterocyclic group. Each $R_2$ represents an alkyl group and they may be the same or different. $R_3$ represents a hydrogen atom or a group capable of being substituted to a benzene ring. $R_4$ represents a group capable of being substituted to a benzene ring, while m and n each represents an integer of 0-2.

Of the compounds represented by General Formula (1), it is more preferable to employ high activity reducing agents (hereinafter referred to as General Formula (1a) Compound) in which at least one of $R_2$s is a secondary or tertiary alkyl group, because it is possible to produce photothermographic materials which result in high density as well as excellent image retention quality after light irradiation. In the present invention, it is preferable that in order to yield desired tone, General Formula (1a) Compound is simultaneously used with the compounds represented by General Formula (2) below.

General Formula (2)

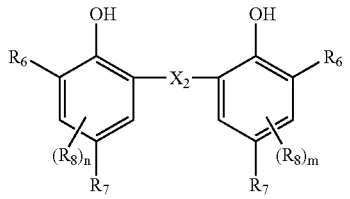

wherein $X_2$ represents a chalcogen atom or $CHR_5$ wherein $R_5$ represents a hydrogen atom, a halogen atom, an alkyl group, an alkenyl group, an aryl group, or a heterocyclic group; each $R_6$ represents an alkyl group which may be the same or different, but may not be a secondary or tertiary alkyl group; $R_7$ represents a hydrogen atom or a group capable of being substituted on a benzene ring; $R_8$ represents a group capable of being substituted on a benzene ring; and m and n each represents an integer of 0-2.

As a combination use ratio, being (weight of General Formula (1a) Compound):(weight of compound represented by General Formula (2) is preferably 5:95-45:55, but is more preferably 10:90-40:60.

$X_1$ in General Formula (RED) represents a chalcogen atom or $CHR_1$. Specifically listed as chalcogen atoms are a sulfur atom, a selenium atom, and a tellurium atom. Of these, a sulfur atom is preferred.

$R_1$ in $CHR_1$ represents a hydrogen atom, a halogen atom, an alkyl group, an alkenyl group, an alkynyl group, an aryl group or a heterocyclic group. Listed as halogen atoms are, for example, a fluorine atom, a chlorine atom, and a bromine atom. Listed as alkyl groups are, alkyl groups having 1-20 carbon atoms, for example, a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocylic groups are, a thienyl group, a furyl group, an imidazolyl group, a pyrazolyl group and a pyrrolyl group. Of these, cyclic groups such as cycloalkyl groups and cycloalkenyl groups are preferred.

These groups may have a substituent. Listed as said substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group) and an alkylsulfinylaminocarbonyl group (for example, a methanesulfinylaminocarbonyl group or an ethanesulfinylaminocarbonyl group). Further, when at least two substituents are present, they may be the same or different. Most preferred substituent is an alkyl group.

$R_2$ represents an alkyl group. Preferred as the alkyl groups are those, having 1-20 carbon atoms, which are substituted or unsubstituted. Specific examples include a methyl, ethyl, i-propyl, butyl, i-butyl, t-butyl, t-pentyl, t-octyl, cyclohexyl, 1-methylcyclohexyl, or 1-methylcyclopropyl group.

Substituents of the alkyl group are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. In addition, $(R_4)_n$ and $(R_4)_m$ may form a saturated ring. $R_2$ is preferably a secondary or tertiary alkyl group and preferably has 2-20 carbon atoms. $R_2$ is more preferably a tertiary alkyl group, is still more preferably a t-butyl group, a t-pentyl group, or a methylcyclohexyl group, and is most preferably a t-butyl group.

$R_3$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino(group, a sulfamoyl group, a carbamoyl group, an alkylthio group, a sulfonyl group, an alkylsulfonyl group, a sulfonyl group, a cyano group, and a heterocyclic group.

Preferably listed as $R_3$ are methyl, ethyl, i-propyl, t-butyl, cyclohexyl, 1-methylcyclohexyl, and 2-hydroxyethyl. Of these, more preferably listed is 2-hydroxyethyl.

These groups may further have a substituent. Employed as such substituents may be those listed in aforesaid $R_1$. Further, $R_3$ is more preferably an alkyl group having 1-10 carbon atoms. and having a hydroxyl group or a precursor thereof. Still more preferably, $R_3$ is an alkyl group having 1-5 carbon atoms. Specifically listed is a 2-hydroxyethyl group. The most preferred combination of $R_2$ and $R_3$ is that $R_2$ is a tertiary alkyl group (t-butyl, or 1-methylcyclohexyl) and $R_3$ is an alkyl group, such as a 2-hydroxyethyl group, which has, as a substituent, a hydroxyl group or a group capable of forming a hydroxyl group while being deblocked. Incidentally, a plurality of $R_2$ and $R_3$ is may be the same or different.

$R_4$ represents a group capable of being substituted to a benzene ring. Listed as specific examples may be an alkyl group having 1-25 carbon atoms (methyl, ethyl, propyl, i-propyl, t-butyl, pentyl, hexyl, or cyclohexyl), a halogenated alkyl group (trifluoromethyl or perfluorooctyl), a cycloalkyl group (cyclohexyl or cyclopentyl); an alkynyl group (propagyl), a glycidyl group, an acrylate group, a methacrylate group, an aryl group (phenyl), a heterocyclic group (pyridyl, thiazolyl, oxazolyl, imidazolyl, furyl, pyrrolyl, pyradinyl, pyrimidyl, pyridadinyl, selenazolyl, piperidinyl, sliforanyl, piperidinyl, pyrazolyl, or tetrazolyl), a halogen atom (chlorine, bromine, iodine or fluorine), an alkoxy group (methoxy, ethoxy, propyloxy, pentyloxy, cyclopentyloxy, hexyloxy, or cyclohexyloxy), an aryloxy group (phenoxy), an alkoxycarbonyl group (methyloxycarbonyl, ethyloxycarbonyl, or butyloxycarbonyl), an aryloxycarbonyl group (phenyloxycarbonyl), a sulfonamido group (methanesulfonamide, ethanesulfonamide, butanesulfonamide, hexanesulfonamide group, cyclohexabesulfonamide, benzenesulfonamide), sulfamoyl group (aminosulfonyl, methyaminosulfonyl, dimethylaminosulfonyl, butylaminosulfonyl, hexylaminosulfonyl, cyclohexylaminosufonyl, phenylaminosulfonyl, or 2-pyridylaminosulfonyl), a urethane group (methylureido, ethylureido, pentylureido, cyclopentylureido, phenylureido, or 2-pyridylureido), an acyl group (acetyl, propionyl, butanoyl, hexanoyl, cyclohexanoyl, benzoyl, or pyridinoyl), a carbamoyl group (aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (acetamide, propionamide, butaneamide, hexaneamide, or benzamide), a sulfonyl group (methylsulfonyl, ethylsulfonyl, butylsulfonyl, cyclohexylsulfonyl, phenylsulfonyl, or 2-pyridylsulfonyl), an amino group (amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of 0-2. However, the most preferred case is that both n and m are 0. A plurality of $R_4$s may be the same or different.

Further, $R_4$ may form a saturated ring together with $R_2$ and $R_3$. $R_4$ is preferably a hydrogen atom, a halogen atom, or an alkyl group, and is more preferably a hydrogen atom.

In General Formula (2), $R_5$ is a group similar to $R_1$, and $R_7$ is a group similar to $R_3$, while $R_8$ is a group similar to $R_4$. Each $R_6$ represents an alkyl group which may be the same or different, but are neither a secondary nor tertiary alkyl group. Preferred as alkyl groups are those which are substituted or unsubstituted and have 1-20 carbon atoms. Specific examples include a methyl group, an ethyl group, a propyl group and a butyl group.

Substituents of the alkyl group are not particularly limited, and examples include an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group, and a halogen atom. Further, a saturated ring may be formed with $(R_8)_n$ and $(R_8)_m$. $R_6$ is preferably methyl. Some of these compounds represented by General Formula (2) are preferably employed.

These compounds satisfy General Formulas (S) and (T) described in European Patent No. 1,278,101, and specific examples of the compounds include compounds (1-24), (1-28)-(1-54), and (1-56)-(1-75).

Specific examples of the compounds represented by General Formulas (1) and (2) are listed below, however, the present invention is not limited thereto.

(1-1)
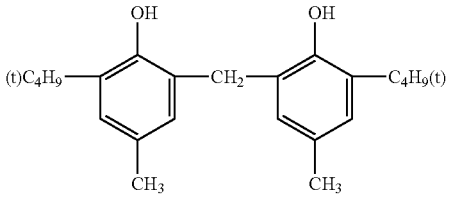
(1-2)
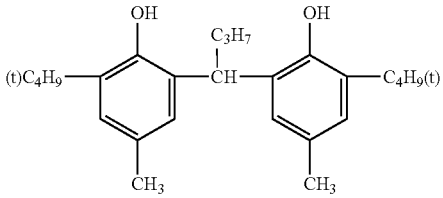
(1-3)
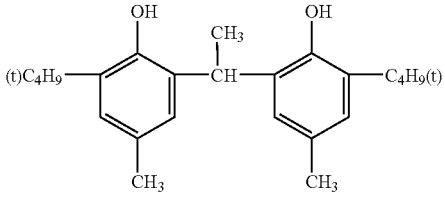
(1-4)
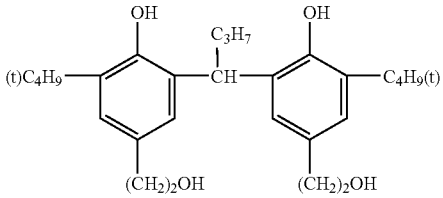
(1-5)
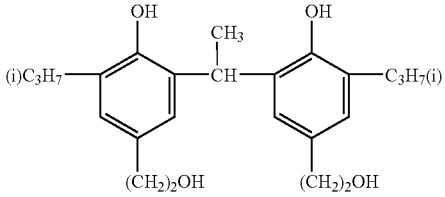
(1-6)
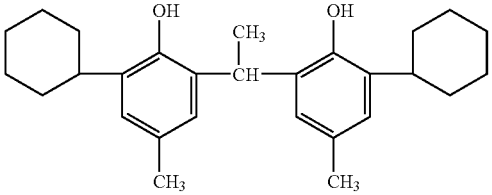
(1-7)
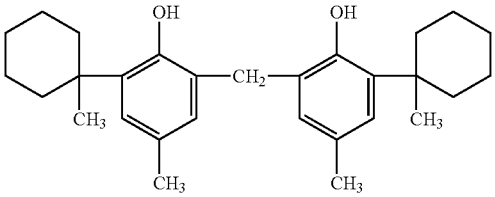
-continued
(1-8)
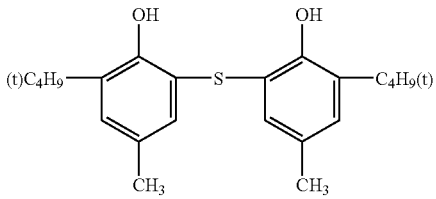
(1-9)
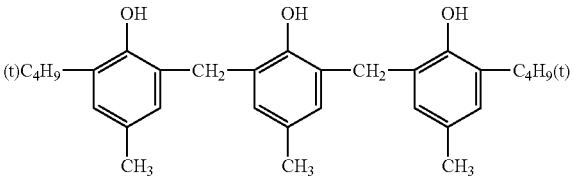
(1-10)
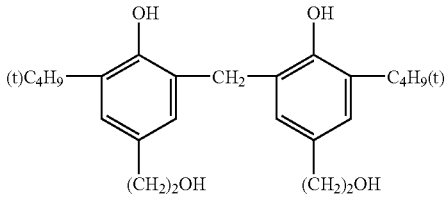
(2-1)
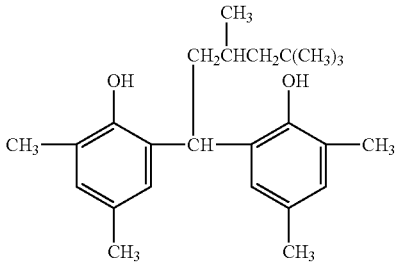
(2-2)
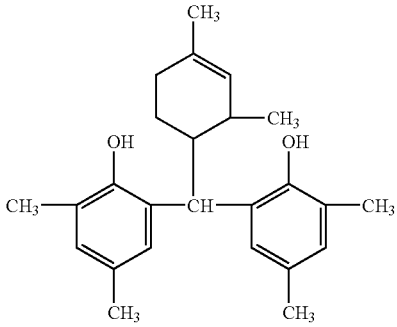
(2-3)
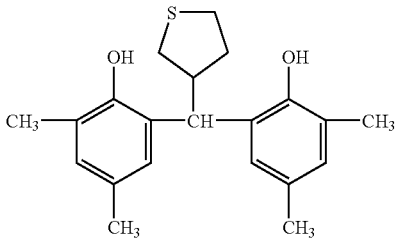

-continued (2-4)

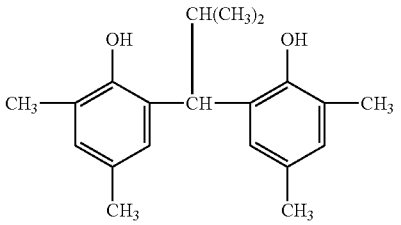

(2-5)

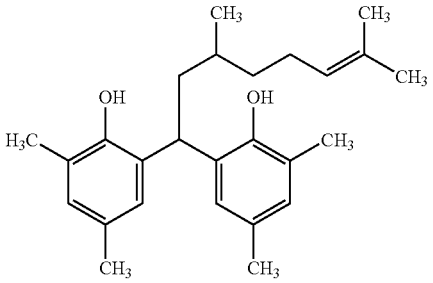

(2-6)

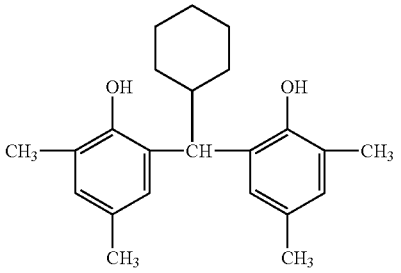

(2-7)

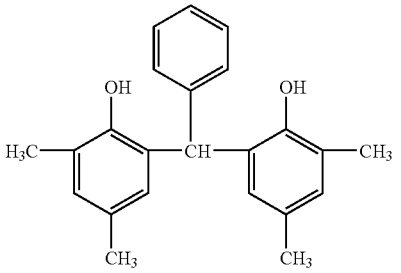

(2-8)

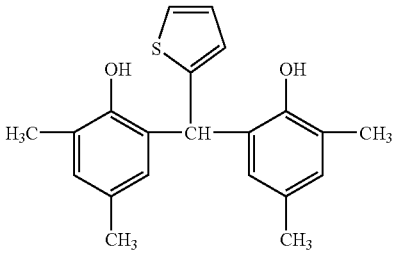

The bisphenol compounds represented by these General Formulas (1) and (2) can easily be synthesized employing conventional methods known in the art.

Reducing agents incorporated into photothermographic materials are those which reduce organic silver salts to form images. Employed as reducing agents which are used together with the reducing agents of the present invention are, for example, those described in U.S. Pat. Nos. 3,770,448, 3,773,512, and 3,593,863; RD Nos. 17029 and 29963; and JP-A Nos. 11-119372 and 2002-62616.

The used amount of the reducing agents, represented by aforesaid General Formula (1) and the like, is preferably $1\times10^{-2}$-10 mol per mol of silver, but is most preferably $1\times10^{-2}$-1.5 mol.

<Tone Controlling Agent>

The tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown.

The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the present invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Diligent investigation was performed for the silver salt photothermographic imaging material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

(1) It is preferable that the coefficient of determination value $R^2$ of the linear regression line which is made by arranging u* and v* in terms of each of the above optical densities is 0.998-1.000; value v* of the intersection point of the aforesaid linear regression line with the ordinate is −5-+5; and gradient (v*/u*) is 0.7-2.5.

(2) The coefficient of determination value $R^2$ of the linear regression line is preferably 0.998-1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is −5-+5, while gradient (b*/a*) is 0.7-2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below.

In the present invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, toning agents such as phthalazinones or a combinations of phthalazine with phthalic acids, or phthalic anhydride are employed.

Examples of suitable image toning agents are disclosed in Research Disclosure, Item 17029, and U.S. Pat. Nos. 4,123,282, 3,994,732, 3,846,136, and 4,021,249.

Other than such toners, it is preferable to control color tone employing couplers disclosed in JP-A No. 11-288057 and EP 1134611A2 as well as leuco dyes detailed below.

<Leuco Dyes>

Employed as leuco dyes may be any of the colorless or slightly tinted compounds which are oxidized to form a colored state when heated at temperatures of about 80-about 200° C. for about 0.5-about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include biphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes as well as other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01-0.30, is preferably 0.02-0.20, and is most preferably 0.02-0.10. Further, it is preferable that images be controlled within the preferred color tone range described below.

<Yellow Forming Leuco Dyes>

In the present invention, particularly preferably employed as yellow forming leuco dyes are color image forming agents represented by following General Formula (YA) which increase absorbance between 360 and 450 nm via oxidation.

General Formula (YA)

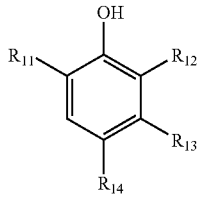

In General Formula (YA), $R_{11}$ represents a substituted or unsubstituted alkyl group, $R_{12}$ represents a hydrogen atom, a substituted or unsubstituted alkyl group, a substituted or unsubstituted acylamino group. However, $R_{11}$ and $R_{12}$ each does not represents a 2-hydroxyphenylmethyl group. $R_{13}$ represents a hydrogen atom, a substituted or unsubstituted alkyl group; and $R_{14}$ represents a substituent which can be substituted with a hydrogen atom on a benzene ring.

The compounds represented by General Formula (YA) will now be detailed.

In aforesaid General Formula (YA), preferably as the alkyl groups represented by $R_{11}$ are those having 1-30 carbon atoms, which may have a substituent.

Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than i-propyl are preferred. Of these, preferred are secondary or tertiary alkyl groups and t-butyl, t-octyl, and t-pentyl, which are tertiary alkyl groups, are particularly preferred. Listed as substituents which $R_{11}$ may have are a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_{12}$ represents a hydrogen atom, a substituted or unsubstituted alkyl group, or an acylamino group. The alkyl group represented by $R_{12}$ is preferably one having 1-30 carbon atoms, while the acylamino group is preferably one having 1-30 carbon atoms. Of these, description for the alkyl group is the same as for aforesaid $R_{11}$.

The acylamino group represented by $R_{12}$ may be unsubstituted or have a substituent. Specifically listed are an acetylamino group, an alkoxyacetylamino group, and an aryloxyacetylamino group. $R_2$ is preferably a hydrogen atom or an unsubstituted group having 1-24 carbon atoms, and specifically listed are methyl, i-propyl, and t-butyl. Further, neither $R_{11}$ nor $R_{12}$ is a 2-hydroxyphenylmethyl group.

$R_{13}$ represents a hydrogen atom, and a substituted or unsubstituted alkyl group. Preferred as alkyl groups are those having 1-30 carbon atoms. Description for the above alkyl groups is the same as for $R_{11}$. Preferred as $R_{13}$ are a hydrogen atom and an unsubstituted alkyl group having 1-24 carbon atoms, and specifically listed are methyl, i-propyl and t-butyl. It is preferable that either $R_{12}$ or $R_{13}$ represents a hydrogen atom.

$R_{14}$ represents a group capable of being substituted to a benzene ring, and represents the same group which is described for substituent $R_{14}$, for example, in aforesaid General Formula (1). $R_{14}$ is preferably a substituted or unsubstituted alkyl group having 1-30 carbon atoms, as well as an oxycarbonyl group having 2-30 carbon atoms. The alkyl group having 1-24 carbon atoms is more preferred. Listed as substituents of the alkyl group are an aryl group, an amino group, an alkoxy group, an oxycarbonyl group, an acylamino group, an acyloxy group, an imide group, and a ureido group. Of these, more preferred are an aryl group, an amino group, an oxycarbonyl group, and an alkoxy group. The substituent of these alkyl group may be substituted with any of the above alkyl groups.

Among the compounds represented by General Formula (YA), preferred compounds are bis-phenol compounds represented by the following General Formula (YB).

General Formula (YB)

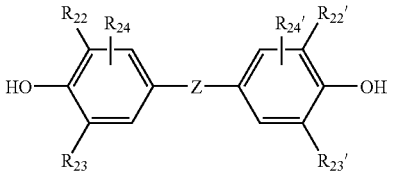

wherein, Z represents a —S— or —C($R_{21}$)($R_{21'}$)— group. $R_{21}$ and $R_{21'}$ each represent a hydrogen atom or a substituent. The substituents represented by $R_1$ and $R_{1'}$ are the same substituents listed for $R_1$ in the aforementioned General Formula (1). $R_{21}$ and $R_{21'}$ are preferably a hydrogen atom or an alkyl group.

$R_{22}$, $R_{23}$, $R_{22'}$ and $R_{23'}$ each represent a substituent. The substituents represented by $R_{22}$, R23, $R_{22'}$ and $R_{23'}$ are the same substituents listed for $R_2$ and $R_3$ in the aforementioned General Formula (1).

$R_{22}$, $R_{23}$, $R_{22'}$ and $R_{23'}$ are preferably, an alkyl group, an alkenyl group, an alkynyl group, an aryl group, a heterocyclic group, and more preferably, an alkyl group. Substituents on the alkyl group are the same substituents listed for the substituents in the aforementioned General Formula (1).

$R_{22}$, $R_{23}$, $R_{22'}$ and $R_{23'}$ are more preferably tertiary alkyl groups such as t-butyl, t-amino, t-octyl and 1-methylcyclohexyl.

$R_{24}$ and $R_{24'}$ each represent a hydrogen atom or a substituent, and the substituents are the same substituents listed for $R_4$ in the aforementioned General Formula (1).

Examples of the compounds represented by General Formulas (YA) and (YB) are, the compounds disclosed in JP-A No. 2002-169249, paragraph Nos. [0032]-[0038], Compounds (II-1) to (II-40); and EP 1211093, paragraph No. [0026], Compounds (ITS-1) to (ITS-12).

In the following, specific examples of bisphenol compounds represented by General Formula (YA) and (YB) are shown. However, the present invention is not limited thereby.

YA-1

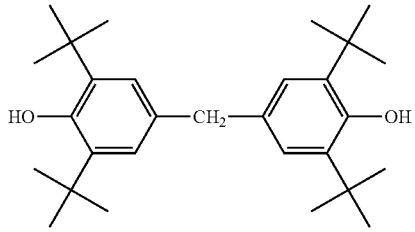

YA-2

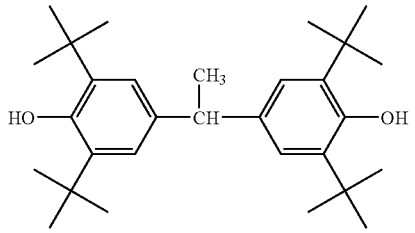

YA-3

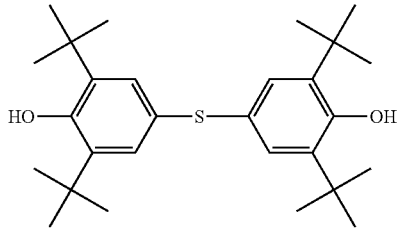

YA-4

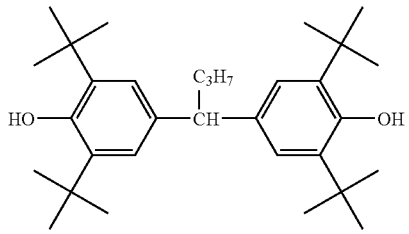

YA-5

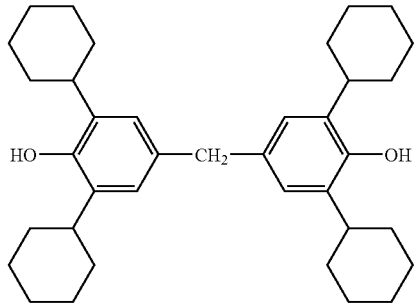

YA-6

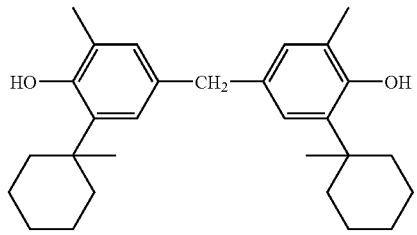

-continued

YA-7

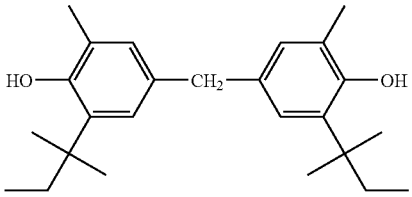

YA-8

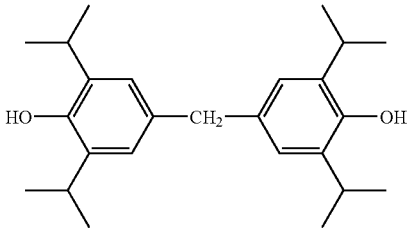

YA-9

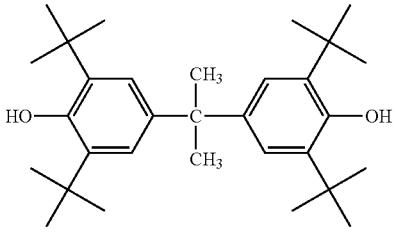

YA-10

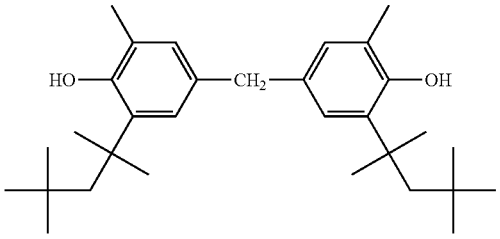

YA-11

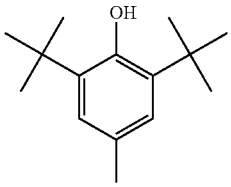

YA-12

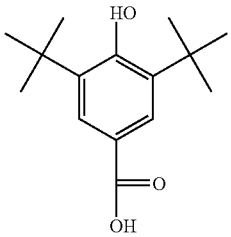

YA-13

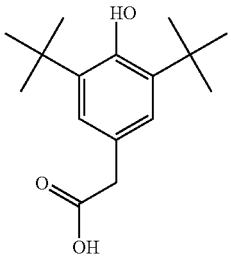

-continued

YA-14

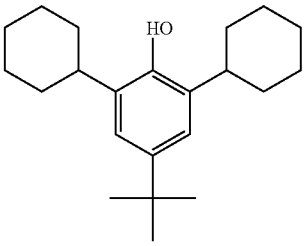

YA-15

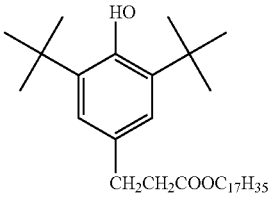

An amount of an incorporated compound represented by General Formulas (YA) or (YB) is; usually, 0.00001 to 0.01 mol, and preferably, 0.0005 to 0.01 mol, and more preferably, 0.001 to 0.008 mol per mol of Ag.

A ratio of an added amount of a yellow leuco dye to a reducing agent represented by General Formulas (1) or (2) is preferably from 0.001-0.2, more preferably from 0.005-0.1.

<Cyan Forming Leuco Dyes>

Cyan forming leuco dyes will now be described. In the present invention, particularly preferably employed as cyan forming leuco dyes are color image forming agents which increase absorbance between 600 and 700 nm via oxidation, and include the compounds described in JP-A No. 59-206831 (particularly, compounds of λmax in the range of 600-700 nm), compounds represented by General Formulas (I)-(IV) of JP-A No. 5-204087 (specifically, compounds (1)-(18) described in paragraphs [0032]-[0037]), and compounds represented by General Formulas 4-7 (specifically, compound Nos. 1-79 described in paragraph [0105]) of JP-A No. 11-231460.

Cyan forming leuco dyes which are particularly preferably employed in the present invention are represented by following General Formula (CL).

General Formula (CL)

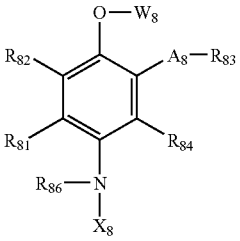

wherein $R_{81}$ and $R_{82}$ each represent a hydrogen atom, a substituted or unsubstituted alkyl group, an NHCO—$R_{10}$ group wherein $R_{10}$ is an alkyl group, an aryl group, or a heterocyclic group, while $R_{81}$ and $R_{82}$ may bond to each other to form an aliphatic hydrocarbon ring, an aromatic hydrocarbon ring, or a heterocyclic ring; $A_8$ represents a —NHCO— group, a —CONH— group, or a —NH-CONH— group; $R_{83}$ represents a substituted or unsubstituted alkyl group, an aryl group, or a heterocyclic group, or -$A_8$-$R_{83}$ is a hydrogen atom; $W_8$ represents a hydrogen atom or a —CONH$R_{85}$— group —CO$R_{85}$ or a —CO—O—$R_{85}$ group wherein $R_{85}$ represents a substituted or unsubstituted alkyl group, an aryl group, or a heterocyclic group; $R_{84}$ represents a hydrogen atom, a halogen atom, a substituted or unsubstituted alkyl group, an alkoxy group, a carbamoyl group, or a nitrile group; $R_{86}$ represents a —CONH—$R_{87}$ group, a —CO—$R_{87}$ group, or a —CO—O—$R_{87}$ group wherein $R_{87}$ is a substituted or unsubstituted alkyl group, an aryl group, or a heterocyclic group; and $X_8$ represents a substituted or unsubstituted aryl group or a heterocyclic group.

In General Formula (CL), halogen atoms represented by $R_{81}$ and $R_{82}$ include fluorine, bromine, and chlorine; alkyl groups include those having at most 20 carbon atoms (methyl, ethyl, butyl, or dodecyl); alkenyl groups include those having at most 20 carbon atoms (vinyl, allyl, butenyl, hexenyl, hexadienyl, ethenyl-2-propenyl, 3-butenyl, 1-methyl-3-propenyl, 3-pentenyl, or 1-methyl-3-butenyl); alkoxy groups include those having at most 20 carbon atoms (methoxy or ethoxy); aryl groups include those having 6-20 carbon atoms such as a phenyl group, a naphthyl group, or a thienyl group; heterocyclic groups include each of thiophene, furan, imidazole, pyrazole, and pyrrole groups; $R_{83}$ represents a substituted or unsubstituted alkyl group (preferably having at most 20 carbon atoms such as methyl, ethyl, butyl, or dodecyl), an aryl group (preferably having 6-20 carbon atoms, such as phenyl, naphthyl, or thienyl), or a heterocyclic group (thiophene, furan, imidazole, pyrazole, or pyrrole); $W_8$ represents a hydrogen atom or a —CONH$R_5$ group, a —CO—$R_{85}$ group or a —CO—O$R_{85}$ group wherein $R_{85}$ represents a substituted or unsubstituted alkyl group (preferably having at most 20 carbon atoms, such as methyl, ethyl, butyl, or dodecyl), an aryl group (preferably having 6-20 carbon atoms, such as phenyl, naphthyl, or thienyl), or a heterocyclic group (such as thiophene, furan, imidazole, pyrazole, or pyrrole).

$R_{84}$ is preferably a hydrogen atom, a halogen atom (e.g., fluorine, chlorine, bromine, iodine), a chain or cyclic alkyl group (e.g., a methyl group, a butyl group, a dodecyl group, or a cyclohexyl group), an alkoxy group (e.g., a methoxy group, a butoxy group, or a tetradecyloxy group), a carbamoyl group (e.g., a diethylcarbamoyl group or a phenylcarbamoyl group), and a nitrile group and of these, a hydrogen atom and an alkyl group are more preferred. Aforesaid $R_{83}$ and $R_{84}$ bond to each other to form a ring structure.

The aforesaid groups may have a single substituent or a plurality of substituents. For example, typical substituents which may be introduced into aryl groups include a halogen atom (fluorine, chlorine, or bromine), an alkyl group (methyl, ethyl, propyl, butyl, or dodecyl), a hydroxyl group, a cyan group, a nitro group, an alkoxy group (methoxy or ethoxy), an alkylsulfonamide group (methylsulfonamido or octylsulfonamido), an arylsulfonamide group (phenylsulfonamido or naphthylsulfonamido), an alkylsulfamoyl group (butylsulfamoyl), an arylsulfamoyl group (phenylsulfamoyl), an alkyloxycarbonyl group (methoxycarbonyl), an aryloxycarbonyl group (phenyloxycarbonyl), an aminosulfonamide group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group, or an aminocarbonyl group.

Either $R_{10}$ or $R_{85}$ is preferably a phenyl group, and is more preferably a phenyl group having a plurality of substituents containing a halogen atom or a cyano group.

$R_{86}$ is a —CONH—$R_{87}$ group, a —CO—$R_{87}$ group, or —CO—O—$R_{87}$ group, wherein $R_{87}$ is a substituted or unsubstituted alkyl group (preferably having at most 20 carbon atoms, such as methyl, ethyl, butyl, or dodecyl), an aryl group (preferably having 6-20 carbon atoms, such as phenyl, naphthol, or thienyl), or a heterocyclic group (thiophene, furan, imidazole, pyrazole, or pyrrole).

Employed as substituents of the alkyl group represented by $R_{87}$ may be the same ones as substituents in $R_{81}$-$R_{84}$ in General Formula (CL).

$X_8$ represents a substituted or unsubstituted aryl group or a heterocyclic group. These aryl groups include groups having 6-20 carbon atoms such as phenyl, naphthyl, or thienyl, while the heterocyclic groups include any of the groups such as thiophene, furan, imidazole, pyrazole, or pyrrole.

Employed as substituents which may be substituted to the group represented by $X_8$ may be the same ones as the substituents in $R_{81}$-$R_{84}$ in General Formula (CL).

As the groups represented by $X_8$, preferred are an aryl group, which is substituted with an alkylamino group (a diethylamino group) at the para position, or a heterocyclic group.

These may contain other photographically useful groups.

Specific examples of cyan forming leuco dyes (CL) are listed below, however are not limited thereto.

(CL-1)

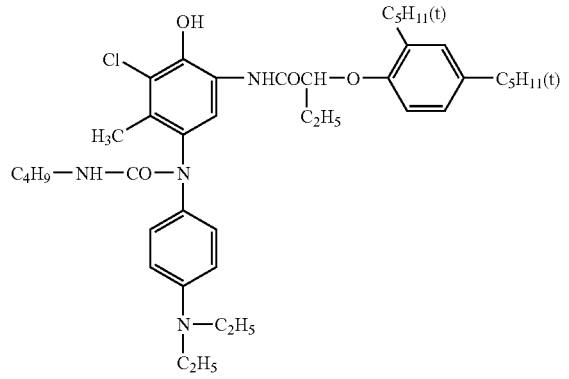

(CL-2)

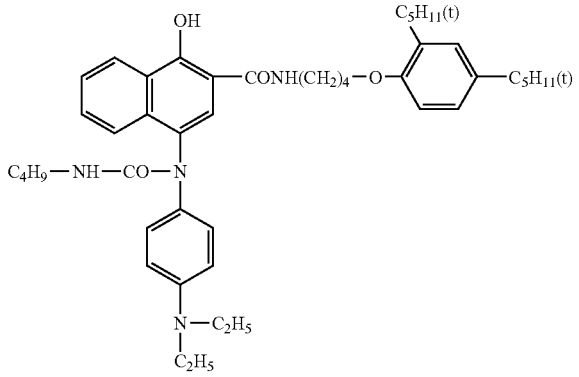

(CL-3)

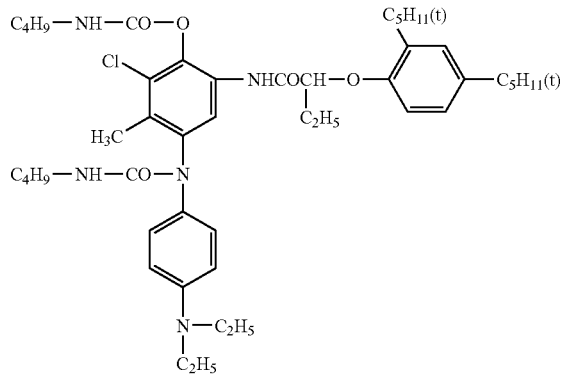

-continued
(CL-4)
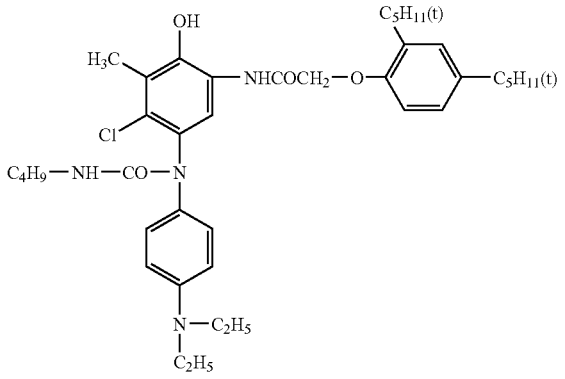
(CL-5)
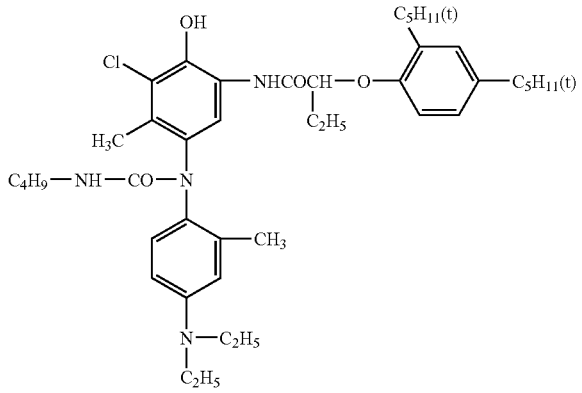
(CL-6)
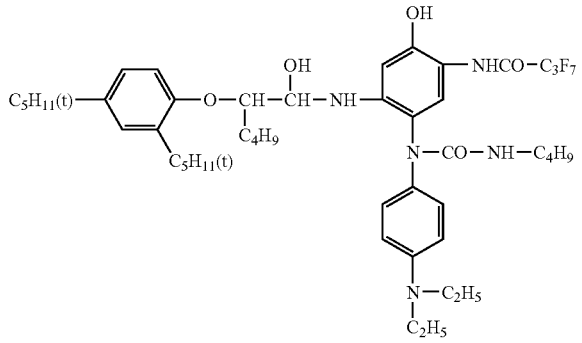
(CL-7)
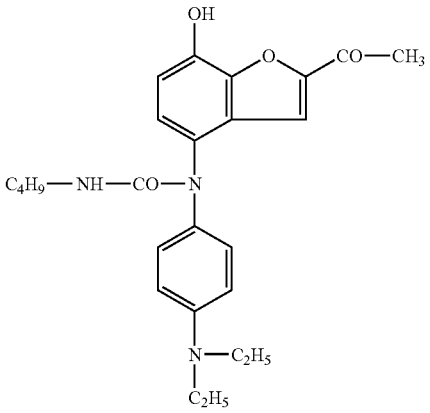
-continued
(CL-8)
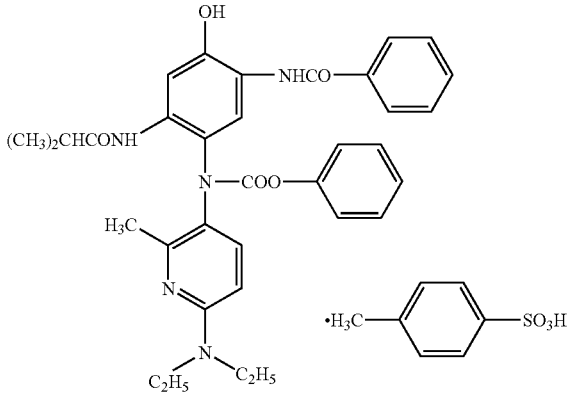
(CL-9)
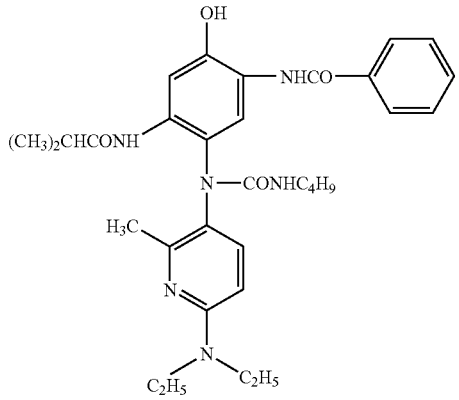
(CL-10)
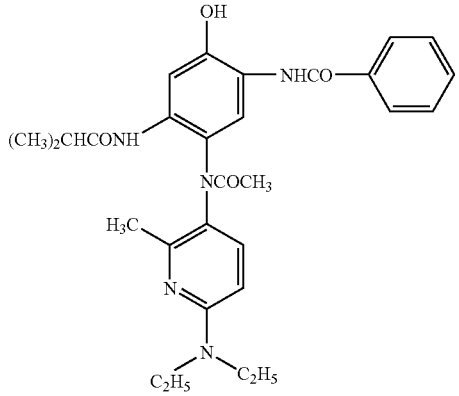
(CL-11)
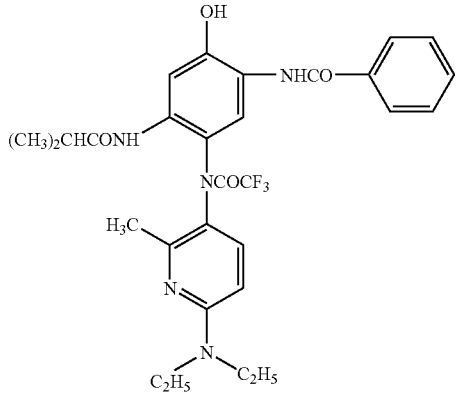

-continued (CL-12)

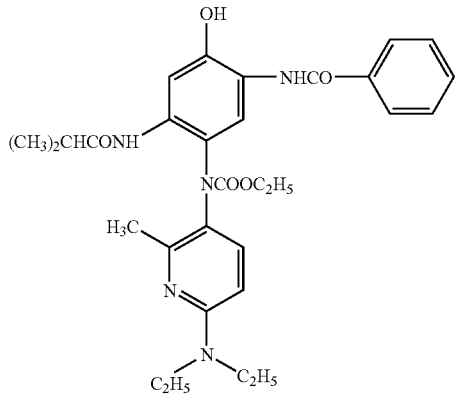

The added amount of cyan forming leuco dyes is commonly 0.00001-0.05 mol/mol of Ag, is preferably 0.0005-0.02 mol, but is more preferably 0.001-0.01 mol. The addition ratio of cyan forming leuco dyes to the total of the reducing agents represented by General Formulas (1) and (2) is preferably 0.001-0.2 in terms of mol ratio, but is more preferably 0.005-0.1. In the present invention, the sum of maximum density in the maximum absorption wavelength of dye images formed by cyan leuco dyes is controlled to be preferably 0.01-0.50, more preferably 0.02-0.30, but most preferably 0.03-0.10.

In the present invention, it is possible to further control delicate tone by combining magenta forming leuco dyes or yellow forming leuco dyes with the above cyan forming leuco dyes.

The compounds represented by General Formulas (YA), (YB) and cyan forming leuco dyes may be added employing the same method as for the reducing agents represented by General Formula (1). They may be incorporated in liquid coating compositions employing an optional method to result in a solution form, an emulsified dispersion form, or a minute solid particle dispersion form, and then incorporated in a photosensitive material.

It is preferable to incorporate the compounds represented by General Formulas (YA), (YB) and cyan forming leuco dyes into an image forming layer containing organic silver salts. On the other hand, the former may be incorporated in the image forming layer, while the latter may be incorporated in a non-image forming layer adjacent to the aforesaid image forming layer. Alternatively, both may be incorporated in the non-image forming layer. Further, when the image forming layer is comprised of a plurality of layers, incorporation may be performed for each of the layers.

<Binder>

Suitable binders for the silver salt photothermographic material of the present invention are to be transparent or translucent and commonly colorless, and include natural polymers, synthetic resin polymers and copolymers, as well as media to form film. Examples of the hinders are cited in JP-A No. 2001-330918. Preferable binders for the photosensitive layer of the silver salt photothermographic dry imaging material of the present invention are poly(vinyl acetals), and a particularly preferable binder is poly(vinyl butyral), which will be detailed hereunder.

Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

It is preferable that the binders of the present invention include at least one polar group selected from the group consisting of —COOM, —$SO_3M$, —$OSO_3M$, —P═O$(OM)_2$, —O—P═O$(OM)_2$ (wherein M represents a hydrogen atom or an alkali metal salt group), —$N(R_4)_2$, —$N^+(R)_3$ (wherein R represents a hydrocarbon group, —SH, and —CN. Specifically preferred are —$SO_3M$ and —$OSO_3M$. The amount of such polar groups is commonly from $10^{-1}$ to $10^{-8}$ mol/g, and is preferably from $10^{-2}$ to $10^{-6}$ mol/g.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/$m^2$, and is more preferably from 1.7 to 5 g/$m^2$. When the binder amount is less than 1.5 g/$m^2$, density of the unexposed portion markedly increases, whereby it occasionally becomes impossible to use the resultant material.

In the present invention, it is preferable that thermal transition point temperature is from 70 to 105° C. Thermal transition point temperature Tg, as described in the present invention, can be obtained with a differential scanning calorimeter. Tg is a intersection point of a base line and a tangent of a endothermic peak.

The glass transition temperature (Tg) is determined employing the method, described in Brandlap, et al., "Polymer Handbook", pages from III-139 through III-179, 1966 (published by Wiley and Son Co.).

The Tg of the binder comprised of copolymer resins is obtained based on the following formula.

$$Tg \text{ of the copolymer (in ° C.)} = v_1 Tg_1 + v_2 Tg_2 + \ldots + v_n Tg_n$$

wherein $v_1$, $v_2$, . . . $v_n$ each represents the mass ratio of the monomer in the copolymer, and $Tg_1$, $Tg_2$, . . . $Tg_n$ each represents Tg (in ° C.) of the homopolymer which is prepared employing each monomer in the copolymer. The accuracy of Tg, calculated based on the formula calculation, is ±5° C.

A sufficient amount of image density can be obtained after image formation when a binder having Tg of 70-105° C. is employed.

The polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers containing constituent units of ethylenic unsaturated monomers are listed in JP-A No. 2001-330918, paragraph No. [0069].

Of these, listed as preferable examples are allyl methacrylates, aryl methacrylates, and styrenes. Of such polymers, those having an acetal group are preferably employed. Among polymers having an acetal group, specifically preferred are polyvinylacetals having a acetal structure in the molecule. Examples of such polymers are listed in U.S. Pat. Nos. 2,358,836, 3,003,879 and 2,828,204, GB Patent No. 771155.

Examples of specifically preferred polymers having an acetal group are listed in JP-A No. 2002-287299, paragraph No. [150], represented General Formula (V).

Employed as polyurethane resins usable in the present invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that the molecular terminal of the polyurethane molecule has at least one OH group and at least two OH groups in total. The OH group cross-links with polyisocyanate as a hardening agent so as to form a 3-dimensional net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 $M/mm^2$.

These polymer compounds (or polymers) may be employed individually or in combinations via blending of at least two types.

It is preferable that the aforesaid polymers are used as a binder in the image forming layer of the present invention. As used herein, the term "main binder" refers to one which results in a state in which the aforesaid binder occupies at least 50 percent by weight of the total binders of the image forming layer. Accordingly, other polymers may be blended within the range of less than 50 percent by weight of the total binders. These polymers are not particularly limited as long as they are soluble in the solvents of the present invention. More preferred polymers include polyvinyl acetate, polyacryl resins, and urethane resins.

Organic gelling agents may be incorporated into the image forming layer. Organic gelling agents, as descried herein, refer to compounds which, for example, as polyhydric alcohols, their addition to organic liquid results in a yield value in the system and exhibits functions to eliminate or decrease fluidity.

An embodiment is also preferred in which an image forming layer liquid coating composition incorporates polymer latexes in the form of a water based dispersion. In this case, it is preferable that at least 50 percent by weight of the total hinder in the image forming layer liquid coating composition is composed of polymer latexes in the form of water based dispersion. Further, when the image forming layer incorporates polymer latexes, it is preferable that at least 50 percent of the total binders in the image forming layer is composed of polymer latexes, but it is still more preferable that at least 70 percent by weight of the same is composed of polymer latexes.

Polymer latexes, as described herein, refer to those which are prepared in such a manner that water-insoluble hydrophobic polymers are dispersed into a water based dispersion media in the form of minute particles. Dispersion states include any of the states in which polymers are emulsified in a dispersion medium, are prepared by emulsification polymerization, or are subjected to micelle dispersion, or further molecular chains themselves are subjected to molecular dispersion while having a partial hydrophilic structure in the polymer molecule. The average diameter of dispersion particles is preferably in the range of 1-50,000 nm, but is more preferably in the range of 5-1,000 nm. The size distribution of dispersion particles is not particularly limited and those having a broad particle size distribution or a monodispersion size distribution may are acceptable.

Polymer latexes employed in the present invention may be so-called core/shell type latexes, other than common polymer latexes having a uniform structure. In this case, a core and a shell are occasionally preferable when Tg is varied. The minimum filming temperature (MFT) of the polymer latexes according to the present invention is preferably from −30 to 90° C., but is more preferably from about 0 to about 70° C. Further, in order to control the minimum filming temperatures, film forming aids may be incorporated.

The above film forming aids are called plasticizers and are organic compounds (commonly organic solvents) which lower the minimum filming temperature of polymer latexes. They are described, for example, in "Gosei Latex no Kagaku (Chemistry of Synthesis Latexes)" (written by Soichi Muroi, published by Kobunshi Kankokai, 1770).

Polymer species employed for polymer latexes include acryl resins, vinyl acetate resins, polyester resins, polyurethane resins, rubber based resins, vinyl chloride resins, vinylidene chloride resins, and polyolefin resins, or copolymers thereof. Polymers may include straight chain polymers, branched chain polymers, and crosslinked polymers. Further, polymers include homopolymers which are prepared by copolymerizing identical monomers, as well as copolymers which are prepared by polymerizing at least two types of monomers. In the case of copolymers, either random polymers or block polymers are acceptable. The molecules weight of polymers is commonly 5,000-1,000,000 in terms of number average molecular weight, but is preferably about 10,000-about 100,000. Polymers having an excessively small molecular weight result in insufficient dynamic strength of the light-sensitive layers, while those having an excessively large molecular weather results in degraded film forming properties, whereby both cases are not preferable.

The equilibrium water content ratio of polymer latexes at 25° C. and 60 percent RH (relative humidity) is preferably 0.01-2 percent by weight, but is more preferably 0.01-1 percent by weight. With regard to the measurement methods of the equilibrium water content ratio as well as its definition, it is possible to refer, for example, to "Kobunshi Kogaku Koza 14, Kobunshi Zairyo Siken Ho (Polymer Engineering Lecture 14, Test Methods of Polymer Materials)" (edited by Kobunshi Gakkai, Chizin Shokan)".

Specific examples of polymer latexes include each of the latexes described in paragraph 「0173」 of JP-A No. 2002-287299. These polymers may be employed individually or, if desired, in combinations via blending at least two types. Preferred as polymer species of polymer latexes are those which incorporate carboxylic acid components such as acrylate or methacrylate in an amount of about 0.1-about 10 percent by weight.

Further, if desired, incorporated may be hydrophilic polymers such as gelatin, polyvinyl alcohol, methylcellulose, hydroxypropyl cellulose, carboxymethyl cellulose, or hydroxypropyl methylcelluose in the range of at most 50 percent by weight of the total binders. The added amount of these hydrophilic polymers is preferably at most 30 percent by weight of the total binders of the aforesaid light-sensitive layer.

During preparation of an image forming layer liquid coating composition, with regard to the addition order, any of the organic silver salts and polymer latexes in the form of water based dispersion may be added initially, or both may be simultaneously added. However, it is preferable that the polymer latexes are added later.

Further, it is preferable that prior to the addition of polymer latexes, organic silver salts and in addition, reducing agents are mixed. Still further, after blending the organic silver salts with the polymer latexes, when the temperature during storage is excessively low, problems occur in which the resulting coating surface is degraded, while when it is excessively high, problems occur in which fogging is increased. Consequently, it is preferable that the coating liquid composition after blending is maintained between 30-65° C. during the above standing period. Still further, it is preferable to maintain it between 35-60° C. and it is most preferable to maintain it between 35-55° C. To make it possible to maintain the temperatures as above, the tanks used to prepare the liquid coating composition may be heated.

With regard to coating of image forming liquid coating compositions, it is preferable to use the liquid coating Composition 0.5-24 hours after blending organic silver salts with polymer latexes in the form of water based dispersion, while it is more preferable to use the same 1-12 hours after blending, but it is most preferable to use the same 2-10 hours after blending.

As used herein, the term "after blending" means that after organic silver salts and polymer latexes in the form of water based dispersion are added, added components are uniformly dispersed.

It is known that by employing crosslinking agents in the aforesaid binders, the resulting layer adhesion is assured, and uneven development is minimized. In addition, effects are also exhibited in which fogging during storage is retarded and the formation of print-out silver after development is also retarded.

Employed as crosslinking agents are various crosslinking agents used for light-sensitive photographic materials, examples of which include aldehyde based, epoxy based, ethyleneimine based, vinylsulfone based, sulfonic acid ester based, acryloyl based, carbodiimide based, and silane compound based crosslinking agents described in JP-A No. 50-96216. Of these, preferred are the isocyanate based, silane compound based, epoxy based compounds or acid anhydrides.

The aforesaid isocyanate based cross-linking agents are isocyanates having at least two isocyanate groups and adducts thereof. More specifically, listed are aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric polyalcohols.

Employed as specific examples may be isocyanate compounds described on pages 10 through 12 of JP-A No. 56-5535.

Incidentally, adducts of isocyanates with polyalcohols are capable of markedly improving the adhesion between layers and further of markedly minimizing layer peeling, image dislocation, and air bubble formation. Such isocyanates may be incorporated in any portion of the silver salt photothermographic dry imaging material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are placed on the photosensitive layer side of the support, and may be incorporated in at least two of the layers.

Further, as thioisocyanate based cross-linking agents usable in the present invention, compounds having a thioisocyanate structure corresponding to the isocyanates are also useful.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as the cross-linking agent. However, it is possible to obtain the desired results by employing compounds which have a v of 0, namely compounds having only one functional group.

Listed as examples of silane compounds which can be employed as a cross-linking agent in the present invention are compounds represented by General Formulas (1) to (3), described in JP-A No. 2001-264930.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Acid anhydrides are compounds which have at least one acid anhydride group having the structural formula described below.

The acid anhydrites are to have at least one such acid anhydride group. The number of acid anhydride groups, and the molecular weight are not limited.

—CO—O—CO—

These acid anhydrides may be employed individually or in combinations of at least two types. The added amount is not particularly limited, but is preferably in the range of $1\times10^{-6}$ to $1\times10^{-2}$ mol/m$^2$ and is more preferably in the range of $1\times10^{-5}$ to $1\times10^{-3}$ mol/m$^2$.

<Silver Saving Agent>

In the present invention, either a photosensitive layer or a light-insensitive layer may comprise silver saving agents.

Specific examples of hydrazine derivatives include compounds H-1-H-29 described in columns 11-20 of U.S. Pat. No. 5,545,505, as well as compounds 1-12 described in columns of U.S. Pat. No. 5,464,738; and compounds H-1-1-H-1-28, H-2-1-H-2-9, H-3-1-H-3-12, H-4-1-H-4-21, and H-5-1-H-5-5 described in paragraphs 「0042」-「0052」 of JP-A No. 2001-27790.

Specific examples of vinyl compounds include compounds CN-01-CN-13 described in columns 13-14 of U.S. Pat. No. 5,545,515, compounds HET-01-HET-02 described in column 10 of U.S. Pat. No. 5,635,339, compounds MA-01-MA-07 described in columns 9-10 of U.S. Pat. No. 5,654,130, compounds IS-01-IS-04 described in columns 9-10 of U.S. Pat. No. 5,705,324, and compounds 1-1-218-2 described in paragraphs 「0043」-「0088」 of JP-A No. 2001-125224.

Specific examples of phenol derivatives and naphthol derivatives include compounds A-1-A-89 described in paragraphs 「0075」-「0078」 of JP-A No. 2003-267222, as well as compounds A-1-A-258 described in paragraphs 「0025」-「0045」JP-A No. 2003-66558.

Specific example of quaternary onium compounds includes triphenyltetrazolium.

In the present invention, it is preferable that at least one of silver saving agents is a silane compound.

The silane compounds employed as a silver saving agent in present invention are preferably alkoxysilane compounds having at least two primary or secondary amino groups or salts thereof, as described in JP-A No. 2003-5324, paragraph No. [0027]-[0029], compounds A1-A33.

The added amount of a silver saving agent is preferably in the range of $1\times10^{-5}$ to 1 mol per 1 mole of an organic silver salt, and more preferably in the range of $1\times10^{-4}$ to $5\times10^{-1}$ mol.

<Antifoggant and Image Stabilizer>

Antifoggants as well as image stabilizing agents which are employed in the silver salt photothermographic dry imaging material of the present invention will now be described.

In the silver salt photothermographic dry imaging material of the present invention, it is contained a reducing agent such as bisphenols or sulfonamidephenols having a proton in the molecule. It is preferable that compounds are incorporated which are capable of deactivating reducing agents upon generating active species capable of extracting hydrogen atoms from the aforesaid reducing agents.

Preferred compounds are those which are capable of producing a colorless free radical species as an active agent of a photo-oxidation product at the time of exposure with light.

Accordingly, any compounds may be usable as long as they exhibit these functions, however organic free radicals composed of a plurality of atoms are preferred. Compounds having any structures may be acceptable as long as they exhibit such functions and do not adversely affect photothermographic materials.

Further, preferred as such free radical generating compounds are those having a carbocyclic or heterocyclic aromatic group to provide generated free radicals with stability so that they react with reducing agents and can come into contact for a sufficient time to deactivate the reducing agents. Listed as representatives of these compounds may be biimidazolyl compounds and iodonium compounds.

The added amount of above biimidazolyl compounds and iodonium compounds is customarily in the range of 0.001-0.1 mol/$m^2$, but is preferably in the range of 0.005-0.05 mol/$m^2$. Incidentally, the aforesaid compounds may be incorporated into any constituting layers of the light-sensitive materials of the present invention, but are preferably incorporated in the vicinity of reducing agents.

Further, known as fog inhibiting and image stabilizing agents are many compounds capable of releasing halogen atoms as an active species. Specific examples of compounds generating such active halogen atoms, include the compounds represented by General Formula (9) described in 「0264」-「0271」 of JP-A No. 2002-287299.

The added amount of these compounds is preferably in the range in which an increase in print-out silver due to the formation of silver halide causes substantially no problems. The ratio to compounds which do not generate active halogen radicals is preferably at most maximum 150 percent, but is preferably at most 100 percent. Listed as specific examples which generate these active halogen atoms may be compounds (III-1)-(III-23) described in paragraphs 「0086」-「0087」 of JP-A No. 2002-169249, compounds 1-1a-1-1o and 1-2a-1-2o described in paragraphs 「0031」-「0034」 and compounds 2a-2z, 2aa-2ll, and 2-1a-2-1f described in paragraphs 「0050」-「0056」 of JP-A No. 2003-50441, and compounds 4-1-4-32 described in paragraphs 「0055」-「0058」 and compounds 5-1-5-10 described in paragraphs 「0069」-「0072」 of JP-A No. 2003-91054.

Antifogging agents preferably employed in the present invention, other than the above, will now be described. Listed as antifogging agents preferably employed in the present invention may, for example, be compound examples "a"-"j" in paragraph 「0012」 of JP-A No. 8-314059, thiosulfonate esters A-K in paragraph 「0028」 of JP-A No. 7-209797, compound examples (1)-(44) described from page 14 of JP-A No. 55-140833, compounds (I-1)-(I-6) described in paragraph 「0063」 and (C-1)-(C-3) described in paragraph 「0066」 of JP-A No. 2001-13627, compounds (III-1)-(III-108) described in paragraph 「0027」 of JP-A No. 2002-90931, compounds VS-1-VS-7 and compounds HSD-1-HS-5 described in paragraph 「0013」 of JP-A No. 6-208192 as a vinylsulfone and/or β-halosulfone compound, compounds KS-1-KS-8 described in JP-A No. 2000-330235 as a sulfonylbenzotriazole compound, PR-01-PR-08 described in Japanese Patent Publication Open to Public Inspection (under PCT application) No. 2000-515995 as a substituted propanenitrile compound, and compounds (1)-1-(1)-132 described in paragraphs 「0042」-「0051」 of JP-A No. 2002-207273.

The aforesaid antifogging agents are employed in an amount of at least 0.001 mol with respect to mol of silver. The range is commonly 0.01-5 mol with respect to mol of silver, but is preferably 0.02-0.6 mol with respect to mol of silver.

Incidentally, in addition to the aforesaid compounds, those, which have conventionally been known as an antifogging agent, may be incorporated in the photothermographic material of the present invention. These include compounds which generate reaction active species which are the same as the above compounds or compounds which exhibit different fog inhibiting mechanism. Examples include the compounds described in U.S. Pat. Nos. 3,589,903, 4,546,075, and 4,452,885, JP-A No. 59-57234, U.S. Pat. Nos. 3,874,946 and 4,756,999, JP-A Nos. 9-2883238 and 9-905560. In addition, listed as other antifogging agents are compounds disclosed in U.S. Pat. No. 5,028,523, as well as European Patent Nos. 600,587, 605,981 and 631,176.

In cases in which reducing agents employed in the present invention have a hydroxyl group (—OH), specifically in cases of bisphenols, it is preferable to simultaneously use non-reducing compounds having a group capable of forming a hydrogen bond with these groups.

Listed as specific examples of particularly preferred hydrogen bonding compounds are compounds (II-1)-(II-40) described in paragraphs 「0061」-「0064」 of JP-A No. 2002-90937.

The photothermographic material of the present invention forms photographic images via thermal photographic processing, and it is preferable that toners, which control silver tone, are, if desired, incorporated commonly in the dispersed state in an (organic) binder matrix.

Examples of appropriate toners employed in the present invention are disclosed in RD No. 17029, as well as U.S. Pat. Nos. 4,123,282, 3,994,732, 3,846,136, and 4,021,249, examples of which include the following.

Imides (e.g., succinimide, phthalimide, naphthalimide, and N-hydroxy-1,8-naphthalimide); mercaptans (e.g., 3-mercapto-1,2,4-triazole); phthalazinone derivatives or metal salts thereof (e.g., phthalazinone, 4-(1-naphthyl)phthalazinone, 6-chlorophthalazinone, 5,7-dimethyloxyphthalazinone, and 2,3-dihydro-1,4-phthalazinedione); combinations of phthalazine with phthalic acids (e.g., phthalic acid, 4-methylphthalic acid, 4-nitrophthalic acid and tetrachlorophthalic acid; and combinations of phthalazine with at least one compound selected from maleic anhydrides, phthalic acid, 2,3-naphthalenedicarboxylic acid or o-phenylenic acid derivatives and anhydrides thereof (e.g., phthalic acid, 4-methylphthalic acid, 4-nitrophthalic acid and tetrachlorophthalic anhydride). Particularly preferred toners are phthalazinone or combinations of phthalazine with phthalic acids or phthalic anhydrides.

<Fluorine Based Surface Active Agents>

In the present invention, in order to improve film conveyance properties in a thermal processor and environmental adaptability (accumulating properties in living bodies), the fluorine based surface active agents, represented by General Formula (SF) below, are preferably employed.

$$(Rf\text{-}(L_1)_{n1}\text{-})_p\text{-}(Y)_{m1}\text{-}(A)_q \qquad \text{General Formula (SF)}$$

wherein Rf represents a substituent incorporating a fluorine atom, $L_1$ represents a divalent linking group having no fluorine atom, Y represents a (p+q) valent linking group having no fluorine atom, A represents an anionic group or salts thereof, n1 and m1 each represent an integer of 0 or 1, p represents an integer of 1-3, and q represents an integer of 1-3, provided that when q represents 1, n1 and m1 are not simultaneously 0.

In the above General Formula (SF), Rf represents a substituent containing a fluorine atom. Listed as the above substituents containing a fluorine atom are, for example, a fluorinated alkyl group (e.g., a trifluoromethyl group, a trifluoroethyl group, a perfluoroethyl group, a perfluorobutyl group, a perfluorooctyl group, a perfluorodecyl group, and a perfluorooctadecyl group) or a fluorinated alkenyl group (e.g., a perfluoropropenyl group, a perfluoronobutenyl group, a perfluorononenyl group, and a perfluorododecenyl group).

$L_1$ represents a divalent linking group with no fluorine atom. Listed as such divalent linking groups with no fluorine atom are, for example, an alkylene group (e.g., methylene group, an ethylene group, and a butylene group); an alkyleneoxy group (e.g., a methyleneoxy group, an ethyleneoxy group, and a butyleneoxy group); an oxyalkylene group (e.g., an oxymethylene group, an oxyethylene group, an oxybutylene grip); an oxyaklyleneoxy group (e.g., an oxymethyleneoxy group an oxyethyleneoxy group and an oxyethyleneoxyethyleneoxy group); a phenylene group, an oxyphenylene group, a phenyloxy group, and an oxyphenyloxy group, or a group formed by combining these groups.

"A" represents an anionic group or salts thereof. Examples include a carboxylic acid group or salts thereof (sodium salts, potassium salts, and lithium salts), a sulfonic acid group or salts thereof (sodium salts, potassium salts, and lithium salts), a sulfuric acid half ester group or salts thereof (sodium salts, potassium salts, and lithium salts), and a phosphoric acid group or salts thereof (sodium salts, and potassium salts).

Y represents a (p+q) valent linking group. Examples of trivalent or tetravalent linking groups with no fluorine atom include a group of atoms composed of nitrogen atoms or carbons atoms as a main component, while n1 represents an integer of 0 or 1 but 1 is preferred.

The fluorine based surface active agents represented by General Formula (SF) are prepared as follows. Compounds (being alkanol compounds which are subjected to partial Rf reaction) are prepared via addition reaction or condensation reaction of fluorine atom-introduced alkyl compounds having 1-25 carbon atoms (for example, compounds having a trifluoromethyl group, a pentafluoroethyl group, a perfluorobutyl group, a perfluorooctyl group, or a perfluorooctadecyl group), and alkenyl compounds (for example, a perfluorohexenyl group and a perfluorononenyl group) with tri- to hexa-valent alkanol compounds, each of which has no introduced fluorine atom and aromatic compounds having 3-4 hydroxyl groups or hetero compounds, and subsequently, anion group (A) is introduced into the above compounds via, for example, sulfuric acid esterification.

Listed as the above tri- to hexa-valent compounds are glycerin, pentaerythritol, 2-methyl-2-hydroxymethyl-1,3-propanediol, 2,4-dihydroxy-3-hydroxymethylpentane, 1,2,6-hexanetriol, 1,1,1-tris(hydroxymethyl)propane, 2,2-bis(butanol)-3, aliphatic triol, tetramethylolmethane, D-sorbitol, xylitol, and D-mannitol.

Further, listed as the above aromatic compounds having 3-4 hydroxyl groups are 1,3,5-trohydroxybenzene and 2,4,6-trihydroxypyridine.

Specific compounds of the preferred fluorine based surface active agents, represented by General Formula (SF), will now be listed.

SF-1

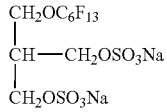

SF-2

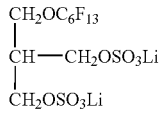

SF-3

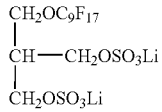

SF-4

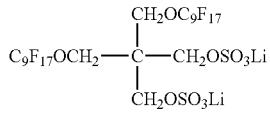

SF-5

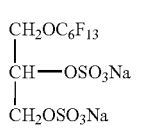

SF-6

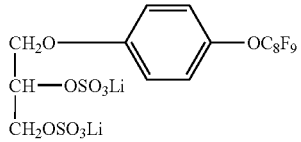

-continued

SF-7

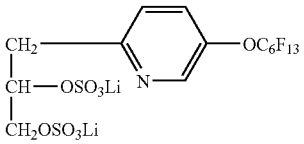

SF-8

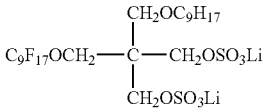

SF-9

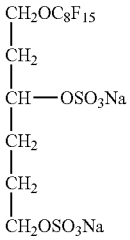

SF-10

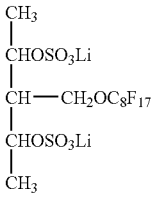

SF-11

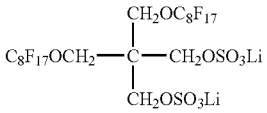

SF-12

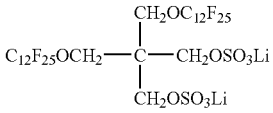

SF-13

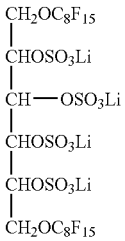

SF-14

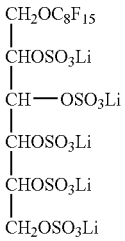

SF-15

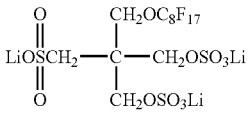

-continued

SF-16

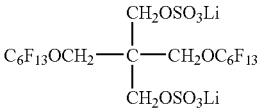

SF-17

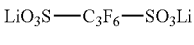

SF-18

It is possible to add the fluorine based surface active agents represented by General Formulas (SF) to liquid coating compositions, employing any conventional addition methods known in the art. Namely, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorine based surface active agents represented by General Formulas (SF) are added to the protective layer which is the outermost layer.

The added amount of the aforesaid fluorine based surface active agents is preferably $1\times10^{-8}$-$1\times10^{-1}$ mol per $m^2$, more preferably $1\times10^{-5}$-$1\times10^{-2}$ mol per $m^2$. When the added amount is less than the lower limit, it is riot possible to achieve desired charging characteristics, while it exceeds the upper limit, storage stability degrades due to an increase in humidity dependence.

<Surface Layer>

Ten-point mean roughness (Rz), maximum roughness (Rt), and center line mean roughness (Ra) in the present invention are defined based on JIS Surface Roughness (B 0601). The term, "ten-point mean roughness" refers to the value represented in micrometers which is the difference between the average value of height from the highest summit to the fifth highest summit which are determined in the longitudinal magnification direction from a straight line which is parallel to the parallel line and does not cross the cross-sectional curve in the portion which is picked out by the standard length and the average value of the depth from the deepest valley to the fifth deepest valley. The term, "maximum roughness (Rt)" refers to the value represented in micrometer of the value which is determined in such a manner that the roughness curve is picked out by standard length L, and when the picked-out portion is interposed by two straight lines parallel to the center line, the gap between the resulting two lines is determined in the longitudinal magnification direction of the roughness curve. The term, "center line mean roughness (Ra)" refers to the value in micrometers, which is obtained by the following formula when a portion of measurement length L is picked out in the center line direction from the roughness curve, and the roughness curve is expressed by y=f(x), wherein the center line is taken as the X axis and the longitudinal magnification is taken as the Y axis.

$$Ra = \frac{1}{L}\int_0^L |f(x)|dx$$

Samples were subjected to moisture control at 25° C. and 65 percent relative humidity for 24 hours under no overlapping conditions, and subsequently, Rz, Rt, and Ra were determined at the same ambience. The term, "no overlapping conditions" refers to any of the methods in which, for example, winding is performed in such a manner that the edge portions are raise, films are overlapped while a paper sheet is inserted between the films, and a flame is prepared employing cardboard and the four corners are fixed. Listed as a usable measurement apparatus may, for example, be a RSTPLUS non-contact three-dimensional minute surface state measurement system.

It is possible to readily control Rz, Rt, and Ra of the front and rear surface of light-sensitive materials to be within the range of the present invention by appropriately combining the following technical means; 1) types, average particle diameter, added amount, and surface treatment methods of matting agents (inorganic or organic powders) incorporated in the layer on the side having an image forming layer and the layer on the side opposite the image forming layer; 2) dispersion conditions of matting agents (types of employed homogenizers, dispersion time, types of beads employed for dispersion, average particle diameter, types and amounts of dispersing agents used during dispersion, content of a polar group; 3) drying conditions after coating (coating rate, distance of heated air blowing nozzle from the coating surface, and drying air amount) and the amount of residual solvents; 4) types of filters employed to filter liquid coating compositions and filtration time; and 5) in cases in which a calender treatment is performed after coating, the employed conditions (for example, calendering temperature of 40-80° C., pressure of 50-300 kg/cm, line speed of 20-100 m, and the number of nips being 2-6).

In the present invention, the value of Rz(E)/Rz(B) is preferably 0.1-0.7, is more preferably 0.2-0.6, but is still more preferably 0.3-0.55. By controlling the above value to be in this range, of effects of the present invention, it is possible to markedly improve film conveyance and to minimize generation of uneven density.

In the present invention, the value of Ra(E)/Ra(B) is preferably 0.6-1.5, is more preferably 0.6-1.3, but is still more preferably 0.7-1.1. By controlling the above values to be in such a range, of effects of the present invention, particularly, it is possible to minimize an increase in fogging over an elapse of time, improve film conveyance, and minimize the generation of uneven density.

In the image forming method of the present invention, Lb/Le is preferably 2.0-10, but is more preferably 3.0-4.5, wherein Le (in μm) represents the average particle diameter of matting agents, having the maximum average particle diameter incorporated in the surface on the side having an image forming layer, while Lb (in μm) is the average particle diameter of matting agents having the maximum average particle diameter incorporated in the surface on the side having a back coat layer. By controlling Lb/Le to be in such a range, of effects of the present invention, particularly, it is possible to minimize uneven density during heat development. Further, in the image forming method of the present invention, the value of Rz(E)/Ra(E) is preferably 12-60, but is more preferably 14-50. By controlling Rz(E)/Ra(E) to be in such a range, of effects of the present invention, particularly, it is possible to minimize uneven density during heat development and to improve storage characteristics over an elapse of time. Still further, in the image forming method of the present invention, the value of Rz(B)/Ra(B) is preferably 25-65, but is more preferably 30-60. By controlling Rz(B)/Ra(B) to be in such a range, of effects of the present invention, particularly, it is possible to minimize uneven density during heat development and to improve storage characteristics over an elapse of time.

In the present invention, it is preferable to use organic or inorganic powders as a matting agent in the surface layer (on the side of the image forming layer, or even in cases in which a non-image forming layer is provided, on the side opposite the image forming layer across the surface of the support) in order to achieve the purpose of the present invention and control the surface roughness. Preferably employed as powders used in the present invention are those of a Mohs hardness of at least 5. Appropriately selected and employed as powders may be inorganic and organic powders known in the art. Listed as inorganic powders may, for example, be titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, garnet, mica, quartzite, silicon nitride, and silicon carbide. Listed as organic powders may, for example, be powders of polymethyl methacrylate, polystyrene, and TEFLON (a registered trade name). Of these, preferred are inorganic powders such as $SiO_2$, titanium oxide, barium sulfate, $\alpha$-$Al_2O_3$, $\alpha$-$Fe_2O_3$, $\alpha$-FeOOH, $Cr_2O_3$, or mica. Of these, preferred are $SiO_2$ and $\alpha$-$Al_2O_3$, while $\alpha$-$Al_2O_3$ is particularly preferred.

In the present invention, it is preferable that the aforesaid powders are, for example, subjected to a surface treatment. A surface treatment layer is formed as follows. After crushing inorganic powder components in a dry state, water and dispersing agents are added and subsequently, the resulting mixture is subjected to wet crushing, followed by rough particle size classification by employing centrifugal separation. Thereafter, a minute particle slurry is transferred to a surface treatment vessel and surface coating of metal hydroxides is performed. Initially, an aqueous solution of salts such as Al, Si, Ti, Zr, Sb, Sn, or Zn is added and acid or alkali, which neutralizes the resultant mixture, is added, whereby the surface of inorganic powder particles is coated employing the resulting hydrate oxides. Water-soluble salts formed as a by-product are removed employing decantation, filtration and washing. Finally, the pH of the slurry is controlled and the resulting slurry is washed with pure water. The washed cake is dried employing a spray drier or a portable dryer. Finally, the resulting dried material is crushed employing a jet mill to form a product. Alternatively, it is possible to perform an Al, Si surface treatment in such a manner that vapor of $AlCl_3$ and $SiCl_4$ is flowed into non-magnetic inorganic powders and thereafter steam is flowed in. With regard to other surface treatment methods, it is possible to refer to "Characterization of Powder Surface", Academic Press.

In the present invention, it is preferable that the surface treatment is performed employing Si or Al compounds. Use of powders, which have been subjected to such a surface treatment, makes it possible to improve the dispersion state during matting agent dispersion. With regard to the content of the above Si and Al, it is preferable that Si is 0.1-10 percent by weight with respect to the above powders, while Al is 0.1-10 percent by weight. It is more preferable that Si is 0.1-5 percent by weight and Al is 0.-5 percent by weight, but it is most preferable that Si is 0.1-2 percent by weight and Al is 0.1-2 percent by weight. Further, the weight ratio of Si to Al is preferably in the relationship of Si<Al. It is possible to perform the surface treatment employing the method described in JP-A No. 2-03219. The average particle diameter of the powders in the present invention refers to the average diameter of spherical particles in the particle powders, the average major axis length of acicular particles in acicular particle powder, and the average of the length of the maximum diagonal of the tabular plane of tabular particles in the tubular particle powder. It is easily determine such a diameters based on measurements employing an electron microscope.

The average particle diameter of the above organic or inorganic powders is preferably 0.5-10 μm, but is more preferably 1.0-8.0 μm.

The average particle diameter of organic or inorganic powders incorporated in the outermost layer on the image forming layer side is commonly 0.5-8.0 μm, is preferably 1.0-6.0 μm, but is more preferably 2.0-5.0 μm. The added amount is commonly 1.0-20 percent by weight with respect to the binder weight (the weight of crosslinking agents is included in the weight of binders) employed in the outermost layer, is preferably 2.0-15 percent by weight, but is more preferably 3.0-10 percent by weight. The average particle diameter of organic or inorganic powders incorporated into the outermost layer opposite the image forming layer side across the support is commonly 2.0-15.0 μm, is preferably 3.0-12 μm, but is more preferably 4.0-10.0 μm. The added amount is commonly 1.0-10 percent by weight with respect to the binder weight (the weight of crosslinking agents is included in the weight of binders) employed in the outermost layer, is preferably 0.4-7 percent by weight, but is more preferably 0.6-5 percent by weight.

Further, the variation coefficient of the particle size distribution of powders is preferably at most 50 percent, is more preferably at most 40 percent, but is most preferably at most 30 percent. The variation coefficient of the particle size distribution, as described herein, refers to the value represented by the formula below.

{(standard variation of particle diameter)/(average value of particle diameter)}×100

Organic or inorganic powders may be added employing a method in which they are previously dispersed in a liquid coating composition and coated, or in which after coating a liquid costing composition, organic or inorganic powders are sprayed onto the coating prior to the completion of drying. Further, in cases in which a plurality of types of powders is added, both methods may simultaneously be employed.

<Support>

Listed as materials of the support employed in the silver salt photothermographic dry imaging material of the present invention are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, polyethylene terephthalate film, polyethylene naphthalate film, polyamide film, polyimide film, cellulose triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

In the present invention, in order to minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773. Especially, it is preferable to incorporate a conductive metal oxide compound in a surface protective layer located on the same side as a baking layer. It was found that the effect of the present invention (especially, transporting property of the photothermographic material during heat processing.

Electrically conductive metal oxides, as described herein, include crystalline metal oxide particles. Those which contain oxygen defects, as well as a small amount of foreign atoms, which form a donor to metal oxides, are preferably employed since they are generally highly conductive. Specifically, the latter is particularly preferred since no togging results in silver halide emulsions. Preferred as examples of metal oxides are ZnO, $TiO_2$, $SnO_2$, $Al_2O_3$, $In_2O_3$, $SiO_2$, MgO, BaO, $MoO_3$, and $V_2O_5$, as well as composite oxides thereof. Of these, particularly preferred are ZnO, $TiO_2$, and $SnO_3$. In examples containing foreign atoms, the addition of Al and In to ZnO, the addition of Sb, Nb, P, and halogen atoms to $SnO_2$, as well as the addition of Nb and Ta to $TiO_2$ are effective. The added amount of these foreign atoms is preferably in the range of 0.01-30 mol percent, but is most preferably in the range of o.1-10 mol percent. Further, in order to improve minute particle dispersibility as well as transparency, silicon compounds may be incorporated during formation of minute particles.

Minute metal oxide particles employed in the present invention exhibit electric conductivity and volume resistivity thereof is at most $10^7$ Ω·cm, but is specifically at most $10^5$ Ω·cm. These oxides are described in JP-A Nos. 56-143431, 56-120519, and 58-62647. In addition, as described in Japanese Patent Publication No. 59-6235, employed may be electrically conductive components which are prepared by adhering the above metal oxides onto other crystalline metal oxide particles or fibrous materials (titanium oxide).

The preferred particle size is at most 1 μm. Particles at a maximum size of 0.5 μm are easily used since stability after dispersion is higher. Further, in order to reduce light scattering as much as possible, it is most preferable to use conductive particles of a maximum size of 0.3 μm since it is possible thereby to prepare transparent light-sensitive materials. Further, in cases in which conductive metal oxides are acicular or fibrous, it is preferable that their length is at most 30 μm and the diameter is at most 1 μm. It is also most preferable that the length is at most 10 μm and the diameter is at most 1 μm, while the length/diameter ratio is at least 3. Incidentally, $SnO_2$ is commercially available from Ishihara Sangyo Kaisha, Ltd. It is also allowed to use SNS10M, SAN-100P, SN-100D, and FSS10M.

The photothermographic material of the present invention incorporates a support having thereon at least one image forming layer, which is a light-sensitive layer. Only an image forming layer may be formed on a support, but it is preferable that at least one light-insensitive layer is formed on the image forming layer. For example, it is preferable that a protective layer is provided on the image forming layer for the purpose of protecting the image forming layer. Further, a back coat layer is provided on the opposite surface of the support in order to minimize "sticking" between light-sensitive materials or in wound rolls of light-sensitive materials.

Selected as binders employed in such a protective layer and a back coat layer from the aforesaid binders are, for example, polymers such as cellulose acetate, cellulose acetate butyrate, or cellulose acetate propionate, which exhibit a higher glass transition point (Tg) than the image forming layer, and barely suffer from abrasion as well as deformation.

Incidentally, in order to control gradation, at least two image forming layers may be formed on one side of the support or at least one layer may be formed on both sides of the same.

<Colorant>

In the silver salt photothermographic dry imaging material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

Employed as dyes may be compounds, known in the art, which absorb various wavelength regions according to the spectral sensitivity of photosensitive materials.

For example, when the silver salt photothermographic dry imaging material of the present invention is used as an image recording material utilizing infrared radiation, it is preferable to employ squarylium dyes having a thiopyrylium nucleus (hereinafter referred to as thiopyriliumsquarylium dyes) and squarylium dyes having a pyrylium nucleus (hereinafter referred to as pyryliumsquarylium dyes), as described in JP-A No. 2001-83655, and thiopyryliumcroconium dyes or pyryliumcroconium dyes which are analogous to the squarylium dyes.

Incidentally, the compounds having a squarylium nucleus, as described herein, refers to ones having 1-cyclobutene-2-hydroxy-4-one in their molecular structure. Herein, the hydroxyl group may be dissociated. Hereinafter, all of these dyes are referred to as squarylium dyes.

Incidentally, preferably employed as the dyes are compounds described in JP-A No. 8-201959.

<Layer Structures and Coating Conditions>

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight (more preferably less than 90 percent by weight), the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The aforesaid extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in time same manner as above. The detailed description of simultaneous multilayer coating methods for a photothermographic material is found in JP-A No. 2000-15173.

An adequate amount of silver coverage is selected in accordance with the purpose of the photothermographic material. For medical use, the silver coverage is preferably from 0.3 to 1.5 g/m$^2$, and is more preferably from 0.5 to 1.5 g/m$^2$. The ratio of the silver coverage which is resulted from silver halide is preferably from 2 to 18 percent with respect to the total silver, and is more preferably from 5 to 15 percent.

Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$.

Further, the coated weight of aliphatic carboxylic acid silver salts of the present invention is from $10^{-17}$ to $10^{-14}$ g per silver halide grain having a diameter (being a sphere equivalent grain diameter) of at least 0.01 μm, and is more preferably from $10^{-16}$ to $10^{-15}$ g.

When coating is carried out under conditions within the aforesaid range, from the viewpoint of maximum optical silver image density per definite silver coverage, namely covering power as well as silver image tone, desired results are obtained.

In the present invention, it is preferable that during development, photothermographic materials incorporate solvents in an amount of 5-1,000 mg/m$^2$. However, it is more preferable that the above amount is controlled to be 100-500 mg/m$^2$. By so doing, photothermographic materials are allowed to exhibit high photographic speed, lowered fogging, and higher maximum density. Listed as such solvents are those described in paragraph 「0030」 of JP-A No. 2001-264930, however, they are not limited thereto. Further, these solvents may be employed individually or in combinations of several types.

Incidentally, it is possible to control the amount of the above solvents in the photothermographic materials by changing conditions such as temperature during the drying process, following the coating process. Further, it is possible to determine the amount of the above solvents by employing gas chromatography under conditions suitable for detecting incorporated solvents.

<Packages>

In cases in which the photothermographic materials of the present invention are stored, in order to minimize density variation and fogging over an elapse of time, or to minimize curl and core-set curl, it is preferable that packaging is performed employing packaging materials of low oxygen permeability and/or low moisture permeability. The oxygen permeability is preferably at most 50 ml/atm·m$^2$·day at 25° C., is more preferably 10 ml/atm·m$^2$·day, but is still more preferably 1.0 ml/atm·m$^2$·day, while the moisture permeability is preferably 10 g/atm·m$^2$·day, is more preferably 5 g/atm·m$^2$·day, but is still more preferably 1 g/atm·m$^2$·day.

Specific examples of packaging materials for photothermographic materials include those described, for example, in JP-A Nos. 8-254793, 2000-206653, 2000-235242, 2002-0626225, 2003-0152261, 2003-057790, 2003-084397, 2003-098648, 2003-098635, 2003-107635, 2003-131337, 2003-146330, 2003-226439, and 2003-228152. The void ratio in packages is commonly controlled to be 0.01-10 percent, but is preferably 0.02-5 percent. Further, by enclosing nitrogen, it is preferable to control the partial pressure of nitrogen in the package to be at least 80 percent, but preferably at least 90 percent. Further, it is preferable to control the relative humidity in the package to be 10-60 percent, but is more preferably 40-55 percent.

<Exposure Conditions>

When the silver salt photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

Further, the light-sensitive materials of the present invention exhibit their characteristics when exposed preferably to light of high illumination intensity at a light amount of at least 1 $mW/mm^2$. Illumination intensity, as described herein, refers to the intensity which allows light-sensitive materials to result in an optical density of 3.0 after heat development. When such high intensity exposure is performed, it is possible to decrease the required light amount (=intensity× exposure time) to result in necessary optical density, whereby it is possible to design a high photographic speed system. The more preferred light amount is at least 2-50 $mW/mm^2$, but is more preferably 10-50 $W/mm^2$. Light sources are not particularly limited as long as they meet such requirements. However, when laser beams are employed, preferable exposure is achieved. Listed as preferably employed lasers in the present invention are gas lasers ($Ar^+$, KrHe—Ne), YAG lasers, dye laser beams, and semiconductor lasers. In addition, further preferably employed are secondary harmonic generating elements. In addition, further preferably employed are semiconductor lasers (having peak intensity in the wavelength range of 350-450 nm) which emit blue-violet. Listed as blue-violet emitting high-power output semiconductors lasers may be NLHV3000E semiconductor laser, marketed by Nichia Corp.

In the present invention, it is preferable that exposure is carried out utilizing laser scanning. Employed as the exposure methods are various ones. For example, listed as a firstly preferable method is the method utilizing a laser scanning exposure apparatus in which the angle between the scanning surface of a photosensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode.

The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

Further, as a third embodiment, it is preferable that by employing at least two laser beams, images are formed via scanning exposure. Such image recording, utilizing a plurality of laser beams, is employed as a technique in image writing methods of laser printers, as well as digital copiers in which an image is written over a plurality of lines in one scan to meet requirements for enhanced resolution as well as printing rate, which is disclosed, for example, in JP-A No. 60-166916. In this technique, a laser beam emitted from a beam source unit is subjected to beam deflected scanning, resulting in image formation on a photoreceptor via an fθ lens. This is a laser scanning optical apparatus employing the same principle as that used in laser imagers.

In the image writing method of laser printers and digital copiers, an image is written over a plurality of lines via one scan and thus the following laser beam forms an image which is shifted by one line from the image forming position of the previous laser beam. Specifically, two laser beams are adjacent to each other in the secondary scanning direction at a distance on the order of several 10 μm on the image forming surface, namely, each pitch in the secondary scanning direction at a printing density of 400 dpi (dpi represents the number of dots per inch/2.54 cm) is 43.3 μm. Being different from the method in which a shift equivalent to resolution in the secondary scanning direction is performed, in the present invention, it is preferable that images are formed in such a manner that at least two laser beams are converged on the same location under varying incident angles. During such operation, when E represents exposure energy on the exposure surface in cases in which, one laser beam (of wavelength λ (in nm)) is commonly used for writing, and N laser beams used for exposure have the same wavelength (wavelength λ (in nm)) and the same exposure energy (En), it is preferable to control the range so that $0.9\times E \leqq En\times N \leqq 1.1\times E$ is held. By so doing, energy on the exposure surface is secured and reflection of each laser beam on the image forming layer is decreased due to low exposure energy, and the generation of interference fringes is reduced.

Incidentally, as noted above, a plurality of laser beams having the same wavelength λ is used, but those having different wavelength may also be employed. In such a case, it is preferable to maintain the range to satisfy the formula of $(\lambda-30)<\lambda 1, \lambda 2, \ldots \lambda n \leqq (\lambda+30)$.

Incidentally, in the recording methods of the aforesaid the first to third embodiments, it is possible to suitably select any of the following lasers employed for scanning exposure, which are generally well known, while matching the use. The aforesaid lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm.

The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

<Thermal Processor>

Figure 2:
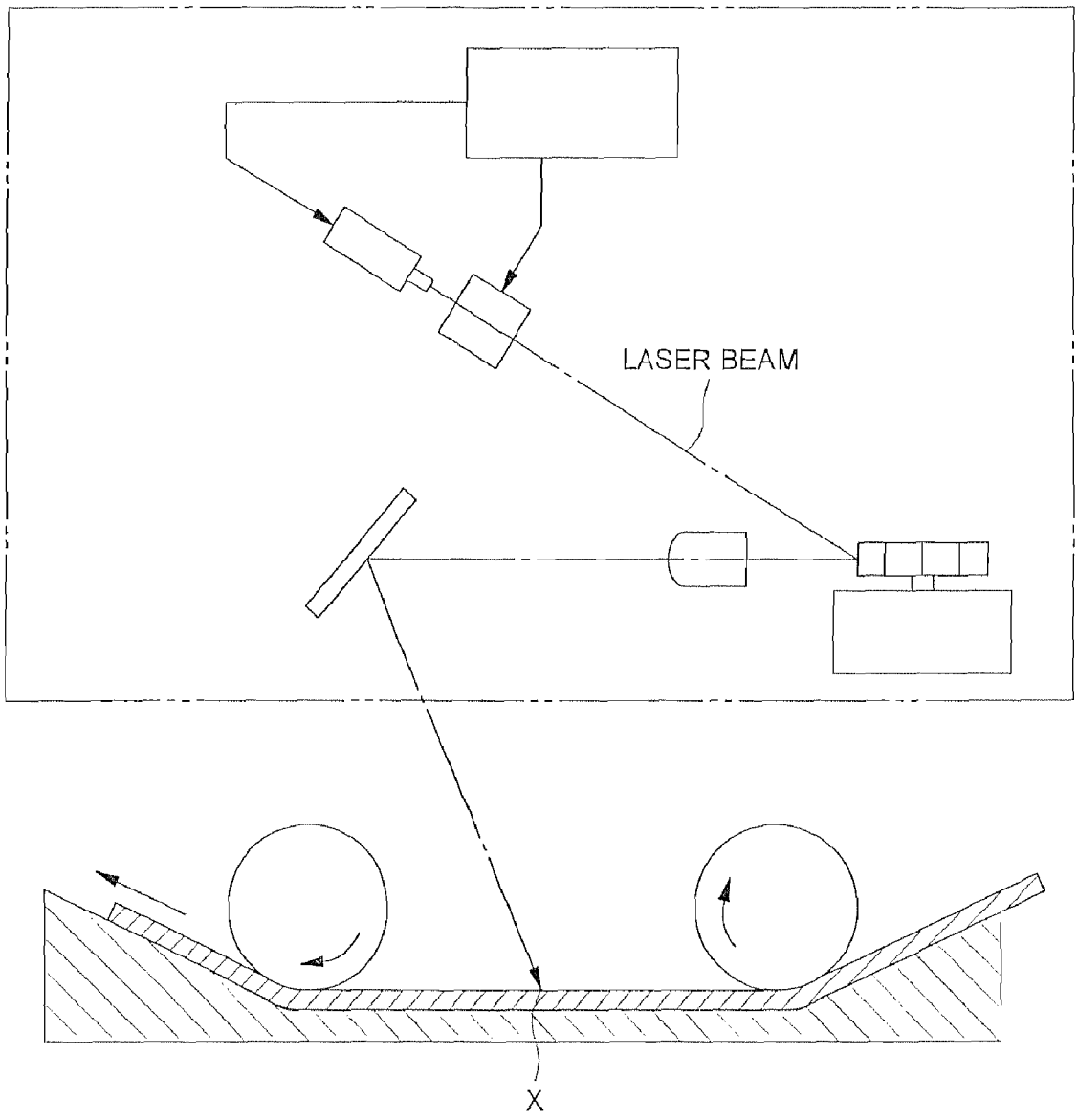
FIG. 2 is a schematic view showing the structure of the conveying section to convey sheets of heat developable recording materials, as well as a scanning exposure section in a laser recording apparatus.

A thermal processor is explained by referring FIG. 1 and FIG. 2.

A thermal processor, as described in the present invention, is composed of a photothermographic material feeding section (a film feeding section: A in FIG. 1) represented by a photothermographic material tray (a film tray: 10*a*, 10*b* and 10*c* in FIG. 1), a laser image recording section (B in FIG. 1), a heat development section (C in FIG. 1) which uniformly and consistently provides heat onto the entire surface of the photothermographic materials (15*a*, 15*b* and 15*c* in FIG. 1), and a conveying section which discharges image-formed photothermographic materials via heat development, from the film feeding section to the exterior of the apparatus via the laser image recording section. FIGS. 1 and 2 show specific examples of thermal processors in such embodiments. In order to simultaneously perform exposure and heat development, namely to initiate development of previously exposed light-sensitive sheet while exposed to a part of the above light-sensitive sheet, it is preferable that the distance between the exposure section and the development section is 0-50 cm. By such action, the series of processing time for exposure and development is extremely decreased. The above distance is preferably 3-40 cm, but is more preferably 5-30 cm.

The exposure section, as described herein, refers to the position at which light from the exposure light source is irradiated onto photothermographic materials, while the development section, as described herein, refers to the position at which the photothermographic material is first heated to be subjected to heat development. In FIG. 1 and FIG. 2, X is the exposure section, while Y in FIG. 1 is a development section, in which a light-sensitive material conveyed from 53 initially comes into contact with plate 51*a*.

Incidentally, the conveying rate of photothermographic materials in the heat development section is preferably in the range of 20-200 mm/second, but is more preferably in the range of 25-200 mm/second. By controlling the conveying rate to be within the above range, it is possible to minimize uneven density during heat development and to correspond to diagnosis in an emergency since it is possible to shorten the processing time.

<Development Conditions>

In the present invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 80 to about 200° C., preferably from about 100 to about 140° C., more preferably from about 110 to about 130° C.) for a sufficient period (commonly from about 1 second to about 2 minutes). When heating temperature is less than or equal to 80° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport or the material while the surface comes into contact with the heating rollers.

EXAMPLES

The present invention will now be detailed with reference to examples. However, the present invention is not limited to these examples. Unless specifically denoted, "%" in the Examples indicates "weight %".

Example 1

<<Preparation of Subbed Photographic Supports>>

A photographic support comprised of a 175 μm thick biaxially oriented polyethylene terephthalate film with blue tinted by a blue dye shown below at an optical density of 0.150 (determined by Densitometer PDA-65, manufactured by Konica Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140° C. An electrically conductive subbing layer (designated as Subbing Lower Layer B-1), which exhibited an antistatic function, was applied onto the backing layer side. The surface of Subbing Lower Layer A1 and Subbing Lower Layer B-1 was subjected to corona discharge treatment of 8 W·minute/$m^2$. Subsequently, subbing liquid coating composition a-2 was applied onto Subbing Lower Layer A1 was applied at 33° C. and 100 m/minute to result in a dried layer thickness of 0.03 μm and dried at 140° C. The resulting Layer was designated as Subbing Upper Layer A-2. Subbing liquid coating composition b-2 described below was applied onto Subbing Lower Layer B-1 at 33° C. and 100 m/minute to results in a dried layer thickness of 0.2 μm and dried at 140° C. The resulting layer was designated as Subbing Upper Layer B-2. Thereafter, the resulting support was subjected to heat treatment at 123° C. for two minutes and wound up under the conditions of 25° C. and 50 percent relative humidity, whereby a subbed sample was prepared.

Blue Dye

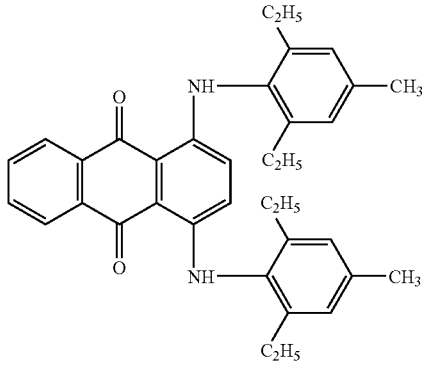

<Preparation of Water-Based Polyester A-1>

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170-220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220-235° C. while distilling out a nearly theoretical amount of water.

Thereafter, the reaction system was subjected to pressure reduction and heating over a period of one hour and was subjected to polycondensation at a final temperature of 280° C. and a maximum pressure of 133 Pa for one hour, whereby Water-soluble Polyester A-1 was synthesized. The intrinsic viscosity of the resulting Water-soluble Polyester A-1 was 0.33, the average particle diameters was 40 nm, and Mw was 80,000-100,000.

Subsequently, 850 ml of pure water was placed in a 2-liter three-necked flask fitted with stirring blades, a refluxing cooling pipe, and a thermometer, and while rotating the stirring blades, 150 g of Water-soluble Polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allow to stand overnight, whereby Water-based Polyester A-1 Solution was prepared.

<Preparation of Modified Water-Based Polyester B-1 and B-2 Solutions>

Placed in a 3-liter four-necked flask fitted with stirring blades, a reflux cooling pipe, a thermometer, and a dripping funnel was 1,900 ml of the aforesaid 15 percent by weight Water-based Polyester A-1 Solution, and the interior temperature was raised to 80° C., while rotating the stirring blades. Into this added was 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby Modified Water-based Polyesters B-1 Solution (vinyl based component modification ratio of 20 percent by weight) at a solid concentration of 18 percent by weight was obtained.

Modified Water-based Polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate: acetoacetoxyethyl methacrylate:n-butyl acrylate 39.5:40:20: 0.5.

(Preparation of Acryl Based Polymer Latexes C-1-C-3)

Acryl Based Polymer Latexes C-1-C-3 having the monomer compositions shown in the following table were synthesized employing emulsion polymerization. All the solid concentrations were adjusted to 30 percent by weight.

TABLE 1

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate:acetacetoxyethyl methacrylate = 40:40:20 | 50 |

<<Water Based Polymers Containing Polyvinyl Alcohol Units>>

D-1: PVA-617 (Water Dispersion (5 percent solids): degree of saponification of 95, manufactured by Kuraray Co., Ltd.)

(Subbing Lower Layer Liquid Coating Composition a-1 on Image Forming Layer Side)

| | |
|---|---|
| Acryl Based Polymer Larex C-3 (30 percent solids) | 70.0 g |
| Water dispersion of ethoxylated alcohol and ethylene homopolymer (10 percent solids) | 5.0 g |
| Surface Active Agent (A) | 0.1 g |

A coating liquid composition was prepared by adding water to make 1,000 ml.

<<Image Forming Layer Side Subbing Upper Layer Liquid Coating Composition a-2>>

| | |
|---|---|
| Modified Water-based Polyester B-2 (18 percent by weight) | 30.0 g |
| Surface Active Agent (A) | 0.1 g |
| Spherical silica matting agent (Sea Hoster KE-P50, manufactured by Nippon Shokubai Co., Ltd.) | 0.04 g |

A liquid coating composition was prepared by adding water to make 1,000 ml.

(Backing Layer Side Subbing Lower Layer Liquid Coating Composition b-1)

| | |
|---|---|
| Acryl Based Polymer Late C-1 (30 percent solids) | 30.0 g |
| Acryl Based Polymer Late C-2 (30 percent solids) | 7.6 g |
| $SnO_2$ sol | 180 g |

(the solid concentration of $SnO_2$ sol synthesized employing the method described in Example 1 of Japanese Patent Publication 35-6616 was heated and concentrated to reach a solid concentration of 10 percent by weight, and subsequently, the pH was adjusted to 10 by the addition of ammonia water)

| | |
|---|---|
| Surface Active Agent (A) | 0.5 g |
| 5 percent by weight of PVA-613 (PVA, manufactured by Kuraray Co., Ltd.) | 0.4 g |

A liquid coating composition was prepared by adding water to make 1,000 ml.

(Backing Layer Side Subbing Upper Layer Liquid Coatings Composition b-2)

| | |
|---|---|
| Modified Water-based Polyester B-1 (18 percent by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |

A liquid coating composition was prepared by adding water to make 1,000 ml.

Incidentally, an antihalation layer having the composition described below was applied onto Subbing Layer A-2 applied onto the aforesaid support.

Surface Active Agent (A)

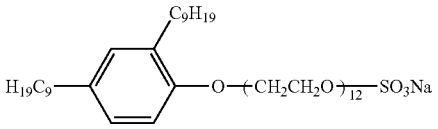

(Preparation of Back Coat Layer Liquid Coating Composition)

While stirring 830 g of methyl ethyl ketone (MEK), 84.2 g of cellulose acetate propionate (CAP482-20, produced by Eastman Chemical Co.) and 4.5 g of a polyester resin (VITEL PE2200B, available from Bostic Co.) were added and dissolved. Subsequently, 0.30 g of Infrared Dye 1 below was added to the resulting solution, and 4.5 g of a fluorine based surface active agent (SURFRON KH40, produced by Asahi Glass Co., Ltd.) and 2.3 g of a fluorine based surface active agent (MEGAFAG F120K, produced by Dainippon Ink and Chemicals, Inc.), which were dissolved in 43.2 g of methanol, were added and vigorously stirred until complete dissolution. Thereafter, 2.5 g of oleyl oleate was added while stirring, whereby a back coat layer liquid coating composition was prepared.

Infrared Dye 1

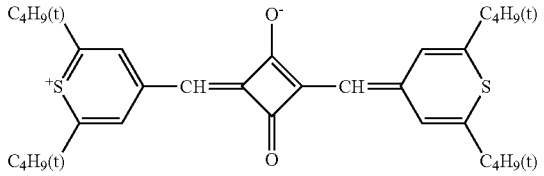

(Preparation of Back Coat Layer Protective Layer (Surface Protective Layer) Liquid Coating Composition)

The back coat layer protective layer liquid coating composition was prepared in the same manner as the back coat layer liquid coating composition under the composition ratios below. Silica was dispersed into MEK at a concentration of one percent, employing a dissolver type homogenizer, and finally added.

| | |
|---|---|
| Celluloses acetate propionate (10 percent MEK solution) (CAP482-20, produced by Eastman Chemical Co.) | 15 g |
| Monodipsersed silica of a monodispersibility of 15 percent (average particle diameter and added amount as silica are described in Table 2) (the surface was treated with aluminum in an amount of one percent of the total silica weight) | |
| $C_8F_{17}(CH_2CH_2O)_{12}C_8F_{17}$ | 0.05 g |
| Fluorine based surface active agent (SF-17) | 0.01 g |
| Stearic acid | 0.1 g |
| Oleyl oleate | 0.1 g |
| α-Alumina (at a Mohs hardness of 9) | 0.1 g |

<Preparation of Light-Sensitive Silver Halide Emulsion A1>

| | | |
|---|---|---|
| (A1) | Phenylcarbamolylated gelatin | 88.3 g |
| | 10 percent aqueous methanol solution of Compound (AO-1) | 10 ml |
| | Potassium bromide | 0.32 g |
| | Water to make | 5429 ml |
| (B1) | 0.67 mol/L aqueous silver nitrate solution | 2635 ml |
| (C1) | Potassium bromide | 50.69 g |
| | Potassium iodide | 2.66 g |
| | Water to make | 660 ml |
| (D1) | Potassium bromide | 151.6 g |
| | Potassium iodide | 7.67 g |
| | Potassium hexachloroiridate (IV) $K_2(IrCl_6)$ (one percent aqueous solution) | 0.93 ml |
| | Potassium hexacyanoferrate (II) | 0.004 g |
| | Potassium hexachloroosmate (IV) | 0.004 g |
| | Water to make | 1982 ml |
| (E1) | 0.4 mol/L aqueous potassium bromide solution silver potential controlling amount below | |
| | Potassium hydroxide | 0.71 g |
| | Water to make | 20 ml |
| (G1) | 56 percent aqueous acetic acid solution | 18.0 ml |
| (H1) | Sodium carbonate anhydride | 1.72 g |
| | Water to make | 151 ml |
| | AO-1: $HO(CH_2CH_2O)_n[CH(CH_3)CH_2O]_{17}(CH_2CH_2O)_mH$ (m + n = 5–7) | |

<Preparation of Photosensitive Silver Halide Emulsion A1>

Upon employing a mixing stirrer shown in Japanese Patent Publication Nos. 58-58288 and 58-58289, ¼ portion of Solution B1 and whole Solution C1 were added to Solution A1 over 4 minutes 45 seconds, employing a double-jet precipitation method while adjusting the temperature to 30° C. and the pAg to 8.09, whereby nuclei were formed. After one minute, whole Solution F1 was added. During the addition, the pAg was appropriately adjusted employing Solution E1. After 6 minutes, ¾ portion of Solution B1 and whole Solution D1 were added over 14 minutes 15 seconds, employing a double-jet precipitation method while adjusting the temperature to 30° C. and the pAg to 8.09. After stirring for 5 minutes, the mixture was cooled to 40° C., and whole Solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, Solution H1 was added and the resultant mixture was heated to 60° C., and then stirred for an additional 120 minutes. Finally, the pH was adjusted to 5.8 and water was added so that the weight was adjusted to 1,161 g per mol of silver, whereby the emulsion A1 was prepared.

The prepared emulsion was comprised of monodispersed cubic silver iodobromide grains having an average grain size of 25 cm, a grain size variation coefficient of 12% and a (100) surface ratio of 92% (a content of AgI was 3.5 mol %).

<Preparation of Photosensitive Silver Halide Emulsion A2>

Photosensitive Silver Halide Emulsion A2 was prepared in the same manner as aforesaid Photosensitive Silver Halide Emulsion A1, except that 5 ml of 0.4% aqueous lead bromide solution was added to Solution D1.

Incidentally, the prepared emulsion was comprised of monodispersed cubic silver iodobromide grains having an average grain size of 25 nm, a grain size variation coefficient of 12% and a (100) surface ratio of 92% (a content of AgI was 3.5 mol %).

<Preparation of Photosensitive Silver Halide Emulsion A3>

Photosensitive Silver Halide Emulsion A3 was prepared in the same manner as aforesaid Photosensitive Silver Halide Emulsion A1, except that after nucleus formation, all Solution F1 was added, and subsequently 40 ml of a 5% aqueous 4-hydroxy-6-methyl-1,3,3a,7-tetraazaindene solution was added.

Incidentally, the prepared emulsion was comprised of monodispersed cubic silver iodobromide grains having an average grain size of 25 nm, a grain size variation coefficient of 12% and a (100) surface ratio of 92% (a content of AgI was 3.5 mol %).

<Preparation of Photosensitive Silver Halide Emulsion A4>

Photosensitive Silver Halide Emulsion A4 was prepared in the same manner as aforesaid Photosensitive Silver Halide Emulsion A1, except that after nucleus formation, all Solution F1 was added and subsequently 4 ml of a 0.1% ethanol solution of ETTU (indicated below) was added.

Incidentally, the prepared emulsion was comprised of monodispersed cubic silver iodobromide grains having an average grain size of 25 nm, a grain size variation coefficient of 12% and a (100) surface ratio of 92% (a content of AgI was 3.5 mol %).

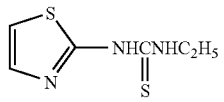

ETTU

<Preparation of Photosensitive Silver Halide Emulsion A5>

Photosensitive Silver Halide Emulsion A5 was prepared in the same manner as aforesaid Photosensitive Silver Halide Emulsion A1, except that after nucleus formation, all Solution F1 was added, and subsequently 4 ml of a 0.1% ethanol solution of 1,2-benzothiazoline-3-one was added.

Incidentally, the prepared emulsion was comprised of monodispersed cubic silver bromide grains having an average grain size of 25 nm, a grain size variation coefficient of 12% and a (100) surface ratio of 93 (a content of AgI was 3.5 mol %).

<Preparation of Light-Sensitive Silver Halide Emulsion B1>

Preparation was performed in the same manner as Light-sensitive Silver Halide Emulsion A1, except that the temperature during the addition, employing a double-jet method, was changed to 45° C. The resulting emulsion was composed of monodispersed cubic silver iodobromide grains of an average grain size of 55 nm, a variation coefficient of the grain size of 12 percent, and a [100] plane ratio of 92 percent (the content of AgI was 3.5 mol percent).

<Preparation of Light-Sensitive Silver Halide Emulsion B2>

Light-sensitive Silver Halide Emulsion B2 was prepared in the same manner as described Light-sensitive Silver Halide Emulsion B1, except that after nuclei formation, all Solution F1 was added and thereafter, 4 ml of one percent ethanol solution of above compound (ETTU) was added. The resulting emulsion was composed of monodispersed cubic silver iodobromide grains of an average grain size of 55 nm, a variation coefficient of the grain size of 12 percent, and a [100] plane ratio of 92 percent (the content of AgI was 3.5 mol percent).

<Preparation of Powdered Organic Silver Salts>

At 80° C., dissolved in 4,720 ml of pure water were 130.8 g of behenic acid, 67.7 g of arachidic acid, 43.6 g of stearic acid, and 2.3 g of palmitic acid. Subsequently, 540.2 ml of a 1.5 mol/L, aqueous sodium hydroxide solution and 6.9 ml of concentrated nitric acid were added. Thereafter, the resulting mixture was cooled to 55° C., whereby a fatty acid sodium salt solution was obtained. While maintaining the above fatty acid sodium salt solution at 55° C., a light-sensitive silver halide emulsion (the type and added amount are described in Table 2) and 450 ml of pure water were added and stirred for 5 minutes. Subsequently, 469.4 ml of a one mol/L silver nitrate solution was added over two minutes and stirred for an additional 10 minutes, whereby an organic silver salt dispersion was obtained. Thereafter, the resulting organic silver salt dispersion was transferred to a washing vessel and deionized water was added. While left standing, the organic silver salt dispersion was separated while floated, and water-soluble salts in the lower portion were removed. Thereafter, washing was repeated employing deionized water until the electric conductivity of the effluent reached 2 μS/cm. After performing centrifugal dehydration to a moisture content of 0.1 percent, the resulting cake-shaped organic silver salt was dried employing an airborne dryer FLASH JET DRYER (produced by Seishin Kikaku) under operation conditions (at 65° C. at the inlet and 40° C. at the outlet) of a nitrogen gas ambience and gas temperatures of the dryer, whereby dried organic silver salt in the form of a powder was obtained. Photothermographic Material Sample 1 prepared employing the above organic silver salts was analyzed employing an electron microscope, resulting in tabular grains of an average grain diameter of 0.08 μm. an aspect ratio of 5, and a monodispersibility of 10 percent.

Incidentally, the moisture regain of the organic salt compositions was determined employing an infrared moisture meter.

<Preparation of Preliminary Dispersion A>

Dissolved in 1457 g of methyl ethyl ketone (hereinafter referred to as MEK) was 14.57 g of poly(vinyl butyral) resin P-9. While stirring, employing Dissolver DISPERMAT Type CA-40M, manufactured by VMA-Getzmann Co., 500 g of aforesaid Powder Aliphatic Carboxylic Acid Silver Salt A was gradually added and sufficiently mixed, whereby Preliminary Dispersion A was prepared.

<Preparation of Photosensitive Emulsion A>

Preliminary Dispersion A, prepared as above, was charged into a media type homogenizer DISPERMAT Type SL-C12EX (manufactured by VMA-Getzmann Co.), filled with 0.5 mm diameter zirconia beads so as to occupy 80 percent of the interior volume so that the retention time in the mill reached 1.5 minutes and was dispersed at a peripheral rate of the mill of 8 m/second, whereby Photosensitive Emulsion A was prepared.

<Preparation of Stabilizer Solution>

Stabilizer Solution was prepared by dissolving 1.0 g of Stabilizer 1 and 0.31 g of potassium acetate in 4.97 g of methanol.

<Preparation of Infrared Sensitizing Dye A Solution>

Infrared Sensitizing Dye A Solution was prepared by dissolving 9.6 mg of Infrared Sensitizing Dye 1, 9.6 mg of Infrared Sensitizing Dye 2, 1.488 g of 2-chloro-benzoic acid, 2.779 g of Stabilizer 2, and 365 mg of 5-methyl-2-mercaptobenzimidazole in 31.3 ml of MEK in a light-shielded room.

<Preparation of Additive Solution "a">

Additive Solution "a" was prepared by dissolving a reducing agent (amount and compound are indicated in Table 2) and 0.159 g of YA-1, 0.159 g of CL-12, 1.54 g of 4-methylphthalic acid, and 0.48 g of aforesaid Infrared Dye 1 in 110 g of MEK.

(Preparation of Additive Solution "b")

Additive Solution "b" was prepared by dissolving 1.56 g of Antifoggant 2, 0.5 g of Antifoggant 3, 0.5 g of Antifoggant 4, 0.5 g of Antifoggant 5 and 3.43 g of phthalazine in 40.9 g of MEK.

<Preparation of Addition Solution c>

Dissolved in 39.99 g of MEK was 0.01 g of silver saving agent (A1), and the resulting solution was designated as Addition Solution c.

<Preparation of Addition Solution d>

Dissolved in 9.9 g of MEK was 0.1 g of Supersensitizer 1, and the resulting solution was designated as Addition Solution d.

<Preparation of Addition Solution e>

Dissolved in 9.0 g of MEK were 0.5 g of potassium p-toluenethiosulfate and 0.5 g of Antifogging Agent 6, and the resulting solution was designated as Addition Solution e.

<Preparation of Addition Solution f>

Dissolved in 9.0 g of MEK was 1.0 g of an antifogging agent containing vinylsulfone ($(CH_2{=}CH{-}SO_2CH_2)_2CHOH$), and the resulting solution was designated as Addition Solution f.

<Preparation of Image Forming Layer Liquid Coating Composition>

While stirring, in an ambience of inert gases (97 percent nitrogen), 30 g of the above light-sensitive emulsion (described in Table 2) and 15.11 g of MEK were maintained at 21° C., and 1,000 μl of Chemical Sensitizer S-5 (0.5 percent methanol solution) was added. After two minutes, 390 μl of Antifogging Agent 1 (a 10 percent methanol solution) was added and the resulting mixture was stirred for one hour. Further, 494 μl of calcium bromide (a 10 percent methanol solution) was added, and the resulting mixture was stirred for 10 minutes. Thereafter, Gold Sensitizer Au-5 in an amount equivalent to 1/20 mol of the above organic chemical sensitizer was added and the resulting mixture was stirred for 20 minutes. Subsequently, 167 μl of a stabilizer solution was added and the resulting mixture was stirred for 10 minutes. Thereafter, 1.32 g of described Infrared Sensitizing Dye Solution A was added and the resulting mixture was stirred for one hour. Thereafter, the temperature was lowered to 13° C., and stirring was further performed over 30 minutes. While maintained at 13° C., 0.5 g of Addition Solution d, 0.5 g of Addition Solution e, 0.5 g of Addition Solution f, and 13.31 g of the binders employed in Preliminary Dispersion A were added and the resulting mixture was stirred for 30 minutes. Thereafter, 1.084 g of tetrachlorophthalic acid (being a 9.4 percent MEK solution) was added and the resulting mixture was stirred for 15 minutes. While stirring, 12.43 g of Addition Solution a, 1.6 ml of DESMODUR (isocyanate produced by Mobay Co.) (being a 10 percent MEK solution), 4.27 g of Addition Solution b, and 4.0 g of Addition Solution c were successively added, whereby an image forming layer liquid coating composition was obtained.

Structures of additives employed to prepare each of the liquid coating compositions firstly including a stabilizer liquid, as well as image forming layer liquid coating compositions, are shown below.

Stabilizer 1
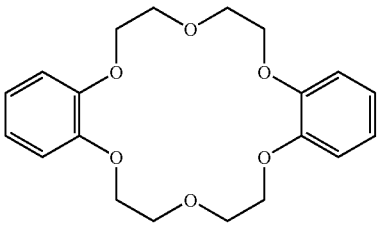
Stabilizer 2
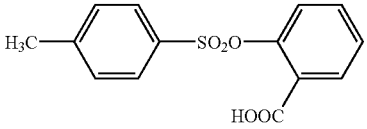
Antifogging Agent 2
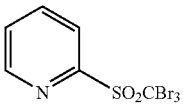
Antifogging Agent 3
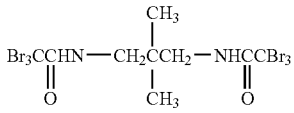
Antifogging Agent 4
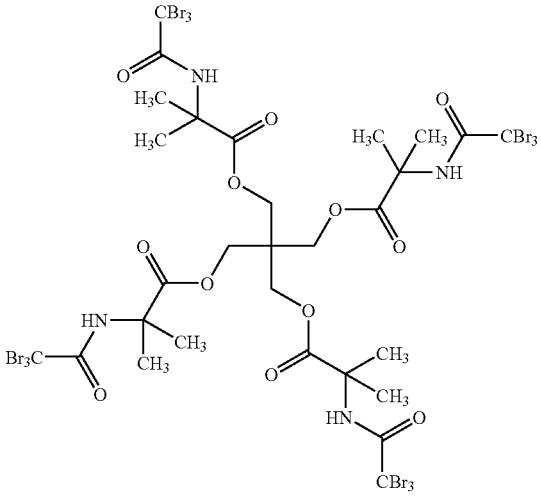
Antifogging Agent 5
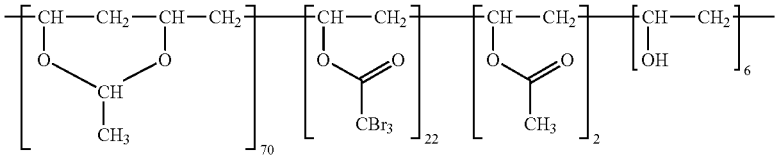
Number average molecular weight of 20,000
Infrared Sensitizing Dye 1
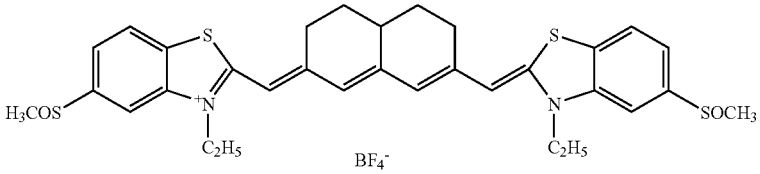
Infrared Sensitizing Dye 2
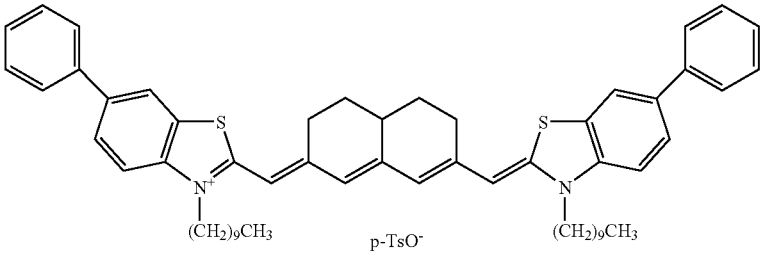

-continued

Supersensitizer 1

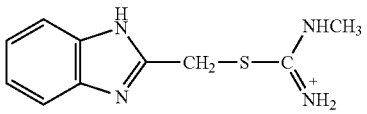

Antifogging Agent 6

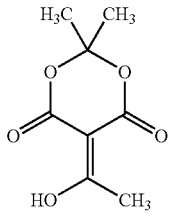

Antifogging Agent 1

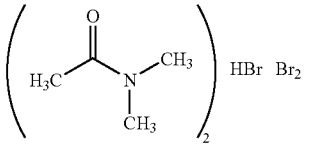

Silver Saving Agent (A1)

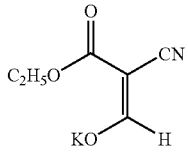

Chemical Sensitizer S-5

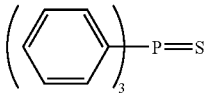

Au-5

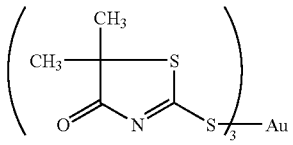

<Preparation of Image Forming Layer Protective Layer Underlayer (Surface Protective Layer Underlayer)>

| | |
|---|---|
| Acetone | 5 g |
| MEK | 21 g |
| Cellulose acetate propionate (CAP-141-20 at a glass transition temperature of 190° C., produced by Eastman Chemical Co.) | 2.3 g |
| Methanol | 7 g |
| Phthalazine | 0.25 g |
| $CH_2{=}CHSO_2CH_2CH_2OCH_2CH_2SO_2CH{=}CH_2$ | 0.035 g |
| $C_{12}H_{25}(CH_2CH_2O)_{10}C_{12}F_{25}$ | 0.01 g |
| Fluorine based surface active agent (SF-17, as above) | 0.01 g |
| Stearic acid | 0.1 g |
| Butyl stearate | 0.1 g |
| α-Alumina (at a Mohs hardness of 9) | 0.1 g |

<Preparation of Image Forming Layer Protective Layer Upper Layer (Surface Protective Layer Upper layer)>

| | |
|---|---|
| Acetone | 5 g |
| MEK | 21 g |
| Cellulose acetate propionate (CAP-141-20 at a glass transition temperature of 190° C., produced by Eastman Chemical Co.) | 2.3 g |
| Methanol | 7 g |
| Phthalazine | 0.25 g |

Silica having a degree of monodispersion of 15%

(an average particle size and an added amount as silica is indicated in Table 2)

(the surface of the employed silica is treated with 1 wt % of aluminium based on the total weight of silica)

| | |
|---|---|
| $CH_2{=}CHSO_2CH_2CH_2OCH_2CH_2SO_2CH{=}CH_2$ | 0.035 g |
| $C_{12}H_{25}(CH_2CH_2O)_{10}C_{12}F_{25}$ | 0.01 g |

-continued

| | |
|---|---|
| Fluorine based surface active agent (SF-17, as above) | 0.01 g |
| Stearic acid | 0.1 g |
| Butyl stearate | 0.1 g |
| α-Alumina (at a Mohs hardness of 9) | 0.1 g |

Incidentally, the image forming layer protective layer upper layer and underlayer were prepared under the above composition ratio, employing the same method as for preparing the back coat layer liquid coating composition. Silica was dispersed into MEK at a concentration of one percent by weight, employing a dissolver type homogenizer in the same manner as for the back coat layer protective layer, and finally added while stirring, whereby image forming layer protective layer upper layer and underlayer liquid coating compositions were obtained.

<Preparation of Photothermographic Materials>

The back coat layer liquid coating composition and the back coat layer protective layer liquid coating composition, both prepared as above, were applied onto Subbing Upper Layer B-2, employing an extrusion coater at a coating rate of 50 m/minute to result in a dried layer thickness of 3.5 μm for each. Incidentally, drying was performed over 5 minutes employing a drying air flow at 100° C. and a dew point of 10° C.

By simultaneously applying the above image forming layer liquid coating composition and image forming layer protective layer (a surface protective lawyer) liquid coating composition onto Subbing Upper Layer A-2 at a coating rate of 50 m/minute, employing an extrusion coater, Light-sensitive Material Samples 1-20, listed in Table 2, were prepared. Coating was performed in such a manner that the image forming layer resulted in a coated silver weight of 1.2 g/m$^2$ and a dried layer thickness of the image forming layer protective layer (surface protective layers) of 3.0 μm (1.5 μm of the surface protective layer upper layer and 1.5 μm of the surface protective layer underlayer). Thereafter, drying was performed for 10 minutes employing a drying air flow of a temperature of 75° C. and a dew point of 10° C.

The pH and Bekk smoothness of the layer surface on the image forming layer side of the resulting photothermographic material (Sample 17) was 5.3 and 6,000 seconds, respectively, while the pH and Bekk smoothness of the layer surface on the back coat layer side of the same were 5.5 and 9,000 seconds, respectively.

Incidentally, Sample 13 was prepared in the same manner as Sample 3, except that during preparation of the organic silver salt powder in Sample 3, 259.9 g of behenic acid was used instead of 130.8 g of behenic acid, 67.7 g of arachidic acid, 43.6 g of stearic acid and 2.3 g of palmitic acid.

Sample 14 was prepared in the same manner as Sample 3, except that during preparation of the organic silver salt powder, 540.2 ml of a 1.5 mol/L aqueous sodium hydroxide solution was replaced with 540.2 ml of a 1.5 mmol/L, aqueous potassium hydroxide solution.

Sample 15 was prepared in the same manner as Sample 3, except that fluorine based surface active agent SF-17 in the back coat layer protective layer and the image forming layer protective layer (both upper layer and underlayer) in Sample 3 was replaced with $C_8F_{17}SO_3Li$.

Sample 16 was prepared in the same manner as Sample 3, except that the $SO_3K$ group containing polyvinyl butyral (having a Tg of 75° C., and containing $SO_3K$ in an amount of 0.2 millimol/g) employed as an image forming layer binder during preparation of the preliminary dispersion in Sample 3 was replaced with a $SO_3K$ group containing polyvinyl butyral (having a Tg of 65° C. and containing $SO_3K$ in an amount of 2 millimol/g).

<Exposure and Photographic Processing>

After cutting each of Photothermographic Material Samples 1-20, prepared as above, into sheets of 34.5×43.0 cm, the resulting sheets were packaged at 25° C. and 50 percent, employing the following packaging materials. After storage at normal temperature for two weeks, the following evaluations were performed.

<Packaging Materials>

Barrier bags composed of PET 10 μm/PE 12 μm/aluminum foil 9 μm/Ny 15 μm/polyethylene 50 μm containing carbon in an amount of 3 percent, of an oxygen permeability of 0 ml/atm·$m^2$·25° C.·day, and a moisture permeability of 0 g/atm·$m^2$·25° C.·day, and paper trays were employed.

<Evaluations of Samples>

Exposure and heat development (employing three panel heaters set at 107° C., 123° C. and 123° C. over a total time of 13.5 seconds) were simultaneously performed employing the laser imager (fitted with a semiconductor laser of a maximum output of 50 mW (IIB) at 810 nm) shown in FIGS. 1 and 2. Density of the resulting images was determined employing a densitometer. As used herein, the term "exposure and heat development were simultaneously performed" means that "in one sheet of the photothermographic material, while being partially exposed, development was initiated on the part of the exposed light-sensitive sheet". The distance between the exposure section and the development section was 12 cm, while the Linear rate was 25 mm/second. The above-described process can be expressed as "simultaneously or sequentially heating the exposed photothermographic material to develop the latent image".

During the above operation, each of the conveying rates from the light-sensitive material feeding section to the image exposure section, at the image exposure section, and at the heat development section was 25 mm/second. Incidentally, exposure and development were performed in a room at 23° C. and 50 percent relative humidity. Exposure was performed stepwise by decreasing the exposure energy amount by loge of 0.05 for each step.

Example 2

<<Preparation of Subbed Photographic Support>>

Preparation was performed in the same manner as for Example 1.

<Preparation of Back Coat Layer Liquid Coating Composition>

While stirring, 830 g of methyl ethyl ketone (MEK), 84.2 g of cellulose acetate propionate (CAP482-20, produced by Eastman Chemical Co.) and 4.5 g of a polyester resin (VITEL, PE2200B, available from Bostic Co.) were added and dissolved. Subsequently, 4.5 g of a fluorine based surface active agent (SURFRON K440, produced by Asahi Glass Co., Ltd.) and 2.3 g of a fluorine based surface active agent (MEGAFAG F120K, produced by Dainippon Ink and Chemicals, Inc.), which were dissolved in 43.2 g of methanol, were added and vigorously stirred to complete dissolution. Thereafter, 2.5 g of oleyl oleate was added. Finally, 75 g of silica (at an average particle diameter of 10 μm) dispersed into MEK at a concentration of one percent, employing a dissolver type homogenizer, was added while stirring, whereby a back coat layer liquid coating composition was prepared.

<Preparation of Back Coat Layer Protective Layer (Surface Protective Layer) Liquid Coating Composition>

Preparation was conducted employing the composition ratios below in the same manner as the back coat layer liquid coating composition. Silica was dispersed employing a dissolver type homogenizer.

| | |
|---|---|
| Cellulose acetate propionate (10 percent MEK solution) (CAP482-20, produced by Eastman Chemical Co.) | 15 g |
| Monodipsersed silica of a monodispersibility of 15 percent (at an average particle diameter and the added amount as silica are described in Table 5 (the surface was treated with aluminum in an amount of one percent of the total silica weight) | |
| $C_8F_{17}(CH_2CH_2O)_{12}C_8F_{17}$ | 0.05 g |
| Fluorine based surface active agent (SF-17) | 0.01 g |
| Stearic acid | 0.1 g |
| Oleyl oleate | 0.1 g |
| α-Alumina (at a Mohs hardness of 9) | 0.1 g |

<Preparation of Light-Sensitive Silver Halide Emulsion A1>

Preparation was conducted in the same manner as for Light-sensitive Silver Halide Emulsion A1 in Example 1.

<Preparation of Light-Sensitive Silver Halide Emulsion B1>

Preparation was conducted in the same manner as for Light-sensitive Silver Halide Emulsion B1 in Example 1.

<Preparation of Light-Sensitive Silver Halide Emulsion C>

Preparation was conducted in the same manner as for Light-sensitive Silver Halide Emulsion A1, except that potassium bromide employed during preparation of Light-sensitive Silver Halide Emulsion A1 was replaced with potassium iodide. The resulting emulsion was composed of monodispersed pure silver iodide grains of an average grain size of 25 nm, a variation coefficient of the particle size of 12 percent, and a [100] plane ratio of 92 percent (the content of the silver iodide was 100 mol percent).

<Preparation of Light-Sensitive Silver Halide Emulsion D>

Preparation was conducted in the same manner as for Light-sensitive Silver Halide Emulsion A1, except that some of the potassium bromide employed during preparation of Light-sensitive Silver Halide Emulsion A1 was replaced with potassium iodide to result in a silver iodide content ratio of 90 mol percent. The resulting emulsion was composed of monodispersed silver iodobromide grains of an average grain size of 25 nm, a variation coefficient of the particle size of 12 percent, and a [100] plane ratio of 92 percent (the content of the silver iodide was 90 mol percent).

<Preparation of Light-Sensitive Silver Halide Emulsion E>

Preparation was conducted in the same manner as for light-sensitive Silver Halide Emulsion C, except that the temperature during the addition, employing a double-jet method was changed to 45° C. The resulting emulsion was composed of monodispersed pure silver iodide grains of an average grain size of 55 nm, a variation coefficient of the particle size of 12 percent, and a [100] plane ratio of 92 percent (the content of the silver iodide was 100 mol percent).

<Preparation of Light-Sensitive Silver Halide Emulsion E>

Preparation was conducted in the same manner as for Light-sensitive Silver Halide Emulsion D, except that the temperature during the addition, employing a double-jet method, was changed to 45° C. The resulting emulsion was monodispersed pure silver iodide grains of an average grain size of 55 nm, a variation coefficient of the particle size of 12 percent, and a [100] plane ratio of 92 percent (the content of the silver iodide was 100 mol percent).

<Preparation of Light-Sensitive Silver Halide Emulsion G>

Light-sensitive Silver Halide Emulsion G was prepared in the same manner as Light-sensitive Silver Halide Emulsion C, except that after adding all of Solution F1 after nuclei formation, 4 ml of 0.1 percent ethanol solution of the described compound (ETTU) was added.

Incidentally, the resulting emulsion was composed of monodispersed pure silver iodide grains of an average grain size of 25 nm, a variation coefficient of the particle size of 12 percent, and a [100] plane ratio of 92 percent.

<Preparation of Light-Sensitive Silver Halide Emulsion H>

Light-sensitive Silver Halide Emulsion H was prepared in the same manner as for Light-sensitive Silver Halide Emulsion E, except that after adding all of Solution F1 after nuclei formation, 4 ml of 0.1 percent ethanol solution of the described compound (ETTU) was added.

The resulting emulsion was composed of monodispersed pure silver iodide grains of an average grain size of 55 nm, a variation coefficient of the particle size of 12 percent, and a [100] plane ratio of 92 percent.

<Preparation of Powdered Organic Silver Salts>

At 80° C., dissolved in 4,720 ml of pure water were 130.8 g of behenic acid, 67.7 g of arachidic acid, 43.6 g of stearic acid, and 2.3 g of palmitic acid. Subsequently, 540.2 ml of a 1.5 mol/L aqueous sodium hydroxide solution and 6.9 ml of concentrated nitric acid were added. Thereafter, the resulting mixture was cooled to 55° C., whereby a fatty acid sodium salt solution was obtained. While maintaining the above fatty acid sodium salt solution at 55° C., a light-sensitive silver halide emulsion (the type and added amount are described in Table 5) and 450 ml of pure water were added and stirred for 5 minutes. Subsequently, 469.4 ml of a one mol/T, silver nitrate solution was added over two minutes and stirred for an additional 10 minutes, whereby an organic silver salt dispersion was obtained. Thereafter, the resulting organic silver salt dispersion was transferred to a washing vessel and deionized water was added and stirred. While left standing, the organic silver salt dispersion was separated while floated, and water-soluble salts in the lower portion were removed. Thereafter, washing was repeated employing deionized water until the electric conductivity of the effluent reached 2 μS/cm. After centrifugal dehydration, until the moisture content reached 0.1 percent, the resulting cake-shaped organic silver salt was dried employing an airborne dryer FLASH JET DRYER (produced by Seishin Kikaku) under operation conditions (at 65° C. at, the inlet and 40° C. at the outlet) of the nitrogen gas ambience and the gas temperatures of the dryer, whereby dried organic silver salts in powder form were obtained.

<Preparation of Preliminary Dispersion>

Preparations was performed in the same manner as for the preliminary dispersion in Example 1.

<Preparation of Light-Sensitive Emulsion>

The preliminary dispersion was charged into a media type homogenizer, DISPERMAT TYPE SL-C12EX (produced by VMA-GETZMANN Co.) loaded with 0.5 mm diameter zirconia beads (TORESERUM, produced by Toray Industries, Inc.) to 80 percent of the interior capacity so that the retention time in the mill reached 1.5 minutes, and was dispersed at a peripheral rate of 8 m/second, whereby a light-sensitive emulsion was prepared.

<Preparation of Stabilizer Solution>

A stabilizer solution was prepared by dissolving 1 g of Stabilizer 1 and 0.31 g of potassium acetate in 4.97 g of methanol.

<Preparation of 2-Chlorobenzoic Acid Solution>

A 2-chlorobenzoic acid solution was prepared by dissolving 1.488 g of 2-chlorobenzoic acid, 2.779 g of Stabilizer 2, and 365 mg of 5-methyl-2-mercaptobenzimidazole in 31.3 ml of MEK in a darkened environment.

<Preparations of Addition Solution a>

Dissolved in 110 g of MEK were a reducing agent (the compound (the reducing agent) and the amount listed in Table 5), 0.159 g of a yellow forming leuco dye (YA-1), 0.159 g of a cyan forming leuco dye (CA-10), and 1.54 g of 4-methylphthalic acid, and the resulting solution was designated as Addition Solution a.

<Preparations of Addition Solution b>

Dissolved in 40.9 g of MEK were 1.56 g of Antifogging Agent 2, 0.5 g of Antifogging Agent 3, 0.5 g of Antifogging Agent 4, 0.5 g of Antifogging Agent 5, and 3.43 g of phthalazine, and the resulting solution was designated as Addition Solution b.

<Preparations of Addition Solution c>

Dissolved in 39.99 g of MEK was 0.01 g of Silver Saving Agent A(1) and the resulting solution was designated as Addition Solution c.

<Preparations of Addition Solution d>

Dissolved in 9.0 g of MEK was 0.5 g of sodium p-toluenethiosufonate and 0.5 g of Antifogging Agent 6, and the resulting solution was designated as Addition Solution d.

<Preparations of Addition Solution e>

Dissolved in 9.0 g of MEK was 1.0 g of vinylsulfone ($(CH_2{=}CH{-}SO_2CH_2)_2CHOH$), and the resulting solution was designated as Addition Solution e.

In an ambience of inert gases (97 percent nitrogen), while stirring, 50 g of described Light-sensitive Emulsion A and 15.11 g of MEK were maintained at 21° C., and 1,000 μl of Chemical Sensitizer S-5 (being a 0.5 percent methanol solution) was added. After two minutes, 390 μl of Antifogging Agent 1 (being a 10 percent methanol solution) was added and the resulting mixture was stirred for one hour. Further, 494 μl of calcium bromide (being a 10 percent methanol solution) was added, and the resulting mixture was stirred for 10 minutes. Thereafter, Cold Sensitizer Au-5 in an amount equivalent to 1/20 mol of the above organic chemical sensitizer was added and the resulting mixture was stirred for 20 minutes. Subsequently, 167 μl of a stabilizer solution was added and the resulting mixture was stirred for 10 minutes. Thereafter, 1.32 g of described 2-chlorobenzoic acid solution was added and the resulting mixture was stirred for one hour. Thereafter, the temperature was lowered to 13° C., and stirring was further performed for 30 minutes. While maintained at 13° C., 0.5 g of Addition Solution d, 0.5 g of Addition Solution e, and 13.31 g of the binders employed in the preliminary dispersion were added and the resulting mixture was stirred for 30 minutes. Thereafter, 1.084 g of tetrachlorophthalic acid (a 9.4 percent MEK solution) was added and the resulting mixture was stirred for 15 minutes. While stirring, 12.43 g of Addition Solution a, 1.6 ml of DESMODUR (isocyanate produced by Mobay Co.) (being a 10 percent MEK solution), 4.27 g of Addition Solution b, and 1.0 g of Addition Solution c were successively added, whereby an image forming layer liquid coating composition was obtained.

<Preparation of Image Forming Layer Protective Layer Underlayer (Surface Protective Layer Underlayer)>

While stirring, 230 g of cellulose acetate butyrate (CAB-171-15, produced by Eastman Chemical Co.) was added to a mixture of 500 g of acetone, 2,100 g of MEK, and 700 g of methanol and then dissolved. Subsequently, 25 g of phthalazine, 3.5 g of $CH_2{=}CHSO_2CH_2CH_2OCH_2CH_2SO_2CH{=}CH_2$, 1 g of $C_{12}F_{25}(CH_2CH_2O)_{10}C_{12}F_{25}$, 1 g of Compound SF-17 represented by General Formula (SF), 10 g of stearic acid, and 10 g of butyl stearate were added and then dissolved, whereby an image forming layer protective layer underlayer liquid coating composition was prepared.

<Preparation of Image Forming Layer Protective Layer Upper Layer (Surface Protective Layer Upper Layer)>

By employing a dissolver, 230 g of cellulose acetate butyrate (CAB-171-15, produced by Eastman Chemical Co.) was added to a mixture of 500 g of acetone, 2,100 g of MEK, and 700 g of methanol, and then dissolved. Subsequently, 25 g of phthalazine, 3.5 g of $CH_2{=}CHSO_2CH_2CH_2OCH_2CH_2SO_2CH{=}CH_2$, 1 g of $C_{12}F_{25}(CH_2CH_2O)_{10}C_{12}F_{25}$, 1 g of Compound SF-17 represented by General Formula (SF), 10 g of stearic acid, and 10 g of butyl stearate were added while stirring and then dissolved. Finally, monodispersed silica of a monodispersibility of 15 percent (the average particle diameter and the added amount as silica are listed in Table 5, and the surface was treated with aluminum in an amount of one percent of the total weight of the silica) was added while stirring, whereby an image forming layer protective layer upper layer liquid coating composition was prepared.

<Preparation of Photothermographic Materials>

The back coat layer liquid coating composition and the back coat layer protective layer liquid coating composition, both prepared as above, were applied onto Subbing Upper Layer B-2, employing an extrusion coater at a coating rate of 50 m/minute to result in a dried layer thickness of 3.5 μm for each. Incidentally, drying was performed over 5 minutes employing a drying air flow at 100° C. and a clew point of 10° C.

By simultaneously applying the above image forming layer liquid coating composition and image forming layer protective layer (being a surface protective layer) liquid coating composition onto Subbing Upper Layer A-2 at a coating rate of 50 m/minute, employing an extrusion coater, Light-sensitive Material Samples 21-39, listed in Table 5, were prepared. Coating was performed in such a manner that the image forming layer resulted in a coated silver weight of 1.2 g/m$^2$ and a dried layer thickness of the image forming layer protective layer (being surface protective layers) of 3.0 μm (1.5 μm of the surface protective payer uppers layer and 1.5 μm of the surface protective layer underlayer). Thereafter, drying was performed for 10 minutes employing a drying air flow of a temperature of 75° C. and a dew point of 10° C.

Incidentally, Sample 32 was prepared in the same manner as Sample 23, except that during preparation of the organic silver salt powder in Sample 23, 259.9 g of behenic acid was used instead of 130.8 g of behenic acid, 67.7 g of arachidic acid, 43.6 g of stearic acid and 2.3 g of palmitic acid.

Sample 33 was prepared in the same manner as Sample 23, except that during preparation of the organic silver salt powder, 540.2 ml of a 1.5 mol/L aqueous sodium hydroxide solution was replaced with 540.2 ml of a 1.5 mol/L potassium hydroxide aqueous solution.

Sample 34 was prepared in the same manner as Sample 23, except that fluorine based surface active agent SE-17 in the back coat layer protective layer and the image forming layer protective layer (both upper layer and underlayer) in Sample 23 was replaced with $C_8F_{17}SO_3Li$.

Sample 35 was prepared in the same manner as Sample 23, except that the $SO_3K$ group containing polyvinyl butyral (at a Tg of 75° C., and containing $SO_3K$ in an amount of 0.2 millimol/g) employed as an image forming layer binder during preparation of the preliminary dispersion in Sample 23 was replaced with a $SO_3K$ group containing polyvinyl butyral (at a Tg of 65° C. and containing $SO_3K$ in an amount of 2 millimol/g).

<Exposure and Photographic Processing>

After cutting each of Photothermographic Material Samples 21-39, prepared as above, into sheets of 34.5×43.0 cm, exposure and heat development (employing three panel heaters set at 107° C., 123° C. and 123° C. over a total time of 13.5 seconds) were simultaneously performed employing a laser imager (however, the laser beam source was changed from the 810 nm semiconductor laser to the 405 nm semiconductor laser (NLHV3000, produced by Nichia Chemical Industry), shown in FIGS. 1 and 2. Density of the resulting images was determined employing a densitometer. As used herein, the term "exposure and heat development were simultaneously performed" means that "on one sheet of the photothermographic material, while being partially exposed, development was initiated in the part of the exposed light-sensitive sheet". During this operation, the linear rate was 25 mm/second, while the distance between the exposure section and the development section was 12 cm. Incidentally, exposure and development were performed in a room at 23° C. and 50 percent relative humidity. Exposure was performed stepwise by decreasing the exposure energy amount by logE of 0.05 for each step.

(Packaging Materials)

PET 10 μm/PE 12 μm/aluminum foil 9 μm/Ny 15 μm/polyethylene 50 μm containing carbon in an amount of 3 percent, of an oxygen permeability of 0 ml/atm·$m^2$·25° C.·day, and a moisture permeability of 0 g/atm·$m^2$·25° C.·day. Paper trays were employed.

<Performance Evaluations>

Each of the images thermally developed in Examples 1 and 2 was subjected to the following performance evaluations.

<<Image Density>>

The value of the maximum density portion of the images obtained under the above conditions was determined employing a densitometer and represented as image density.

<<Photographic Speed>>

Density of images obtained under the above conditions was determined employing a densitometer, and a characteristic curve was prepared in which the abscissa represented the exposure amount and the ordinate represented the density. In the resulting characteristic curve, photographic speed was defined as the reciprocal number of the exposure amount which yielded a density which was 1.0 higher than the unexposed portions, whereby the photographic speed was determined. Incidentally, the phototrophic speed was represented by the relative value when each of Samples 1 and 21 was 100. Note: Each of the numerals in parenthesis in the relative photographic speed column was obtained as follows. In the comparison of the photographic speed obtained, in such a manner that before a light-sensitive material was exposed to white light, the above light-sensitive material was thermally processed at a heat development temperature, thereafter was exposed to white light (4874 K and 30 seconds) through an optical wedge, and thermally developed, to the photographic speed which was obtained such a manner that the light-sensitive material was not thermally processed prior to exposure, exposed to white light under the same conditions as above and thermally processed, the relative photographic speed of the former was shown when the photographic speed of the later was 100. Incidentally, based on the observation and measurement of variation of the spectral sensitivity spectra, it has been confirmed that in the above relative comparison, the main reason for the decrease in relative photographic speed of the sample which is prepared in such a manner that before a light-sensitive material is exposed to white light, the above light-sensitive material is thermally processed at heat development temperature is due to the fact that the relative relationship between the surface speed and inner speed of the silver halide grain varies due to the elimination or the decrease in spectral sensitization effects.

<<Retention Quality of Images Irradiated with Light>>

After each of the photothermographic samples was exposed and developed in the same manner as above, the resulting samples were adhered on a viewing box at a luminance of 1,000 lux and allowed to stand for 10 days. Thereafter, any variation of images was visually observed and evaluated based on the following criteria, at an interval of 0.5.

5: almost no variation was noticed

4: slight tone variation was noticed

3: tone variation as well as an increase in fog was noticed in some parts

2: tone variation as well an increase in fog was noticed in a significantly large part 1: tone variation as well as an increase in fog was pronounced and uneven density was generated over the entire surface <<Conveyance Properties>>

By employing a heat processor, photographic processing was performed 50 times, and the frequency of poor conveyance was determined.

<<Uneven Density During Heat Development>>

Uneven density after development was visually evaluated based on the criteria below.

5: no uneven density was generated

4: slight uneven density was generated

3: obvious uneven density was partly generated

2: significant uneven density was partly generated

1: significant uneven density was generated over the entire surface

<<Increase in Fog During Storage at High Temperature>>

The photothermographic materials, prepared as above, were stored in an airtight container maintained at 55° C. and 55 percent humidity for three days (being accelerated aging). As comparison, the same photothermographic materials were stored in a light-shielded container, maintained at 25° C. and 55 percent humidity for three days. These samples were processed in the same manner as those used for sensitometric evaluation, and the destiny of the fog portions was determined. An increase in fog was evaluated employing the formula below.

$$\Delta D\text{min(increase in fog)}=\text{(fog after accelerated aging)}-\text{(fog after comparison aging)}$$

<<Evaluation of Surface Roughness>>

The surface roughness of samples prior to thermal photographic processing was determined employing a non-contact three-dimensional surface analyzer (RST/PLUS, produced by WYKO Co.) while employing the methods below.

1) object lens: ×10.0, intermediate lens: ×1.02

2) measurement range: 463.4 μm×623.9 μm 3) pixel size: 368×2384

4) filter: cylindrical correction and decline correction 5) smoothing: medium smoothing 6) scanning speed: low Incidentally, Rz is as defined in JIS Surface Roughness (B0601). Each of the samples in size of 10 cm×10 cm was used. The sample was divided into 100 in a check pattern at an interval of 1 cm. Measurement was performed at the center of each square region, and the 100 measured values were averaged.

Tables 3, 4, 6, and 7 show the results.

TABLE 2

| Sample No. | Type and Amount (g) of Light-Sensitive Silver Halide Emulsion | Type and Amount (g) of Reducing Agent General Formula (1) | General Formula (2) | Silica in Back Coat Layer Protective Layer Average Particle Size (μm) | Added Amount (g) | Silica in Image Forming Layer Protective Layer (Upper Layer) Average Particle Size (μm) | Added Amount (g) | Remarks |
|---|---|---|---|---|---|---|---|---|
| 1 | A2/B2 = 36.2/9.1 | (1-1) = 4.20 | (2-6) = 23.78 | 10.0 | 0.03 | 3.0/10.0 | 0.280/0.028 | Inv. |
| 2 | A3/B2 = 36.2/9.1 | (1-1) = 4.20 | (2-6) = 23.78 | 10.0 | 0.03 | 3.0/10.0 | 0.280/0.028 | Inv. |
| 3 | A4/B2 = 36.2/9.1 | (1-1) = 4.20 | (2-6) = 23.78 | 10.0 | 0.03 | 3.0/10.0 | 0.280/0.028 | Inv. |
| 4 | A5/B2 = 36.2/9.1 | (1-1) = 4.20 | (2-6) = 23.78 | 10.0 | 0.03 | 3.0/10.0 | 0.280/0.028 | Inv. |
| 5 | A4/B2 = 36.2/9.1 | (1-7) = 4.20 | (2-6) = 23.78 | 10.0 | 0.03 | 3.0/10.0 | 0.280/0.028 | Inv. |
| 6 | A4/B2 = 36.2/9.1 | (1-10) = 4.20 | (2-6) = 23.78 | 10.0 | 0.03 | 2.0/10.0 | 0.280/0.028 | Inv. |
| 7 | A4/B2 = 36.2/9.1 | (1-10) = 4.20 | (2-2) = 23.78 | 10.0 | 0.03 | 3.0/12.0 | 0.280/0.028 | Inv. |
| 8 | A4/B2 = 36.2/9.1 | (1-10) = 4.20 | (2-6) = 23.78 | 10.0 | 0.03 | 3.0/10.0 | 0.300/0.030 | Inv. |
| 9 | A4/B2 = 36.2/9.1 | (1-10) = 4.20 | (2-6) = 23.78 | 3.0/10.0 | 0.280/0.042 | 3.0 | 0.14 | Inv. |
| 10 | A4/B2 = 36.2/9.1 | (1-10) = 4.20 | (2-6) = 23.78 | 2.0/10.0 | 0.280/0.042 | 3.0 | 0.14 | Inv. |
| 11 | A4/B2 = 36.2/9.1 | (1-10) = 4.20 | (2-6) = 23.78 | 3.0/12.0 | 0.280/0.042 | 3.0 | 0.14 | Inv. |
| 12 | A4/B2 = 36.2/9.1 | (1-10) = 4.20 | (2-6) = 23.78 | 3.0/10.0 | 0.300/0.045 | 3.0 | 0.14 | Inv. |
| 13 | A4/B2 = 36.2/9.1 | (1-1) = 4.20 | (2-6) = 23.78 | 10.0 | 0.03 | 3.0/10.0 | 0.280/0.028 | Inv. |
| 14 | A4/B2 = 36.2/9.1 | (1-1) = 4.20 | (2-6) = 23.78 | 10.0 | 0.03 | 3.0/10.0 | 0.280/0.028 | Inv. |
| 15 | A4/B2 = 36.2/9.1 | (1-1) = 4.20 | (2-6) = 23.78 | 10.0 | 0.03 | 3.0/10.0 | 0.280/0.028 | Inv. |
| 16 | A4/B2 = 36.2/9.1 | (1-1) = 4.20 | (2-6) = 23.78 | 10.0 | 0.03 | 3.0/10.0 | 0.280/0.028 | Inv. |
| 17 | A1/B1 = 36.2/9.1 | (1-1) = 4.20 | (2-6) = 23.78 | 10.0 | 0.03 | 3.0/10.0 | 0.280/0.028 | Inv. |
| 18 | A1/B1 = 36.2/9.1 | (1-1) = 4.20 | (2-6) = 23.78 | 6.0 | 0.03 | 3.0/4.0 | 0.140/0.014 | Comp. |
| 19 | A1/B1 = 36.2/9.1 | (1-1) = 4.20 | (2-6) = 23.78 | 6.0 | 0.03 | 0.6/5.0 | 0.140/0.014 | Comp. |
| 20 | A1/B1 = 36.2/9.1 | (1-1) = 4.20 | (2-6) = 23.78 | 6.0 | 0.03 | 3.0 | 0.14 | Comp. |

Inv.: Present Invention
Comp.: Comparative Example

TABLE 3

| Sample No. | LB/LA | Ra(E) (μm) | Rz(E) (μm) | Ra(B) (μm) | Rz(B) (μm) | Rz(E)/Rz(B) | Rz(E)/Ra(E) | Rz(B)/Ra(B) | Remarks |
|---|---|---|---|---|---|---|---|---|---|
| 1 | 3.3 | 0.140 | 3.50 | 0.117 | 6.77 | 0.52 | 25.0 | 57.9 | Inv. |
| 2 | 3.3 | 0.142 | 3.51 | 0.116 | 6.80 | 0.52 | 24.7 | 58.6 | Inv. |
| 3 | 3.3 | 0.142 | 3.52 | 0.122 | 6.82 | 0.52 | 24.8 | 55.9 | Inv. |
| 4 | 3.3 | 0.138 | 3.47 | 0.121 | 6.75 | 0.51 | 25.1 | 55.8 | Inv. |
| 5 | 3.3 | 0.141 | 3.52 | 0.115 | 6.78 | 0.52 | 25.0 | 59.0 | Inv. |
| 6 | 5.0 | 0.135 | 3.40 | 0.116 | 6.79 | 0.50 | 25.2 | 58.5 | Inv. |
| 7 | 4.0 | 0.143 | 3.56 | 0.116 | 6.81 | 0.52 | 24.9 | 58.7 | Inv. |
| 8 | 3.3 | 0.147 | 3.55 | 0.118 | 6.80 | 0.52 | 24.1 | 57.6 | Inv. |
| 9 | 3.3 | 0.083 | 1.18 | 0.148 | 7.42 | 0.16 | 14.2 | 50.1 | Inv. |
| 10 | 5.0 | 0.082 | 1.15 | 0.134 | 7.26 | 0.16 | 14.0 | 54.2 | Inv. |
| 11 | 4.0 | 0.081 | 1.14 | 0.141 | 7.83 | 0.15 | 14.1 | 55.5 | Inv. |
| 12 | 3.3 | 0.084 | 1.21 | 0.144 | 8.14 | 0.15 | 14.4 | 56.5 | Inv. |
| 13 | 3.3 | 0.141 | 3.47 | 0.114 | 6.78 | 0.51 | 24.6 | 59.5 | Inv. |
| 14 | 3.3 | 0.143 | 3.49 | 0.115 | 6.83 | 0.51 | 24.4 | 59.4 | Inv. |
| 15 | 3.3 | 0.137 | 3.53 | 0.116 | 6.81 | 0.52 | 25.8 | 58.7 | Inv. |
| 16 | 3.3 | 0.139 | 3.44 | 0.118 | 6.82 | 0.50 | 24.7 | 57.8 | Inv. |
| 17 | 3.3 | 0.142 | 3.50 | 0.114 | 6.78 | 0.52 | 24.6 | 59.5 | Inv. |
| 18 | 1.3 | 0.115 | 1.32 | 0.095 | 4.12 | 0.32 | 11.5 | 43.4 | Comp. |
| 19 | 8.3 | 0.032 | 1.04 | 0.092 | 4.11 | 0.25 | 32.5 | 44.7 | Comp. |
| 20 | — | 0.106 | 1.17 | 0.093 | 4.14 | 0.28 | 11.0 | 44.5 | Comp. |

Inv.: Present Invention
Comp.: Comparative Example

TABLE 4

| Sample No. | Image Density | Relative Photographic Speed | Retention Quality of Image Irradiated by Light | Increase in Fog During Storage at High Temperature | Conveyance Properties | Uneven Density During Heat Development | Remarks |
|---|---|---|---|---|---|---|---|
| 1 | 4.0 | 100 (5) | 4.0 | 0.003 | 0 | 4.5 | Inv. |
| 2 | 4.1 | 99 (5) | 4.0 | 0.003 | 0 | 4.5 | Inv. |
| 3 | 4.2 | 102 (4) | 4.5 | 0.002 | 0 | 5.0 | Inv. |
| 4 | 4.2 | 101 (4) | 4.5 | 0.002 | 0 | 5.0 | Inv. |
| 5 | 4.2 | 102 (4) | 4.5 | 0.003 | 0 | 5.0 | Inv. |
| 6 | 4.6 | 101 (4) | 4.5 | 0.003 | 0 | 5.0 | Inv. |

TABLE 4-continued

| Sample No. | Image Density | Relative Photographic Speed | Retention Quality of Image Irradiated by Light | Increase in Fog During Storage at High Temperature | Conveyance Properties | Uneven Density During Heat Development | Remarks |
|---|---|---|---|---|---|---|---|
| 7 | 4.6 | 102 (4) | 5.0 | 0.003 | 0 | 5.0 | Inv. |
| 8 | 4.5 | 102 (4) | 4.5 | 0.003 | 0 | 5.0 | Inv. |
| 9 | 4.6 | 101 (4) | 4.5 | 0.003 | 1 | 4.0 | Inv. |
| 10 | 4.6 | 101 (4) | 4.5 | 0.002 | 1 | 4.0 | Inv. |
| 11 | 4.5 | 102 (4) | 4.5 | 0.002 | 1 | 4.0 | Inv. |
| 12 | 4.6 | 102 (4) | 4.5 | 0.003 | 1 | 4.0 | Inv. |
| 13 | 4.0 | 102 (4) | 5.0 | 0.003 | 0 | 5.0 | Inv. |
| 14 | 4.4 | 103 (4) | 4.5 | 0.002 | 0 | 5.0 | Inv. |
| 15 | 4.1 | 101 (4) | 4.5 | 0.003 | 1 | 4.0 | Inv. |
| 16 | 4.3 | 102 (4) | 4.5 | 0.003 | 1 | 4.5 | Inv. |
| 17 | 3.8 | 100 (22) | 3.5 | 0.003 | 0 | 4.5 | Inv. |
| 18 | 3.7 | 100 (23) | 3.0 | 0.006 | 7 | 2.5 | Comp. |
| 19 | 3.7 | 99 (23) | 3.0 | 0.006 | 8 | 2.5 | Comp. |
| 20 | 3.6 | 99 (23) | 3.0 | 0.007 | 10 | 2.5 | Comp. |

Inv.: Present Invention
Comp.: Comparative Example

TABLE 5

| Sample No. | Type and Amount (g) of Light-Sensitive Silver Halide Emulsion | Type and Amount (g) of Reducing Agent: General Formula (1) | Type and Amount (g) of Reducing Agent: General Formula (2) | Silica in Back Coat Layer Protective Layer: Average Particle Size (μm) | Silica in Back Coat Layer Protective Layer: Added Amount (g) | Silica in Image Forming Layer Protective Layer (Upper Layer): Average Particle Size (μm) | Silica in Image Forming Layer Protective Layer (Upper Layer): Added Amount (g) | Remarks |
|---|---|---|---|---|---|---|---|---|
| 21 | C/E = 36.2/9.1 | (1-1) = 4.20 | (2-6) = 23.78 | 10.0 | 0.03 | 3.0/10.0 | 28.0/2.80 | Inv. |
| 22 | D/F = 36.2/9.1 | (1-1) = 4.20 | (2-6) = 23.78 | 10.0 | 0.03 | 3.0/10.0 | 28.0/2.80 | Inv. |
| 23 | G/H = 36.2/9.1 | (1-1) = 4.20 | (2-6) = 23.78 | 10.0 | 0.03 | 3.0/10.0 | 28.0/2.80 | Inv. |
| 24 | G/H = 36.2/9.1 | (1-7) = 4.20 | (2-6) = 23.78 | 10.0 | 0.03 | 3.0/10.0 | 28.0/2.80 | Inv. |
| 25 | G/H = 36.2/9.1 | (1-10) = 4.20 | (2-6) = 23.78 | 10.0 | 0.03 | 2.0/10.0 | 28.0/2.80 | Inv. |
| 26 | G/H = 36.2/9.1 | (1-10) = 4.20 | (2-2) = 23.78 | 10.0 | 0.03 | 3.0/12.0 | 28.0/2.80 | Inv. |
| 27 | G/H = 36.2/9.1 | (1-10) = 4.20 | (2-6) = 23.78 | 10.0 | 0.03 | 3.0/10.0 | 30.0/3.00 | Inv. |
| 28 | G/H = 36.2/9.1 | (1-10) = 4.20 | (2-6) = 23.78 | 3.0/10.0 | 0.280/0.042 | 3.0 | 14.0 | Inv. |
| 29 | G/H = 36.2/9.1 | (1-10) = 4.20 | (2-6) = 23.78 | 2.0/10.0 | 0.280/0.042 | 3.0 | 14.0 | Inv. |
| 30 | G/H = 36.2/9.1 | (1-10) = 4.20 | (2-6) = 23.78 | 3.0/12.0 | 0.280/0.042 | 3.0 | 14.0 | Inv. |
| 31 | G/H = 36.2/9.1 | (1-10) = 4.20 | (2-6) = 23.78 | 3.0/10.0 | 0.300/0.045 | 3.0 | 14.0 | Inv. |
| 32 | G/H = 36.2/9.1 | (1-1) = 4.20 | (2-6) = 23.78 | 10.0 | 0.03 | 3.0/10.0 | 28.0/2.80 | Inv. |
| 33 | G/H = 36.2/9.1 | (1-1) = 4.20 | (2-6) = 23.78 | 10.0 | 0.03 | 3.0/10.0 | 28.0/2.80 | Inv. |
| 34 | G/H = 36.2/9.1 | (1-1) = 4.20 | (2-6) = 23.78 | 10.0 | 0.03 | 3.0/10.0 | 28.0/2.80 | Inv. |
| 35 | G/H = 36.2/9.1 | (1-1) = 4.20 | (2-6) = 23.78 | 10.0 | 0.03 | 3.0/10.0 | 28.0/2.80 | Inv. |
| 36 | A1/B1 = 36.2/9.1 | (1-1) = 4.20 | (2-6) = 23.78 | 10.0 | 0.03 | 3.0/10.0 | 28.0/2.80 | Inv. |
| 37 | A1/B1 = 36.2/9.1 | (1-1) = 4.20 | (2-6) = 23.78 | 6.0 | 0.03 | 3.0/4.0 | 14.0/1.40 | Comp. |
| 38 | A1/B1 = 36.2/9.1 | (1-1) = 4.20 | (2-6) = 23.78 | 6.0 | 0.03 | 0.6/5.0 | 14.0/1.40 | Comp. |
| 39 | A1/B1 = 36.2/9.1 | (1-1) = 4.20 | (2-6) = 23.78 | 6.0 | 0.03 | 3.0 | 14.0 | Comp. |

Inv.: Present Invention
Comp.: Comparative Example

TABLE 6

| Sample No. | LB/LA | Ra(E) (μm) | Rz(E) (μm) | Ra(B) (μm) | Rz(B) (μm) | Rz(E)/Rz(B) | Rz(E)/Ra(E) | Rz(B)/Ra(B) | Remarks |
|---|---|---|---|---|---|---|---|---|---|
| 21 | 3.3 | 0.138 | 3.48 | 0.117 | 6.79 | 0.51 | 25.2 | 58.0 | Inv. |
| 22 | 3.3 | 0.139 | 3.48 | 0.116 | 6.78 | 0.51 | 25.0 | 58.4 | Inv. |
| 23 | 3.3 | 0.138 | 3.48 | 0.122 | 6.78 | 0.51 | 25.2 | 55.6 | Inv. |
| 24 | 3.3 | 0.140 | 3.49 | 0.115 | 6.70 | 0.52 | 24.9 | 58.3 | Inv. |
| 25 | 5.0 | 0.134 | 3.41 | 0.116 | 6.78 | 0.50 | 25.4 | 58.4 | Inv. |
| 26 | 4.0 | 0.140 | 3.55 | 0.116 | 6.79 | 0.52 | 25.4 | 58.5 | Inv. |
| 27 | 3.3 | 0.145 | 3.57 | 0.118 | 6.80 | 0.53 | 24.6 | 57.6 | Inv. |
| 28 | 3.3 | 0.081 | 1.16 | 0.148 | 7.43 | 0.16 | 14.3 | 50.2 | Inv. |
| 29 | 5.0 | 0.080 | 1.15 | 0.134 | 7.28 | 0.16 | 14.4 | 54.3 | Inv. |
| 30 | 4.0 | 0.082 | 1.16 | 0.141 | 7.41 | 0.16 | 14.1 | 52.6 | Inv. |
| 31 | 3.3 | 0.081 | 1.15 | 0.151 | 8.09 | 0.14 | 14.2 | 53.6 | Inv. |
| 32 | 3.3 | 0.140 | 3.46 | 0.114 | 6.75 | 0.51 | 24.7 | 59.2 | Inv. |
| 33 | 3.3 | 0.138 | 3.47 | 0.115 | 6.77 | 0.51 | 25.1 | 58.9 | Inv. |
| 34 | 3.3 | 0.139 | 3.48 | 0.116 | 6.79 | 0.51 | 25.0 | 58.5 | Inv. |
| 35 | 3.3 | 0.141 | 3.50 | 0.118 | 6.81 | 0.51 | 24.8 | 57.7 | Inv. |

TABLE 6-continued

| Sample No. | LB/LA | Ra(E) (μm) | Rz(E) (μm) | Ra(B) (μm) | Rz(B) (μm) | Rz(E)/ Rz(B) | Rz(E)/ Ra(E) | Rz(B)/ Ra(B) | Remarks |
|---|---|---|---|---|---|---|---|---|---|
| 36 | 3.3 | 0.139 | 3.48 | 0.114 | 6.80 | 0.51 | 25.0 | 59.6 | Inv. |
| 37 | 1.3 | 0.116 | 1.30 | 0.095 | 4.22 | 0.31 | 11.2 | 44.4 | Comp. |
| 38 | 8.3 | 0.030 | 1.07 | 0.092 | 4.20 | 0.25 | 35.7 | 45.7 | Comp. |
| 39 | — | 0.104 | 1.17 | 0.088 | 4.17 | 0.28 | 11.3 | 47.4 | Comp. |

Inv.: Present Invention
Comp.: Comparative Example

TABLE 7

| Sample No. | Image Density | Relative Photographic Speed | Retention Quality of Image Irradiated by Light | Increase in Fog During Storage at High Temperature | Conveyance Properties | Uneven Density During Heat Development | Remarks |
|---|---|---|---|---|---|---|---|
| 21 | 4.2 | 100 (15) | 4.0 | 0.003 | 0 | 4.5 | Inv. |
| 22 | 4.1 | 101 (16) | 4.0 | 0.003 | 0 | 4.5 | Inv. |
| 23 | 4.2 | 102 (4) | 4.5 | 0.003 | 0 | 5.0 | Inv. |
| 24 | 4.3 | 101 (4) | 4.5 | 0.003 | 0 | 5.0 | Inv. |
| 25 | 4.7 | 102 (4) | 4.5 | 0.003 | 0 | 5.0 | Inv. |
| 26 | 4.6 | 102 (4) | 5.0 | 0.003 | 0 | 5.0 | Inv. |
| 27 | 4.5 | 102 (4) | 4.5 | 0.003 | 0 | 5.0 | Inv. |
| 28 | 4.5 | 101 (4) | 4.5 | 0.003 | 1 | 4.0 | Inv. |
| 29 | 4.5 | 101 (4) | 4.5 | 0.002 | 1 | 4.0 | Inv. |
| 30 | 4.5 | 102 (4) | 4.5 | 0.002 | 1 | 4.0 | Inv. |
| 31 | 4.6 | 102 (4) | 4.5 | 0.003 | 1 | 4.0 | Inv. |
| 32 | 4.0 | 101 (4) | 5.0 | 0.003 | 0 | 4.5 | Inv. |
| 33 | 4.4 | 102 (4) | 4.5 | 0.002 | 0 | 5.0 | Inv. |
| 34 | 4.1 | 101 (4) | 4.5 | 0.004 | 1 | 4.0 | Inv. |
| 35 | 4.3 | 102 (5) | 4.5 | 0.005 | 1 | 4.5 | Inv. |
| 36 | 3.9 | 99 (22) | 3.5 | 0.003 | 0 | 4.5 | Inv. |
| 37 | 3.6 | 99 (23) | 3.0 | 0.006 | 9 | 2.5 | Comp. |
| 38 | 3.7 | 99 (23) | 3.0 | 0.006 | 9 | 2.5 | Comp. |
| 39 | 3.6 | 99 (23) | 3.0 | 0.007 | 11 | 2.5 | Comp. |

Inv.: Present Invention
Comp.: Comparative Example

Based on Tables 4 and 7, it is clearly seen that compared to the comparative samples, the samples of the present invention exhibit excellent retention quality of light irradiated images, minimize uneven density during heat development, while maintaining high density, as well as exhibiting excellent conveyance properties and minimize an increase in fog during storage at high temperature.

Further, when Samples 15 and 3 are compared, it was found that Sample 3 exhibited superior characteristics in terms of conveyance properties as well as environmental adaptability (accumulation properties in organism).

Still further, when Samples 34 and 23 are compared, it was found that Sample 23 exhibited superior characteristics in terms of conveyance properties and environmental adaptability (accumulation properties in organism).

Based on the present invention, it is possible to provide a photothermographic material which exhibits excellent retention quality of light irradiated images, minimizes uneven density during heat development, exhibits excellent conveyance properties, and minimizes an increase in fog during storage at high temperature, while maintaining high density even in cases in which quick processing is performed, and an image forming method.

What is claimed is:

1. A method of forming an image using a photothermographic material containing a support having:

an image forming layer which contains an organic silver salt, silver halide grains, a binder and a reducing agent on one side of the support; and a backing layer on the other side of the support opposite the image forming layer, the method comprising the steps of:

imagewise exposing the photothermographic material to light to form a latent image; and simultaneously or sequentially heating the exposed photothermographic material to develop the latent image, wherein a center-line mean roughness Ra(E) of an outermost surface of a side having the image forming layer is from 125 to 200 nm;

a ratio of a ten-point mean roughness Rz(E) of the outermost surface of the side having the image forming layer to a ten-point mean roughness Rz(B) the outermost surface of the side having the backing layer, Rz(E)/Rz(B), is from 0.10 to 0.70; and Rz(E) is from 3.0 to 5.0 μm.

2. A method of forming an image using a photothermographic material containing a support having:

an image forming layer which contains an organic silver salt, silver halide grains, a binder and a reducing agent on one side of the support; and a backing layer on the other side of the support opposite the image forming layer, the method comprising the steps of:

imagewise exposing the photothermographic material to light to form a latent image; and simultaneously or sequentially heating the exposed photothermographic material to develop the latent image, wherein a center-line mean roughness Ra(B) of an outermost surface of a side having the backing layer is from 105 to 200 nm;

a ratio of a ten-point mean roughness Rz(E) of the outermost surface of a side having the image forming layer to a ten-point mean roughness Rz(B) of the outermost surface of the side having the backing layer, Rz(E)/Rz(B), is from 0.10 to 0.70; and Rz(B) is from 5.0 to 8.0 μm.

3. The method of forming an image of claim 1, wherein each of the silver halide grains contains silver iodide in an amount of 5 to 100 mol %.

4. The method of forming an image of claim 2, wherein each of the silver halide grains contains silver iodide in an amount of 5 to 100 mol %.

5. The method of forming an image of claim 1, wherein a surface sensitivity of the silver halide grains decreases after heat development of the photothermographic material.

6. The method of forming an image of claim 2, wherein a surface sensitivity of the silver halide grains decreases after heat development of the photothermographic material.

7. The method of forming an image of claim 1, wherein a ratio of a ten-point mean roughness Rz(E) of the outermost surface of the side having the image forming layer to a center-line mean roughness Ra(E) of the outermost surface of the side having the image forming layer, Rz(E)/Ra(E), is from 10 to 70.

8. The method of forming an image of claim 2, wherein a ratio of a ten-point mean roughness Rz(E) of the outermost surface of the side having the image forming layer to a center-line mean roughness Ra(E) of the outermost surface of the side having the image forming layer, Rz(E)/Ra(E), is from 10 to 70.

9. The method of forming an image of claim 1, wherein a ratio of a ten-point mean roughness Rz(B) of the outermost surface of the side having the backing layer to a center-line mean roughness Ra(B) of the outermost surface of the side having the backing layer, Rz(B)/Ra(B), is from 20 to 70.

10. The method of forming an image of claim 2, wherein a ratio of a ten-point mean roughness Rz(B) of the outermost surface of the side having the backing layer to a center-line mean roughness Ra(B) of the outermost surface of the side having the backing layer, Rz(B)/Ra(B), is from 20 to 70.

11. The method of forming an image of claim 1, wherein a transporting speed of the exposed photothermographic material during heating is from 20 to 200 mm/sec.

12. The method of forming an image of claim 2, wherein a transporting speed of the exposed photothermographic material during heating is from 20 to 200 mm/sec.

13. The method of forming an image of claim 1, wherein imagewise exposure of the photothermographic material is carried out with a laser having a luminescence peak in the range of 350 to 450 nm.

14. The method of forming an image of claim 2, wherein imagewise exposure of the photothermographic material is carried out with a laser having a luminescence peak in the range of 350 to 450 nm.

* * * * *